US012546137B2

(12) United States Patent
Vandenbark et al.

(10) Patent No.: US 12,546,137 B2
(45) Date of Patent: Feb. 10, 2026

(54) PORTABLE BARRIER AND ASSOCIATED METHOD OF USE

(71) Applicant: Shadiant LLC, Indianapolis, IN (US)

(72) Inventors: Gary A. Vandenbark, Greenfield, IN (US); Paul J. Maginot, McCordsville, IN (US); Robert G. Glass, Indianapolis, IN (US)

(73) Assignee: Shadiant, LLC, Indianapolis, IN (US)

( * ) Notice: Subject to any disclaimer, the term of this patent is extended or adjusted under 35 U.S.C. 154(b) by 247 days.

(21) Appl. No.: 18/343,649

(22) Filed: Jun. 28, 2023

(65) Prior Publication Data

US 2024/0011318 A1 Jan. 11, 2024

Related U.S. Application Data

(60) Provisional application No. 63/358,815, filed on Jul. 6, 2022.

(51) Int. Cl.
*E04H 15/48* (2006.01)
*E04H 15/38* (2006.01)

(52) U.S. Cl.
CPC ..... *E04H 15/48* (2013.01); *E04H 15/38* (2013.01)

(58) Field of Classification Search
CPC ..... E04H 15/496; E04H 15/38
See application file for complete search history.

(56) References Cited

U.S. PATENT DOCUMENTS 1,913,572 A 6/1933 Hugo
2,166,625 A 7/1939 Deak
2,910,078 A 10/1959 Schunck
2,969,075 A 1/1961 Girten
2,992,649 A 7/1961 Swallow
3,007,735 A 11/1961 Cohn
3,063,718 A 11/1962 Steinkamp
3,182,672 A 5/1965 Biller
(Continued)

FOREIGN PATENT DOCUMENTS

GB 2259927 3/1993

OTHER PUBLICATIONS

International Search Report and Written Opinion corresponding to PCT Application No. PCT/US2014/056058, mailed Dec. 15, 2014 (13 pages).

*Primary Examiner* — David R Dunn
*Assistant Examiner* — Danielle Jackson

(57) ABSTRACT

A method of setting up a portable barrier that includes a pedestal assembly with first and second legs, a cover assembly with first and second arms, and a tensioner is disclosed. The method includes (a) moving the first leg from a collapsed configuration to an expanded configuration, (b) moving the second leg from a collapsed configuration to an expanded configuration, (c) moving the first arm from a collapsed configuration to an expanded configuration, and (d) moving the second arm from a collapsed configuration to an expanded configuration, (e) moving the tensioner from a collapsed configuration to an expanded configuration; and (f) while the tensioner is positioned in its expanded configuration, maintaining with the tensioner: (1) the first leg in its expanded configuration, (2) the second leg in its expanded leg configuration, (3) the first arm in its expanded configuration, and (4) the second arm in its expanded configuration.

18 Claims, 88 Drawing Sheets

(56) References Cited

U.S. PATENT DOCUMENTS

| | | | | |
|---|---|---|---|---|
| 3,190,300 | A | 6/1965 | Wear'n | |
| 3,368,575 | A | 2/1968 | Besonen | |
| 3,374,508 | A | 3/1968 | Slimovitz | |
| 3,405,721 | A | 10/1968 | Crosier | |
| 3,491,781 | A | 1/1970 | Reese | |
| 3,513,861 | A | 5/1970 | Johnson | |
| 3,581,751 | A | 6/1971 | Evans | |
| 3,874,398 | A | 4/1975 | Hendrickson | |
| 4,069,833 | A | 1/1978 | Johansson | |
| 4,098,281 | A | 7/1978 | Bonfilio | |
| 4,227,542 | A | 10/1980 | Bonfilio | |
| 4,275,921 | A | 6/1981 | Genin | |
| 4,520,835 | A | 6/1985 | Moeller | |
| 4,640,332 | A | 2/1987 | Turner | |
| 5,025,819 | A | 6/1991 | Taylor | |
| 5,159,947 | A | 11/1992 | Chuang | |
| 5,271,423 | A | 12/1993 | Eychaner | |
| 5,301,706 | A | 4/1994 | Jones | |
| 5,441,066 | A | 8/1995 | Harris | |
| 5,573,027 | A | 11/1996 | Hsiung | |
| 5,752,537 | A | 5/1998 | Kranzler | |
| 5,771,912 | A | 6/1998 | Swetish | |
| 5,901,726 | A | 5/1999 | Gal | |
| 6,089,245 | A | 7/2000 | Tseytlin | |
| 6,123,091 | A | 9/2000 | Flynn | |
| 6,334,455 | B1 | 1/2002 | Nunez | |
| 6,439,645 | B1 | 8/2002 | Pedersen | |
| 6,681,786 | B2 | 1/2004 | Ju | |
| 6,823,883 | B1 | 11/2004 | Sears | |
| 6,964,277 | B2 | 11/2005 | Naber | |
| 7,137,399 | B1 | 11/2006 | Ransom | |
| 7,735,503 | B2 | 6/2010 | Jenkinson | |
| 8,079,380 | B2 | 12/2011 | Engstrom | |
| 8,156,952 | B2 | 4/2012 | Chesness | |
| 8,171,948 | B2 | 5/2012 | Maginot | |
| 8,176,928 | B2 | 5/2012 | Maginot | |
| 8,205,628 | B2 | 6/2012 | Maginot | |
| 8,464,739 | B2 | 6/2013 | Maginot | |
| 8,555,909 | B2 | 10/2013 | Chen | |
| 8,651,125 | B2 | 2/2014 | Maginot | |
| 8,978,681 | B2 | 3/2015 | Maginot | |
| 9,273,484 | B2 | 3/2016 | Rowley | |
| 9,470,011 | B2 | 10/2016 | Maginot | |
| 9,493,963 | B2 | 11/2016 | Maginot | |
| 9,879,443 | B2 | 1/2018 | Maginot | |
| 9,896,863 | B2 | 2/2018 | Maginot | |
| 10,563,423 | B1 | 2/2020 | Bird | |
| 10,689,878 | B2 | 6/2020 | Vandenbark | |
| 10,724,268 | B2 | 7/2020 | Maginot | |
| 10,767,387 | B2 | 9/2020 | Bird | |
| 11,156,013 | B2 | 10/2021 | Volin | |
| 11,326,365 | B2 | 5/2022 | Vandenbark | |
| 11,414,884 | B2 | 8/2022 | Maginot | |
| 11,421,440 | B2 | 8/2022 | Bird | |
| 11,674,331 | B2 | 6/2023 | Vandenbark | |
| 11,746,556 | B2 | 9/2023 | Bird | |
| 12,188,250 | B2 * | 1/2025 | Vandenbark | E04H 15/58 |
| 2003/0046855 | A1 | 3/2003 | Bergdall | |
| 2005/0056309 | A1 | 3/2005 | Bree | |
| 2009/0039685 | A1 | 2/2009 | Zernov | |
| 2009/0320893 | A1 | 12/2009 | Engstrom | |
| 2012/0005879 | A1 | 1/2012 | Maginot | |
| 2012/0006372 | A1 | 1/2012 | Maginot | |
| 2012/0006374 | A1 | 1/2012 | Maginot | |
| 2012/0006375 | A1 | 1/2012 | Maginot | |
| 2012/0055525 | A1 | 3/2012 | Choi | |
| 2012/0216846 | A1 | 8/2012 | Maginot | |
| 2014/0144475 | A1 | 5/2014 | Maginot | |
| 2015/0075577 | A1 * | 3/2015 | Maginot | E04H 15/56 135/147 |
| 2015/0184418 | A1 | 7/2015 | Maginot | |
| 2015/0308147 | A1 | 10/2015 | Lee | |
| 2017/0058554 | A1 * | 3/2017 | Maginot | E04H 15/44 |
| 2018/0171658 | A1 * | 6/2018 | Vandenbark | E04H 15/54 |
| 2020/0318377 | A1 * | 10/2020 | Vandenbark | E04H 15/56 |
| 2022/0259885 | A1 * | 8/2022 | Vandenbark | E04H 15/38 |
| 2023/0313557 | A1 * | 10/2023 | Vandenbark | E04H 15/56 135/117 |
| 2025/0122746 | A1 * | 4/2025 | Vandenbark | E04H 15/54 |

* cited by examiner

PORTABLE BARRIER AND ASSOCIATED METHOD OF USE

This application claims the benefit of priority of U.S. provisional application Ser. No. 63/358,815, filed on Jul. 6, 2022, the disclosure of which is herein incorporated by reference in its entirety.

BACKGROUND

The present disclosure relates generally to devices configured to protect or shield an individual from environmental elements such as the sun, wind, and rain. More particularly, the present disclosure relates to portable barriers or screening devices that can be quickly deployed at a location where protection from the elements is desired such as a beach or a sideline of a sporting event, and then readily collapsed and transported after use.

Various existing devices for protecting or shielding an individual from environmental elements have been designed. These devices, however, each have drawbacks such as being time consuming and complicated to deploy for use and collapse for subsequent transportation and storage thereof. Also, many of these devices are complicated to manufacture. In addition, the use of a traditional umbrella as a means of protecting an individual from the elements has substantial drawbacks, for example, as requiring constant manual effort or a staking mechanism to hold it upright. These existing prior art devices fail in many respects to meet the needs of the beach visitor, sports spectator, and outdoor enthusiast.

One type of existing protecting or shielding device that overcame many drawbacks of the type of devices identified above is disclosed in the following U.S. Pat. Nos. 8,171,948; 8,176,928; 8,205,628; 8,464,739; 8,651,125; 8,978,681; 9,470,011; 9,896,863; and 10,724,268. However, while this type of design has substantial benefits over its predecessor designs, it possessed a relatively large footprint after it was folded up in its stowed position (or storage mode).

Another type of existing protecting or shielding device that overcame many drawbacks of the type of devices identified above is disclosed in the following U.S. Pat. Nos. 9,493,963; 9,879,443; 10,689,878; and 11,326,365 (hereinafter the'365 Patent). While this type of design has substantial benefits over previous designs, there still exists a drawback. Specifically, in this type of design, after the collapsed portable barrier is removed from the carry bag, the user is required to rotate a lower part of the collapsed portable barrier relative to an upper part of the collapsed portable barrier through a path of about 270 degrees prior to undertaking the remaining deploying steps in which the cover is positioned over the floor and the backscreen horizontally oriented. The requirement that the user must reposition the lower part of the collapsed portable barrier relative to the upper part of collapsed portable barrier through a path of about 270 degrees may be somewhat confusing to a user thereby reducing the ease of setting up devices possessing this type of design.

In comparison, it would be desirable to reduce the amount of repositioning required at this stage in the set-up process to make the set-up process more user-intuitive. In particular, it would be desirable if, after the collapsed portable barrier is removed from the carry bag, a user would be required to reposition an upper part of the collapsed portable barrier relative to a lower part of the collapsed portable barrier through a path of only about 90 degrees prior to undertaking the remaining deploying steps in which the cover is positioned over the floor and the backscreen horizontally oriented. A portable barrier possessing this characteristic would be much easier to set up since its set-up process would be much more user-intuitive. Indeed, a portable barrier that incorporates this feature would have a reduced amount of repositioning by 180 degrees of the various pole structures in comparison to that described at column 8, lines 31-41 (and shown in FIGS. 13 and 17-18) of the '365 Patent. (See, e.g., the required 270 degrees of movement of the collapsed portable barrier 10 during its set-up process from its position shown in FIG. 13 to its position shown in FIGS. 17-18 of the '365 Patent).

What is needed therefore is a portable barrier that is relatively quick and simple to deploy for use and collapse for subsequent transportation and storage thereof. What is also needed is a portable barrier that is relatively easy to manufacture. Further, what is needed is a portable barrier that is relatively stable without needing constant attention of a user when deployed. What is additionally needed is a portable barrier that has a set-up process that is user-intuitive. Further, what is needed is a portable barrier that requires, after the collapsed portable barrier is removed from the carry bag, a user to reposition an upper part of the collapsed portable barrier relative to a lower part of the collapsed portable barrier through a path of only about 90 degrees prior to undertaking remaining deploying steps in which the cover is positioned over the floor and the backscreen horizontally oriented. A portable barrier possessing this feature would require 180 degrees less repositioning of the various pole structures in comparison to that described at column 8, lines 31-41 (and shown in FIGS. 13 and 17-18) of the '365 Patent. (See, e.g., the required 270 degrees of movement of the portable barrier 10 during its set-up process from its position shown in FIG. 13 to its position shown in FIGS. 17-18 of the '365 Patent).

BRIEF DESCRIPTION OF THE DRAWINGS

FIGS. 74-79 show the portable barrier with the flooring, the covering, the back screen panels, and the tensioner removed for clarity of understanding to show the framework of the portable barrier; and the framework including the legs, the arms, the actuator component, the junction assembly, and the hinge components;

DESCRIPTION OF THE PREFERRED EMBODIMENTS

Figure 1:
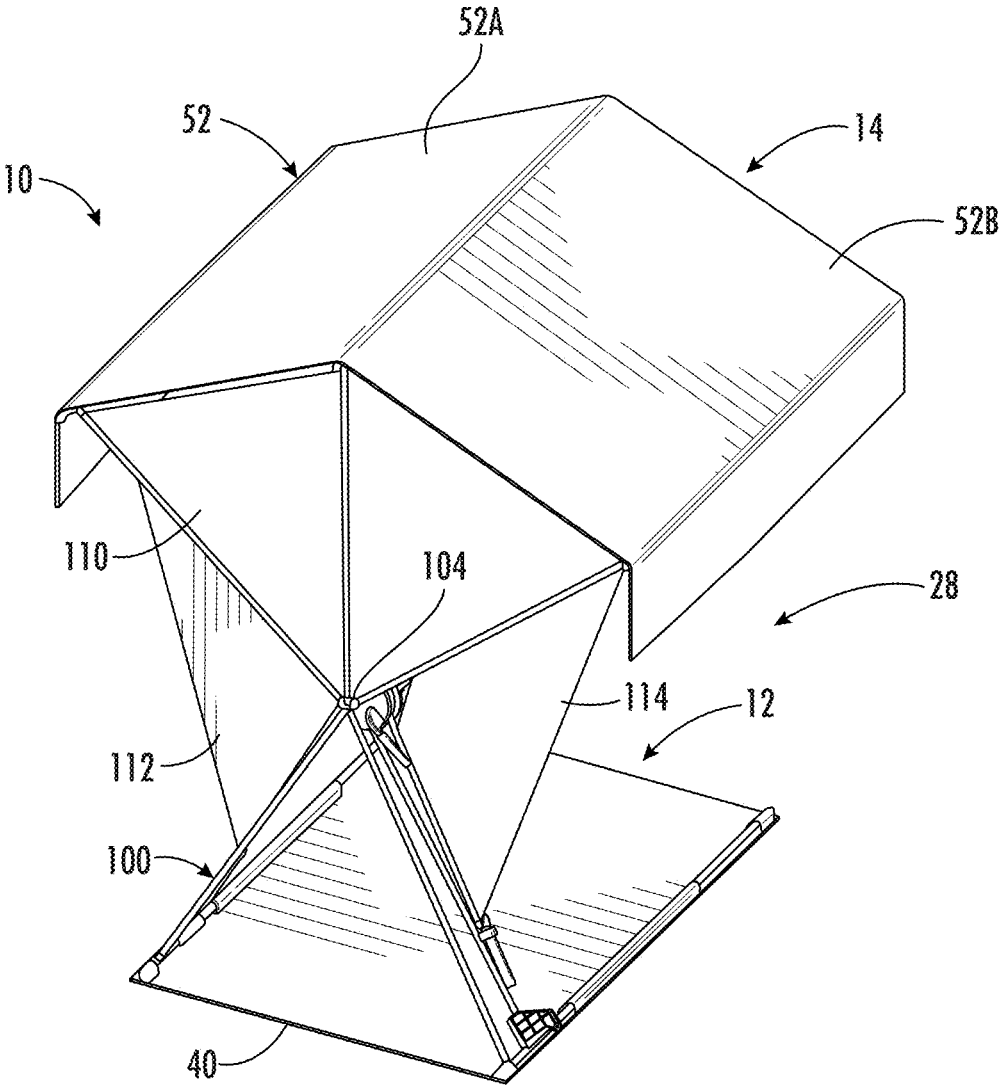
FIGS. 1-8 show various views of a portable barrier of the present disclosure, with the portable barrier shown in its protection mode of operation (or expanded configuration)

While the portable barrier and its method of use described herein is susceptible to various modifications and alternative forms, specific embodiments thereof have been shown by way of example in the drawings and will herein be described in detail. It should be understood, however, that there is no intent to limit the portable barrier and its method of use to the particular forms disclosed, but on the contrary, the intention is to cover all modifications, equivalents, and alternatives falling within the spirit of the inventions described herein.

Referring now to FIGS. 1-8, there is shown a portable barrier 10 that incorporates the features of the present disclosure. The portable barrier 10 includes a pedestal assembly 12 and a cover assembly 14. The portable barrier 10 further includes a junction assembly 16 (see FIGS. 4-6) interposed between the pedestal assembly 12 and the cover assembly 14.

Figure 5:
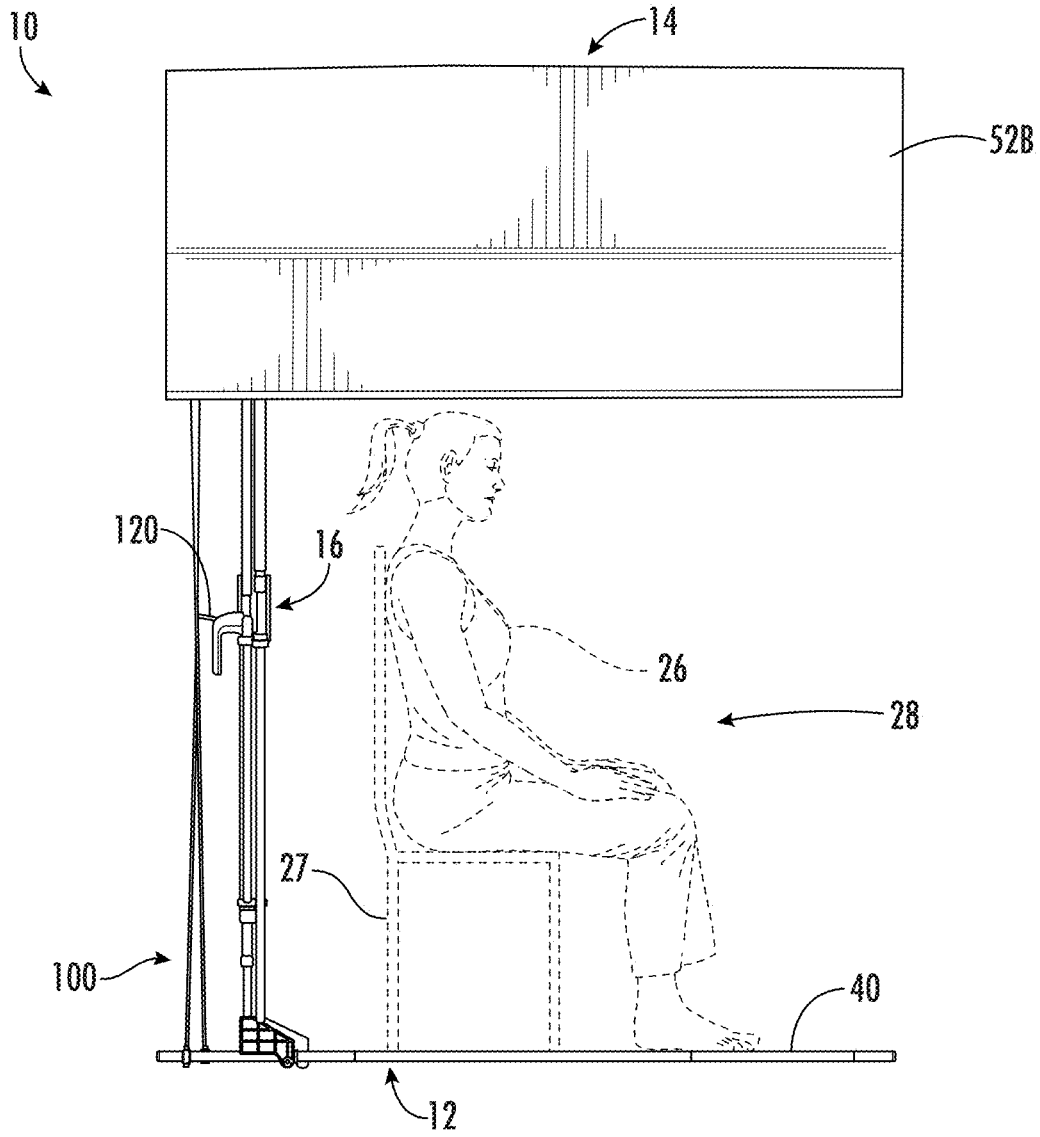
Figure 6:
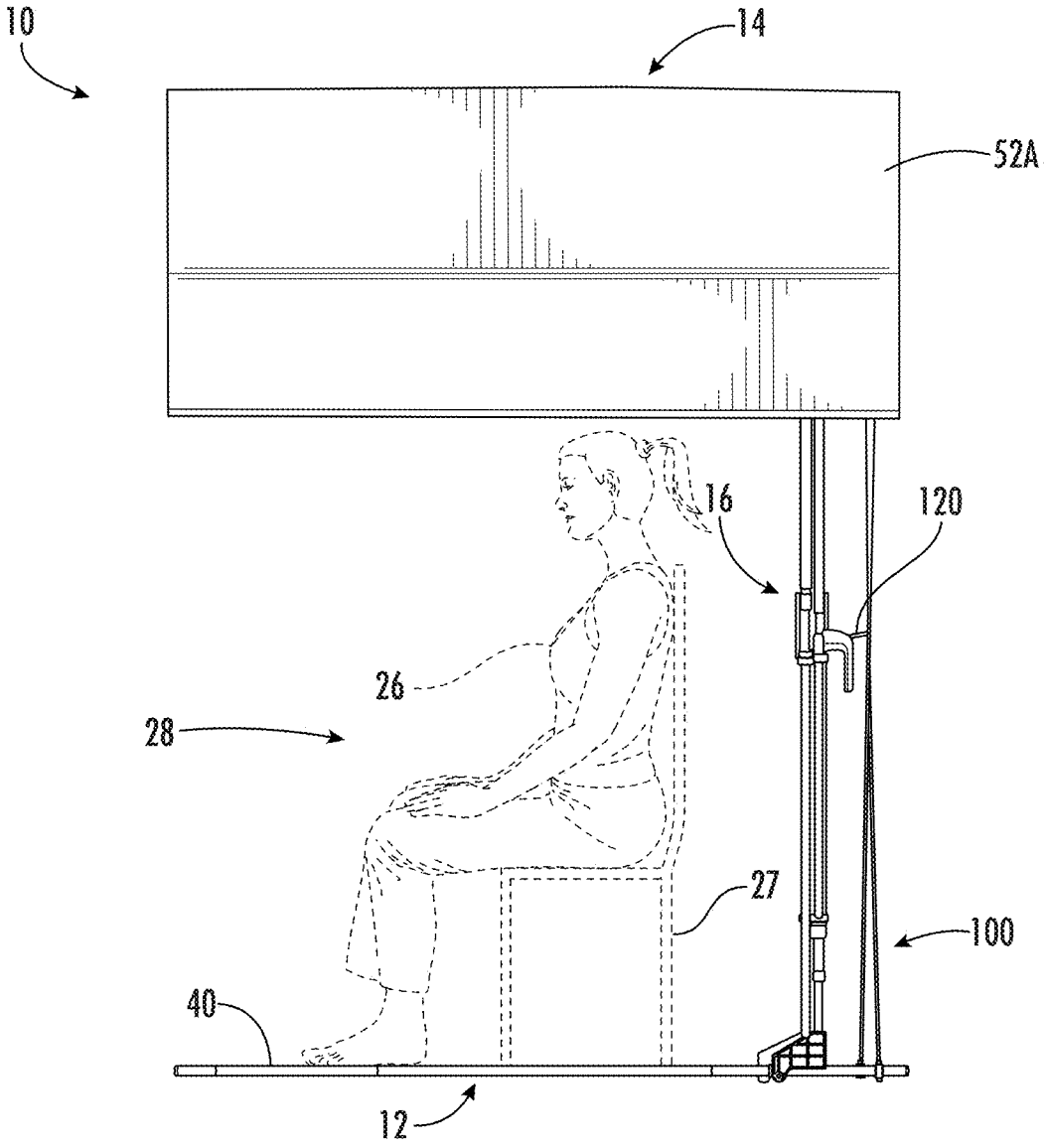
Figure 7:
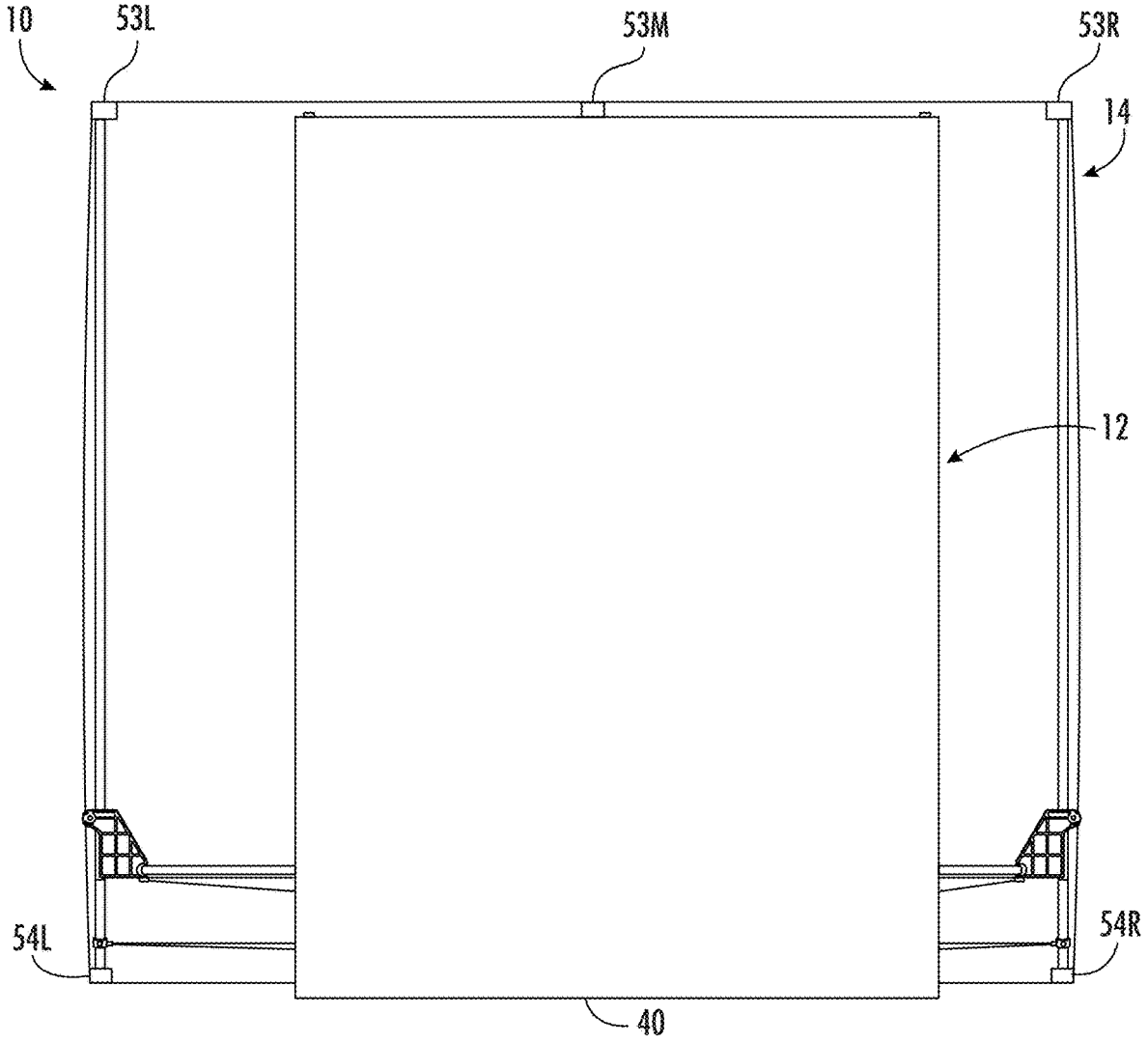
Figure 8:
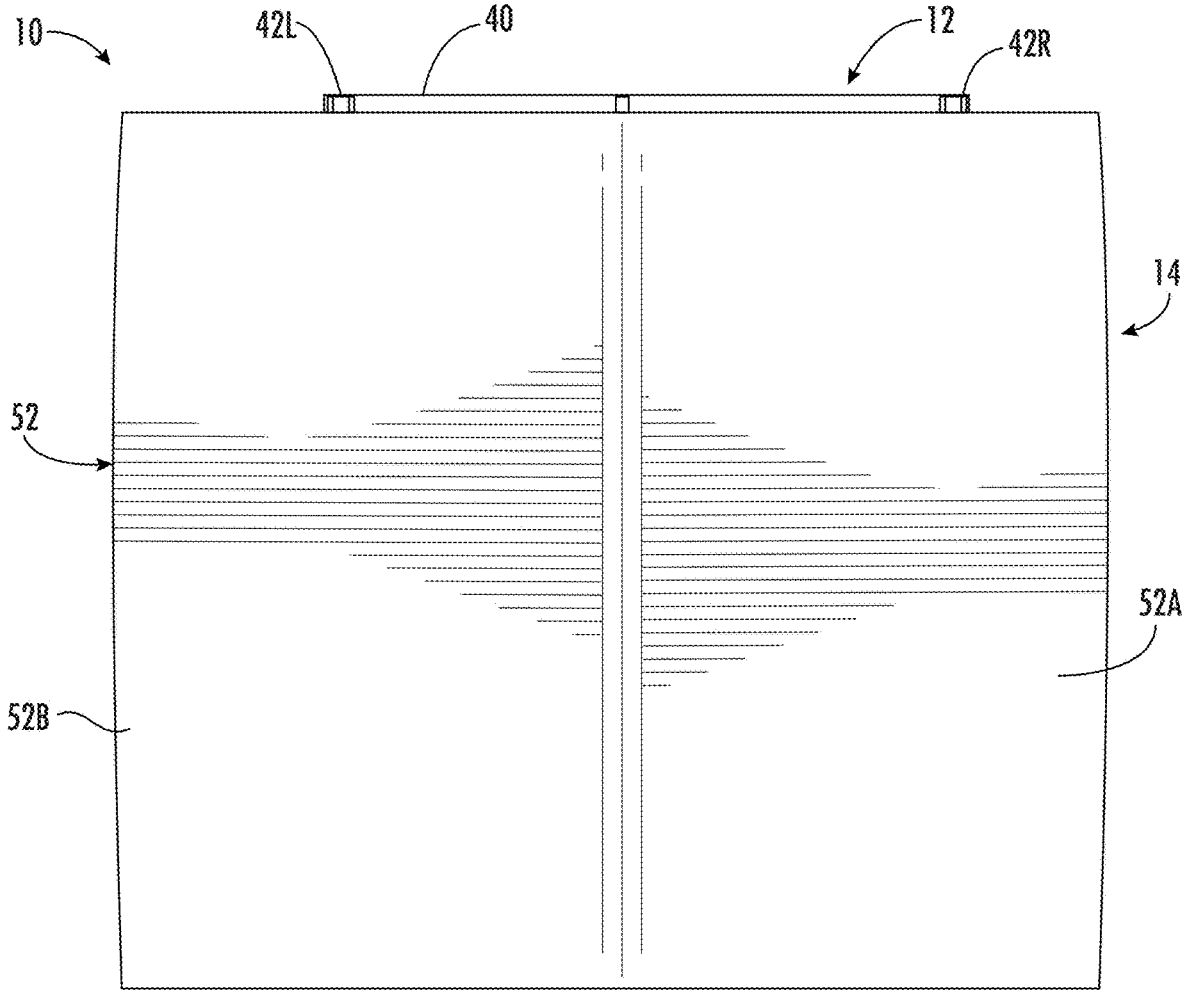
Figure 10:
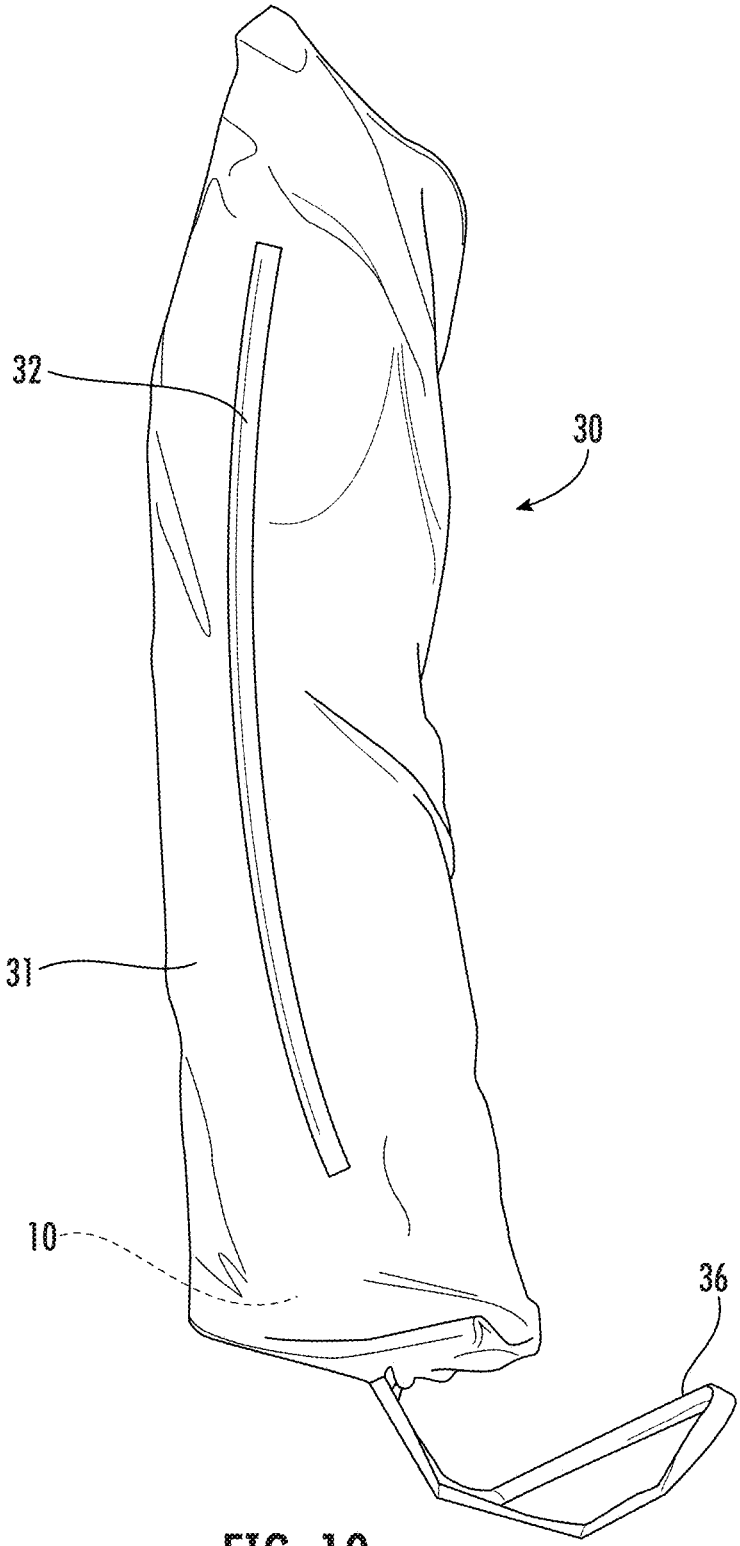
FIG. 10 is a perspective view of the carrier bag of FIG. 9 shown lying on a horizontal surface, with the portable barrier of FIGS. 1-8 positioned therein in its storage mode of operation (or collapsed configuration)
Figure 11:
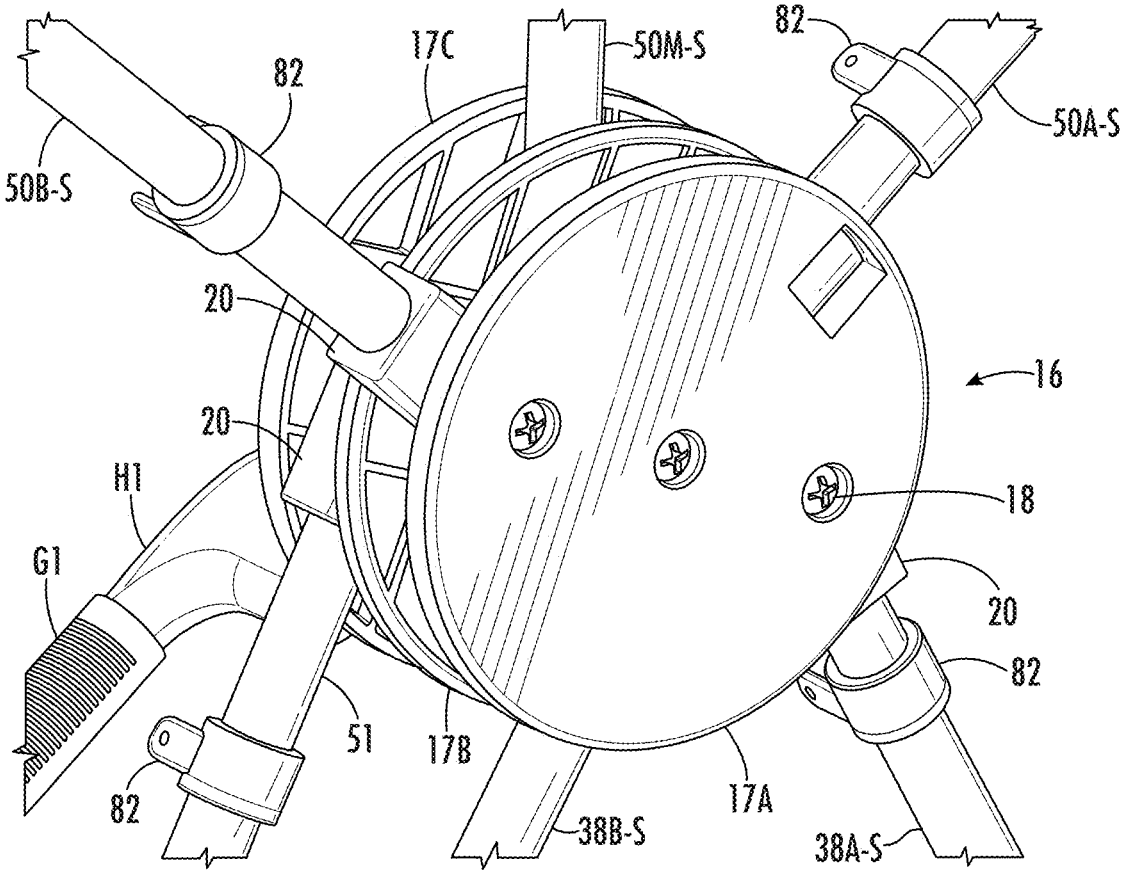
FIG. 11 shows an enlarged perspective view of the junction assembly of the portable barrier of FIGS. 1-8.
Figure 12:
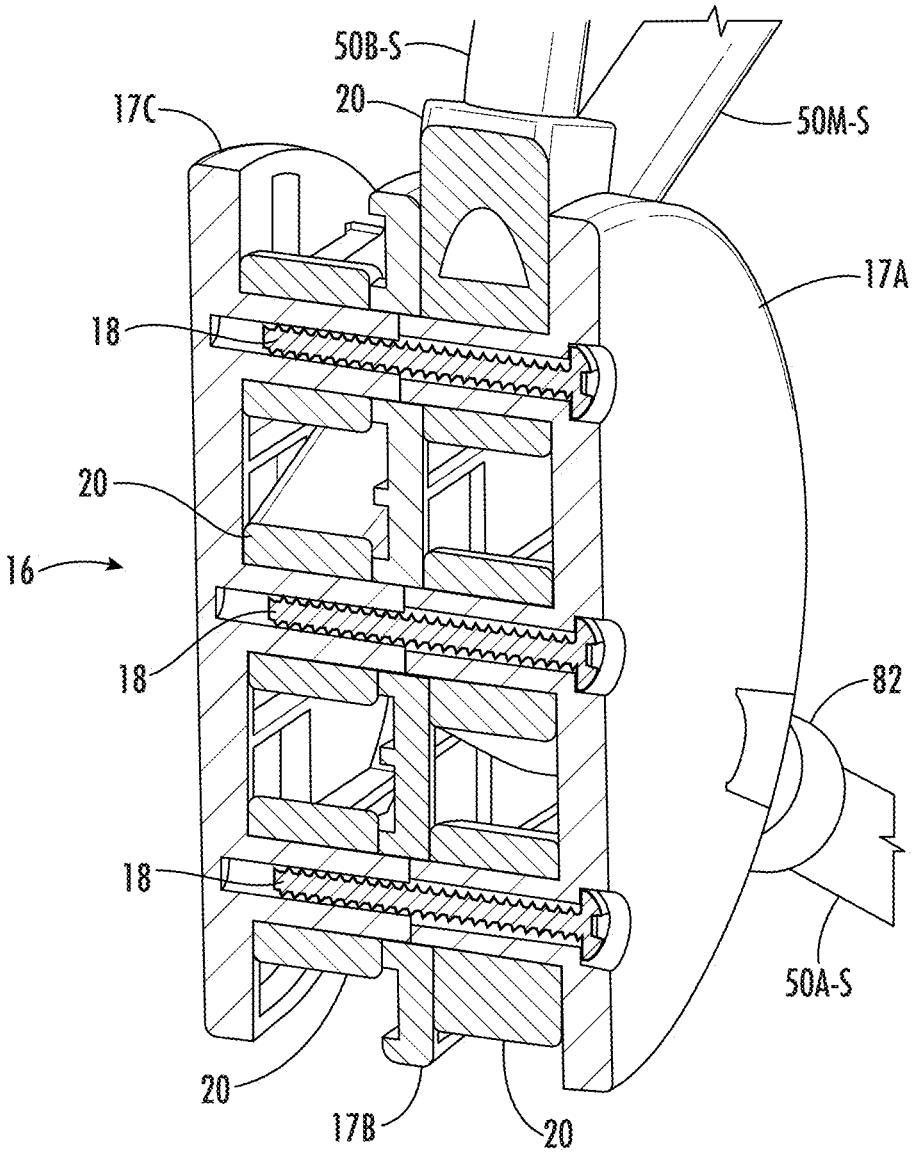
FIG. 12 shows a cross-sectional view of the junction assembly of FIG. 11.
Figure 13:
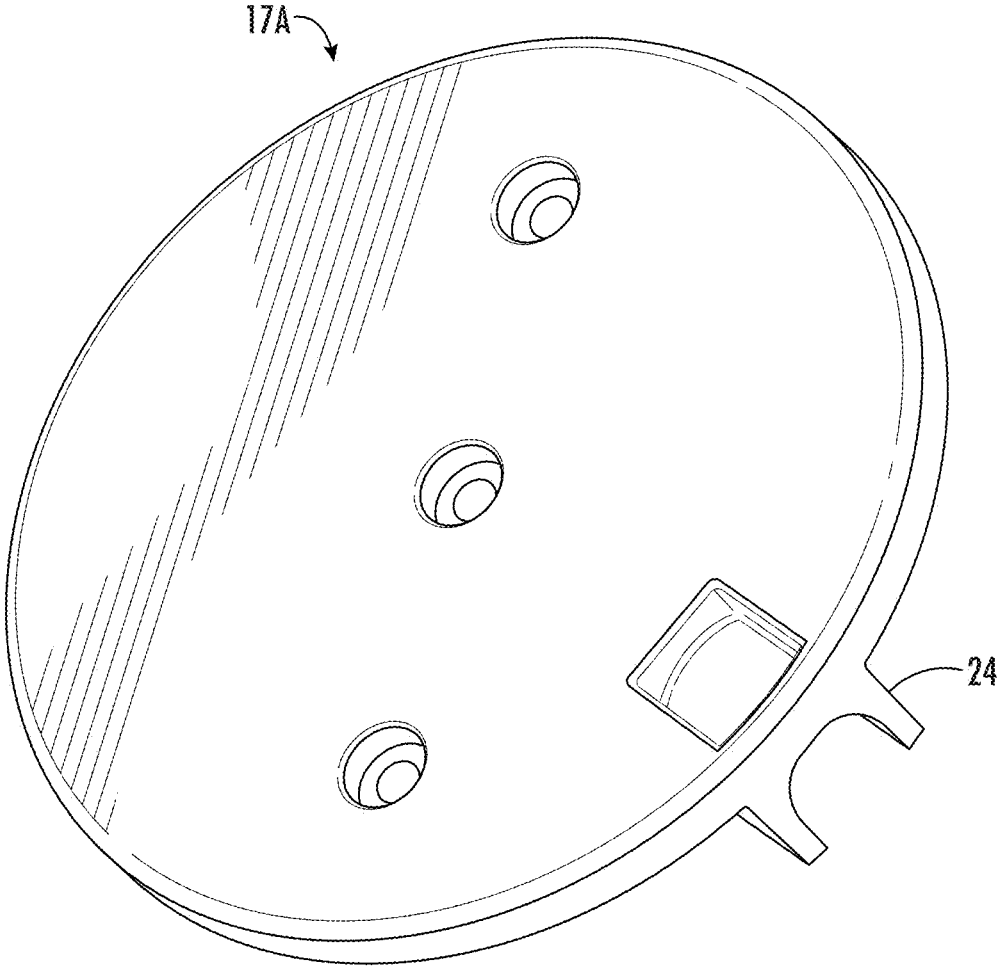
FIGS. 13-17 show various views of the front disc of the junction assembly of FIG. 11 FIGS. 18-21 show various views of the middle disc of the junction assembly of FIG. 11.
Figure 14:
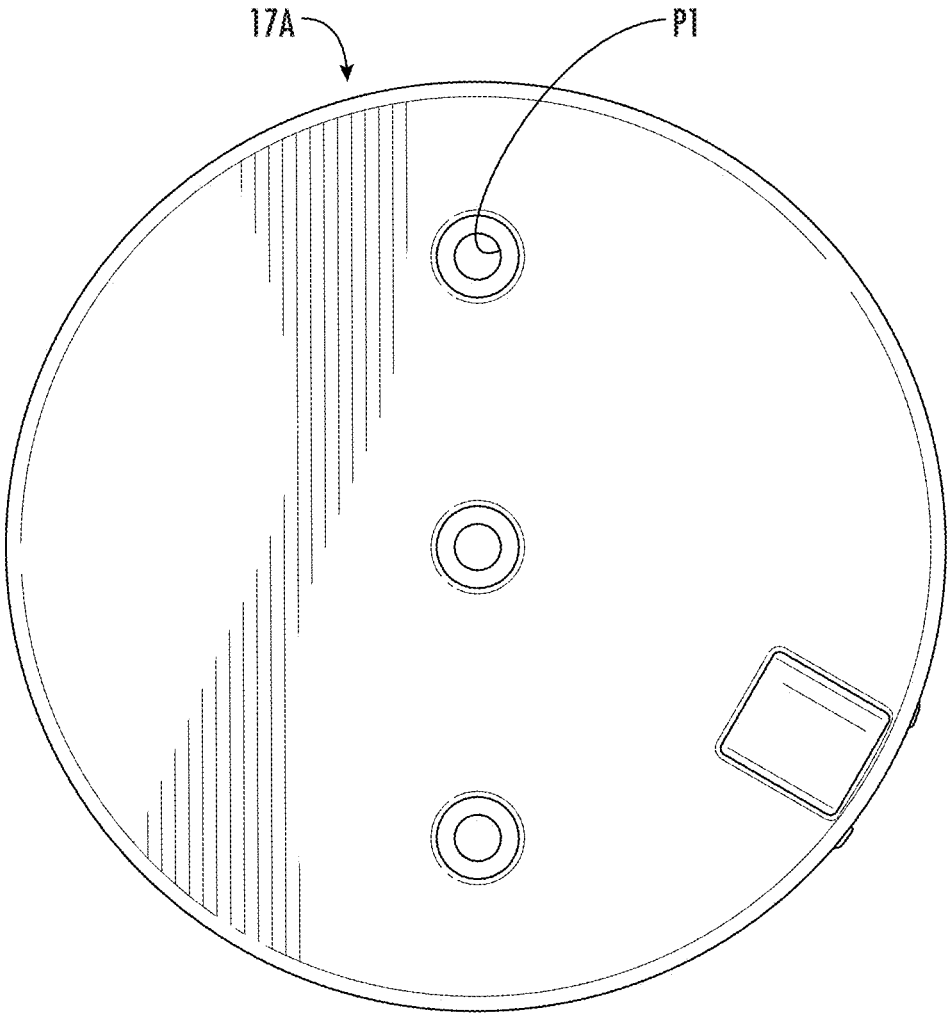
Figure 15:
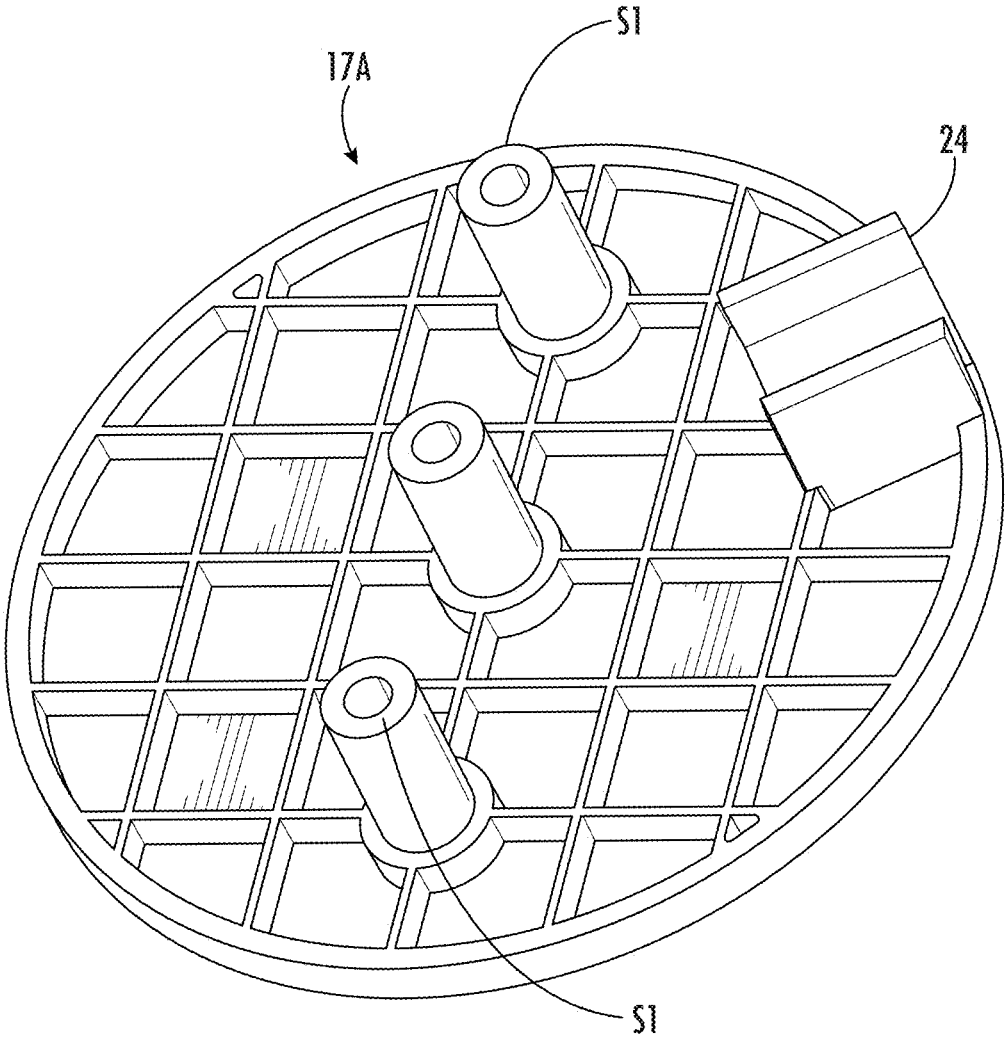
Figure 16:
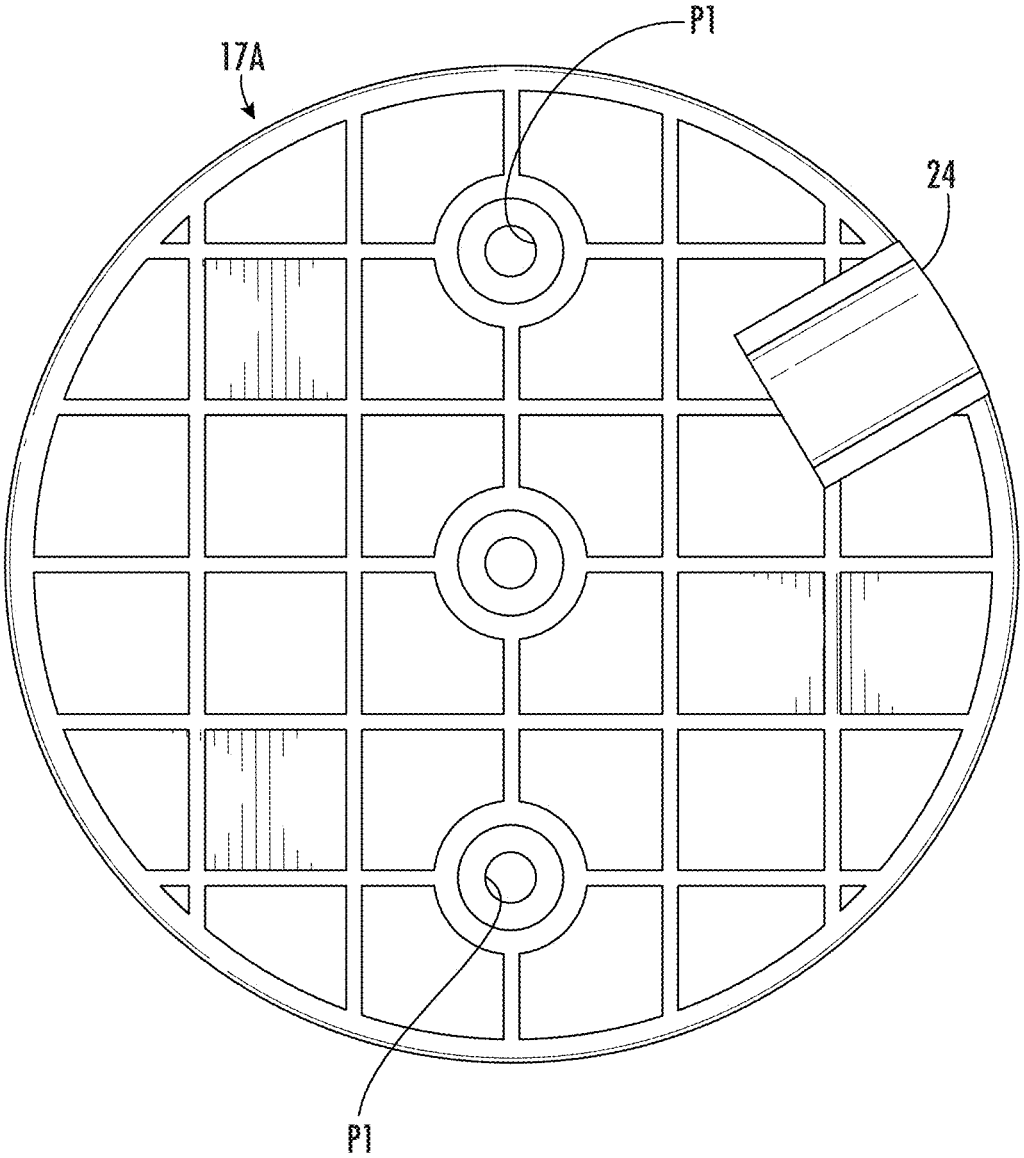
Figure 17:
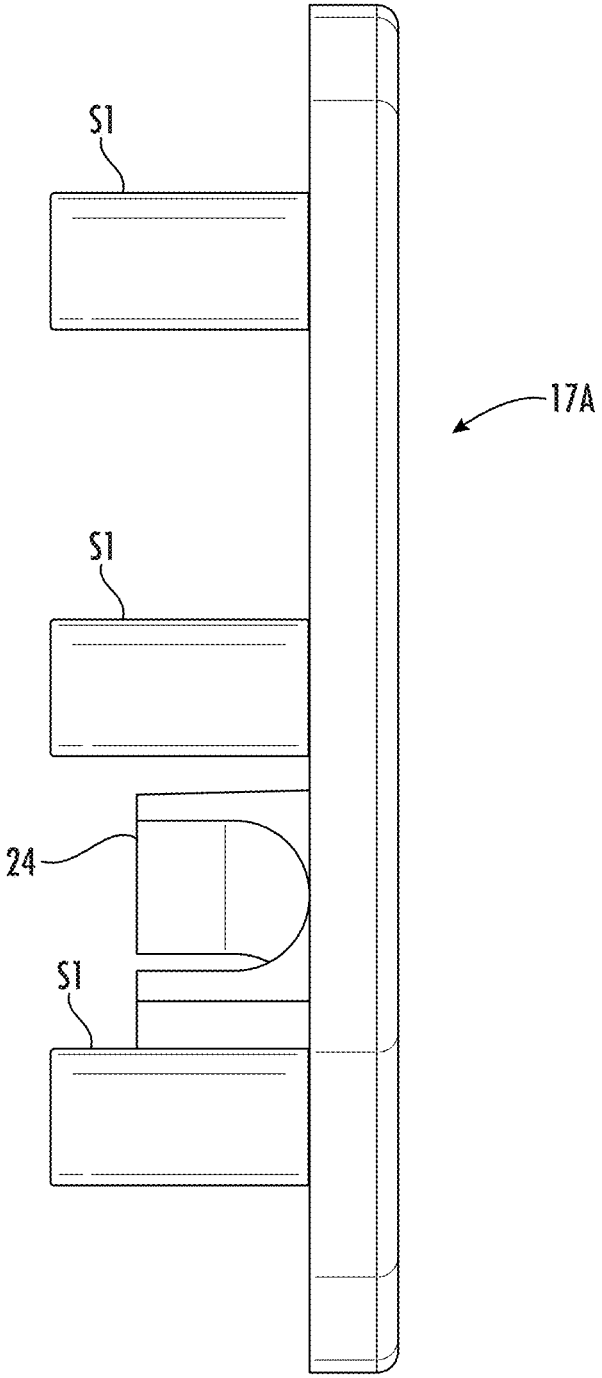
Figure 18:
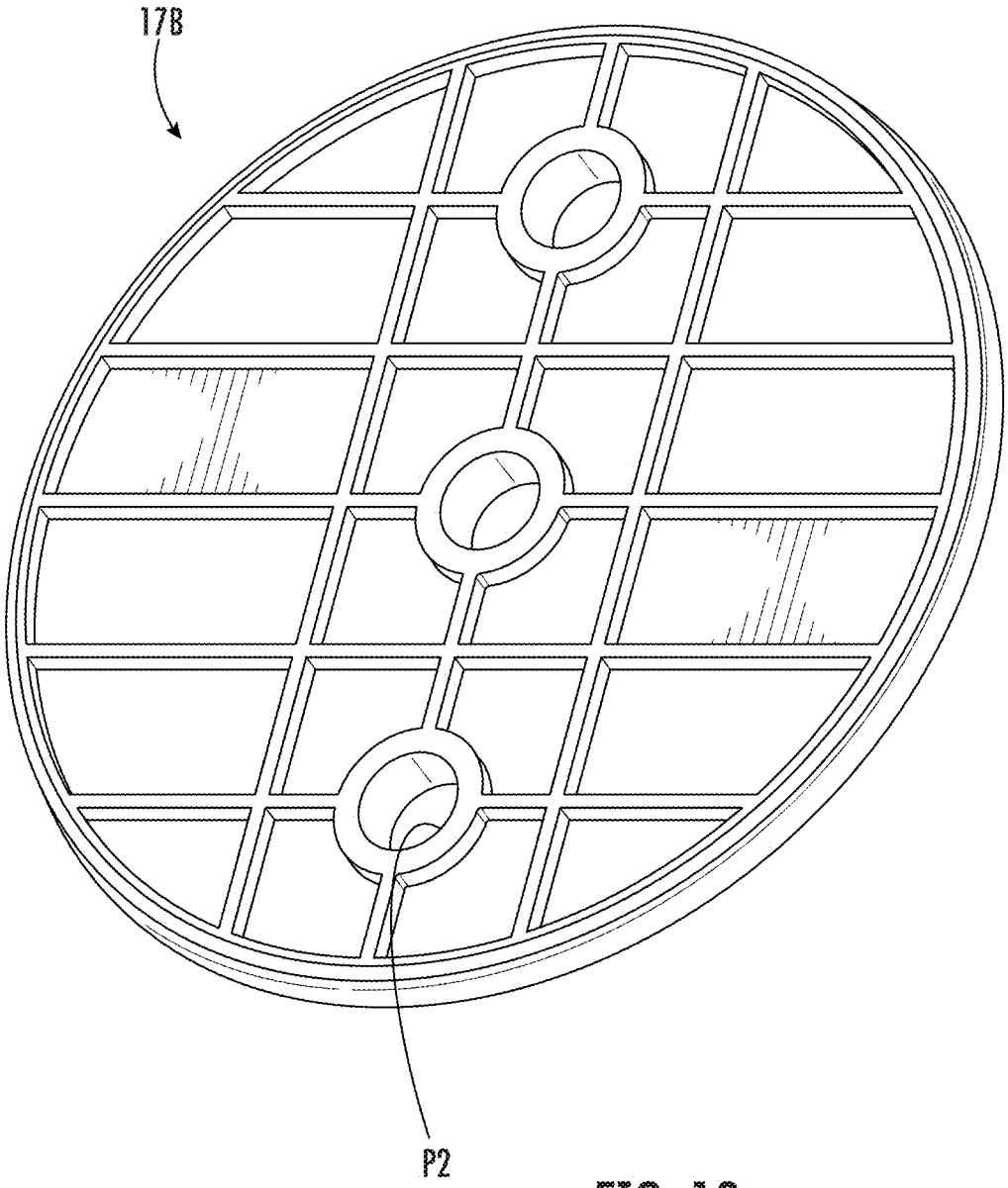
Figure 19:
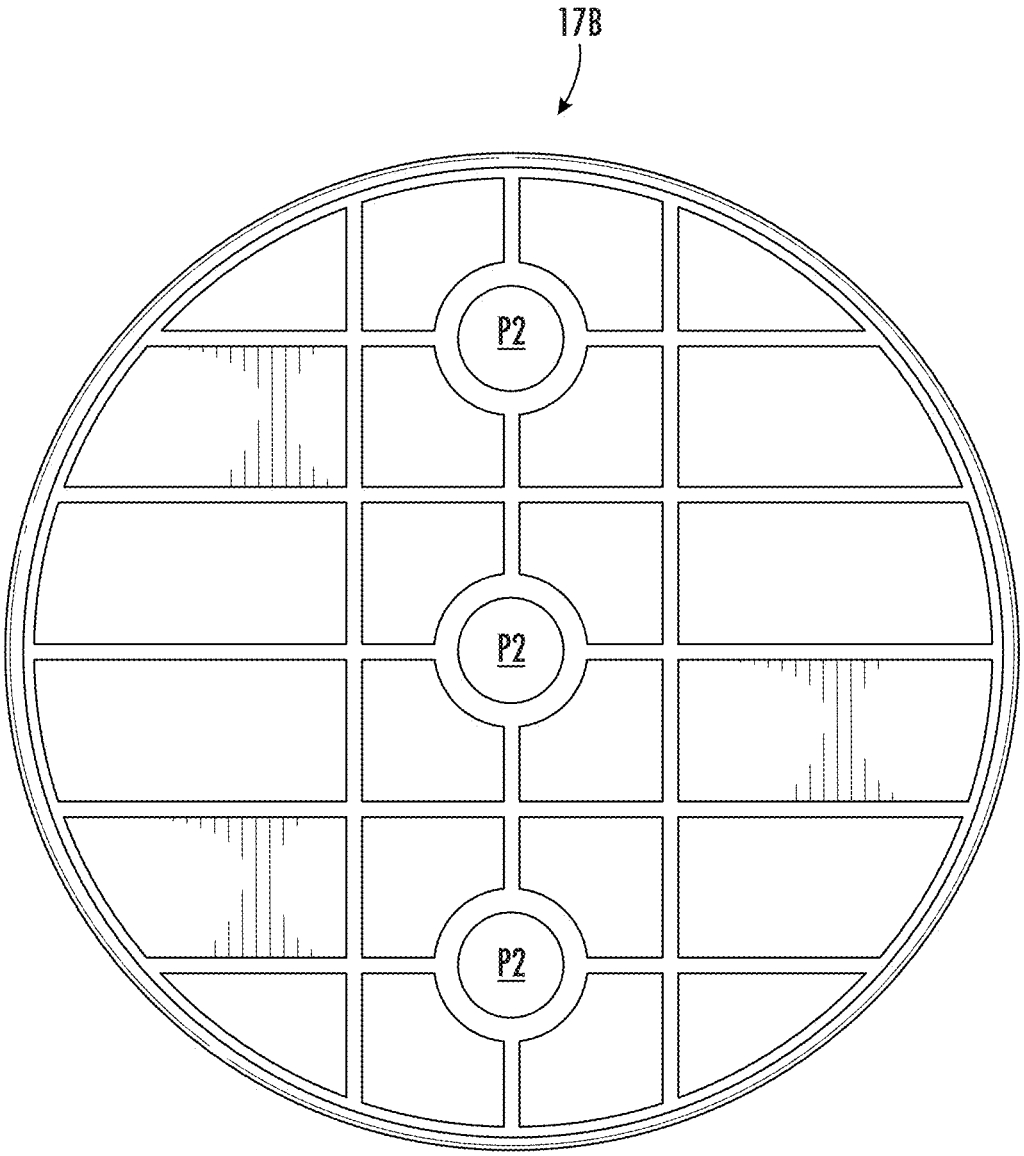
Figure 20:
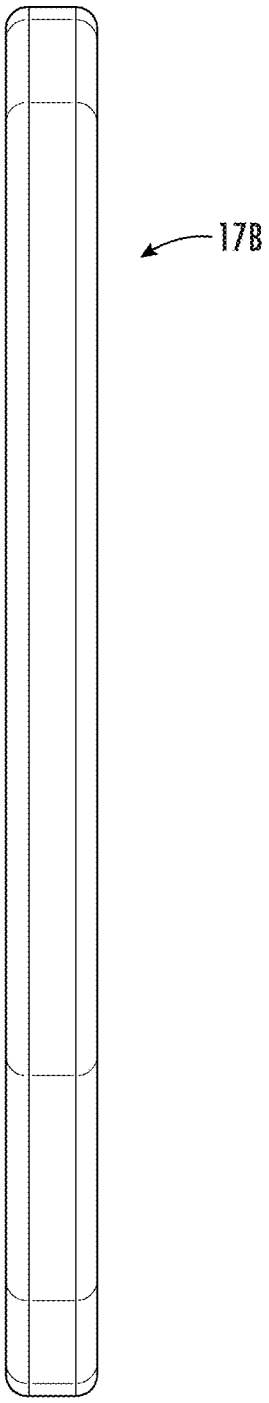
Figure 21:
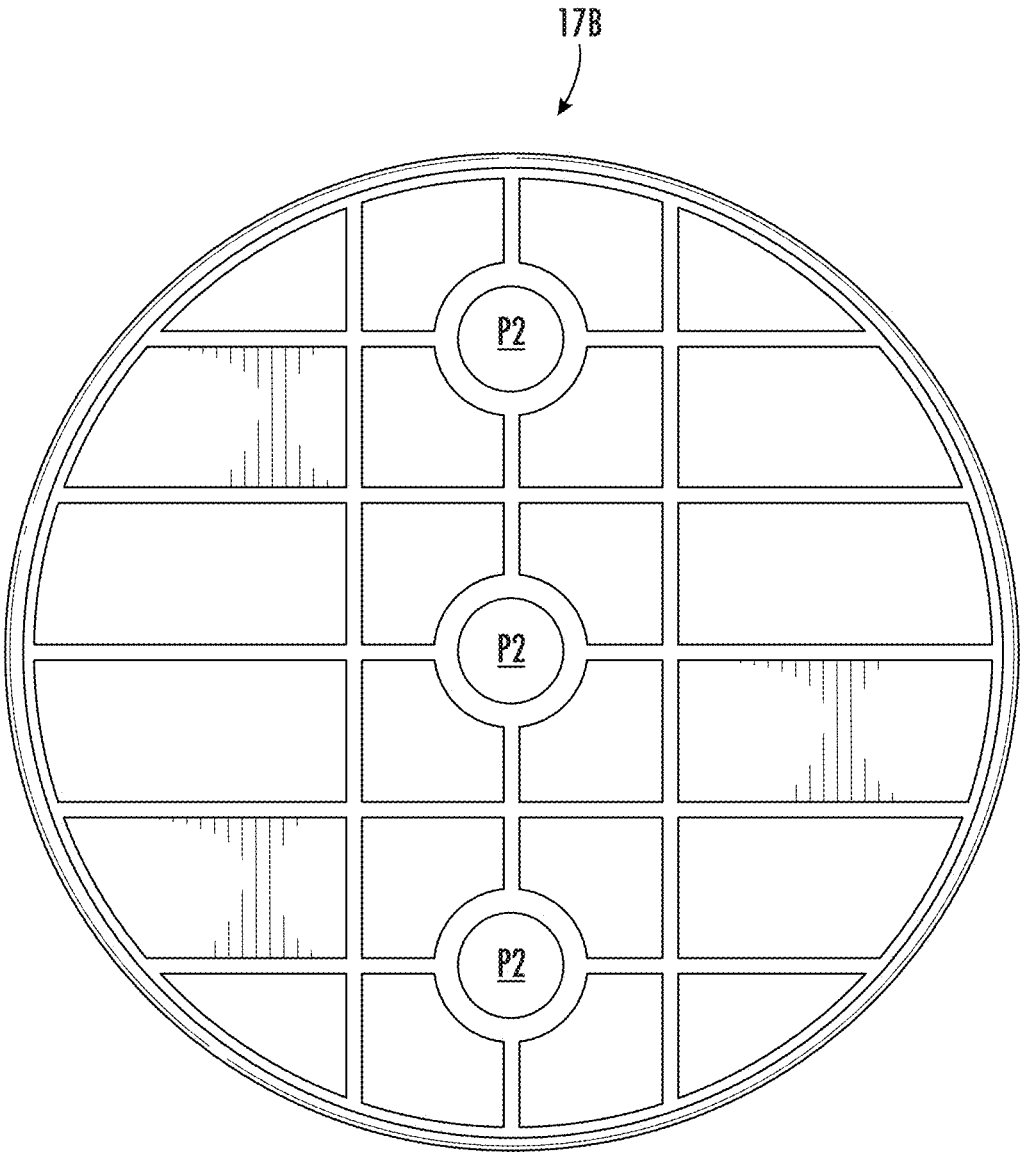
Figure 22:
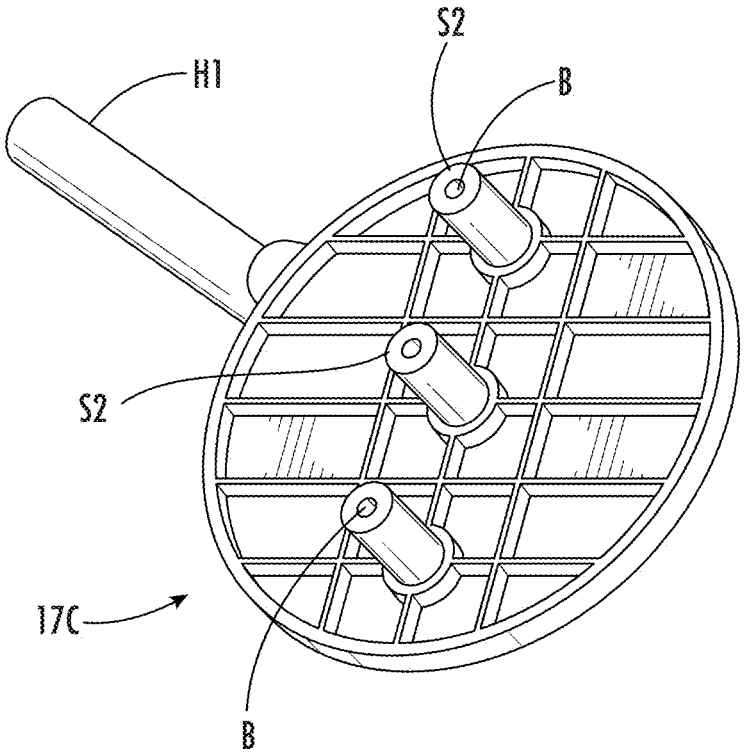
FIGS. 22-25 show various views of the back disc of the junction assembly of FIG. 11.
Figure 73:
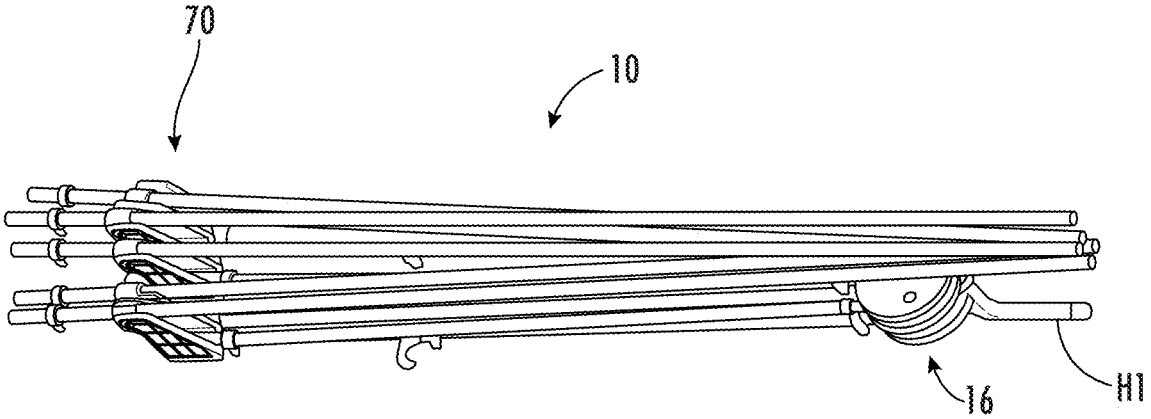
FIG. 73 is a perspective view of the portable barrier of FIGS. 1-8 in its storage mode of operation, with the flooring, the covering, the back screen panels, and the tensioner removed for clarity of understanding to show the framework of the portable barrier that includes the legs, the arms, the actuator component, the junction assembly, and the hinge components.
Figure 73A:
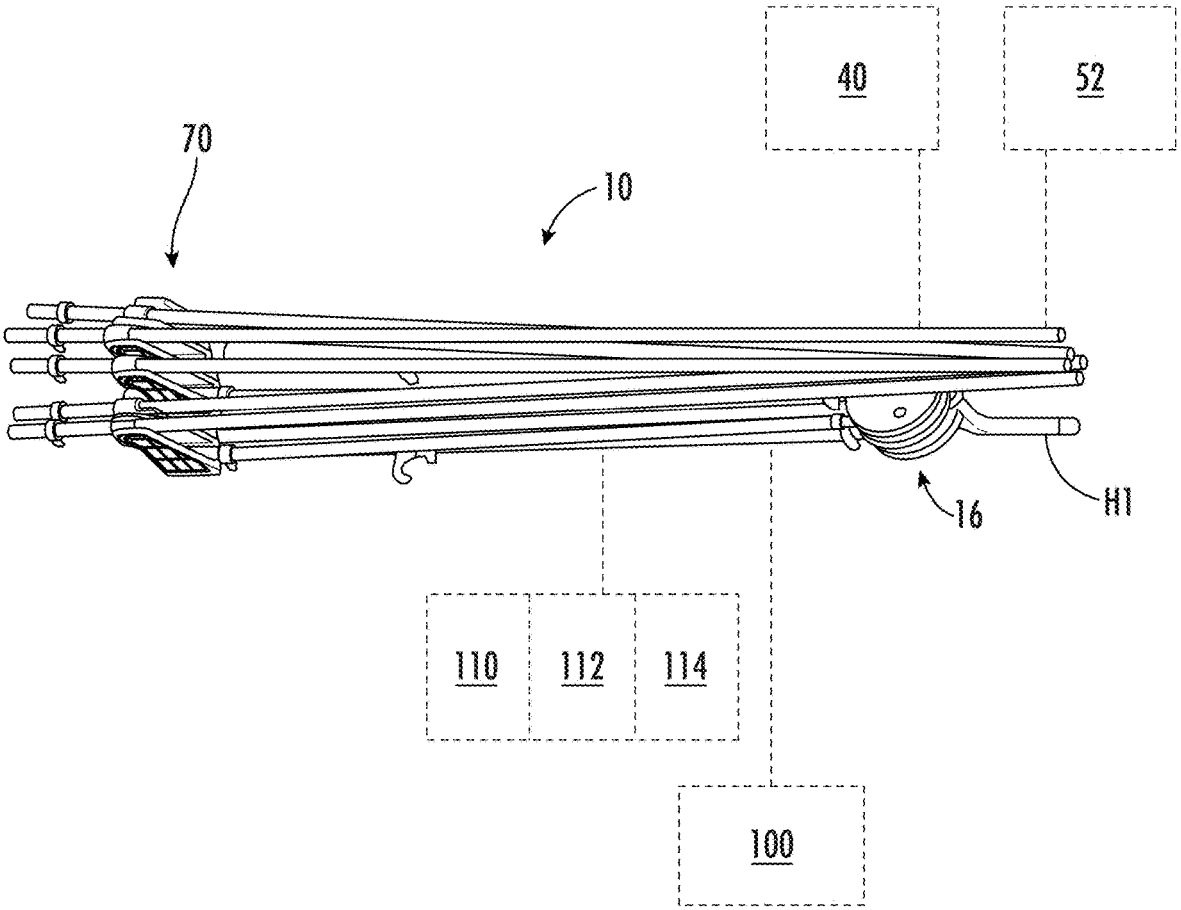
FIG. 73A is a view similar to FIG. 73 that shows the portable barrier of FIGS. 1-8 in its storage position, but showing the flooring, the covering, the back screen panels, and the tensioner connected to the framework in a schematic fashion.

The portable barrier 10 is configured to be moved between a protection mode of operation (or expanded configuration) as shown in FIGS. 1-8 and a storage mode of operation (or collapsed configuration) as shown in FIGS. 10, 73, 73A. When in the protection mode, the portable barrier 10 is configured to assume an expanded configuration which provides protection of an occupant 26 located in a cavity or occupant space 28 defined by the portable barrier as schematically shown in FIGS. 5-6. For example, the portable barrier 10 protects the occupant 26 from exposure to sun, wind, and/or rain while positioned in the occupant space 28 such as while the occupant is sitting on a chair 27 that is located in the occupant space and the chair is supported on a flooring of the portable barrier. (See FIGS. 5-6). One suitable chair that is used to support an occupant (e.g. a soccer spectator) is shown in FIGS. 11-12 of U.S. Pat. No. 11,326,365 (see chair 27 and occupant 26), the disclosure of this patent is totally incorporated by reference herein in its entirety. Since the portable barrier 10 does not possess any side screens, the occupant 26 is allowed uninhibited lateral viewing out of the portable barrier. When in the storage mode, the portable barrier 10 is configured in a collapsed configuration which facilitates convenient transportation and storage of the portable barrier as shown in FIGS. 10, 73, 73A.

For clarity of understanding, the portable barrier 10 is shown in FIGS. 34-40 with all its fabric components and its tensioner removed, while FIGS. 41-48 shows the portable barrier 10 with its fabric floor and fabric cover removed.

Figure 9:
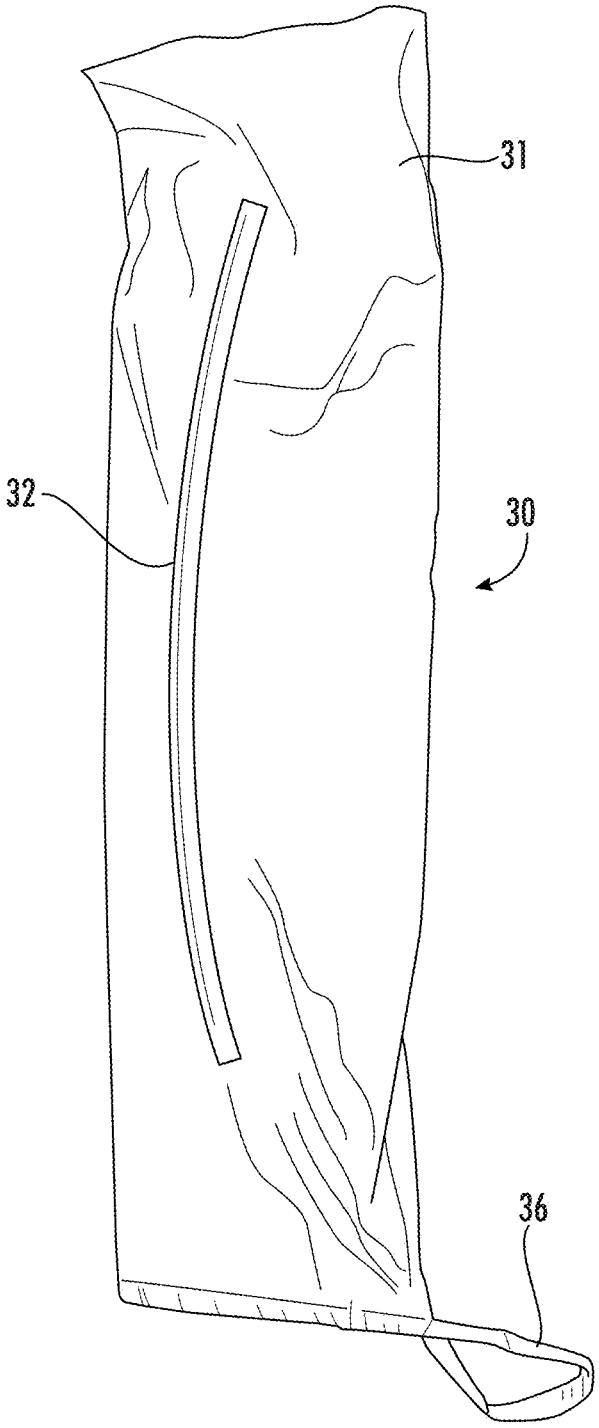
FIG. 9 is a perspective view of a carrier bag shown lying on a horizontal surface, with the portable barrier removed therefrom.

When in the storage mode, the portable barrier 10 is configured to be stowed in a flexible carrier bag 30 which is shown in FIGS. 9-10 so as to facilitate convenient transportation and subsequent long-term storage of the portable barrier. The carrier bag 30 includes a sleeve portion 31 having an open end and a closed end. The carrier bag 30 also includes a flexible handle 32 such as a strap (e.g. a segment of 1" wide polypropylene webbing) connected to a side of the sleeve portion 31. The sleeve portion 31 defines a cavity (not shown) in which the portable barrier 10 is located during transportation and storage of the portable barrier 10 as shown in FIG. 10. The carrier bag 30 further includes a draw string 36 which is slidably attached to the sleeve portion 31 and configured to be pulled so as to cinch the sleeve portion closed thereby trapping the portable barrier 10 within the carrier bag 30 (as shown in FIG. 10) for ready transportation and ultimate storage at a storage location such as an occupant's garage or basement.

Junction Assembly

Turning now to FIGS. 11-12, the junction assembly 16 includes a plurality of disc-like components, namely, front disc 17A, middle disc 17B, and back disc 17C. Each of the disc components includes a generally disc-shaped portion which is oriented in parallel fashion with respect to each other. The disc components 17A, 17B, 17C are made of a plastic material such as a high-density polyethylene material, such as a UHMW polyethylene material. The disc components 17A, 17B, 17C may alternatively be made from an aluminum material or steel. Each of the disc components 17A, 17B, 17C includes a portion that possesses a generally circular configuration as shown in FIGS. 11-12. The junction assembly 16 further includes a plurality of screws 18 that are used to secure the disc components 17A, 17B, and 17C in fixed relation to each other as shown in FIGS. 11-12. In particular, the disc components 17A and 17B each has three non-threaded passageways defined therein, while the disc component 17C has three blind bores defined therein. The blind bores are each threaded so as to meshingly engage the threaded end portions of the three screws 18 so as to secure the disc components 17A, 17B, and 17C in fixed relation to each other as shown in FIGS. 11-12.

The front disc 17A is shown in more detail in FIGS. 13-17. The front disc 17A includes a plurality of posts or stand-offs S1 each defining a non-threaded passageway P1 that extends therethrough. The front disc 17A further includes a strut support 24 as shown in FIGS. 13-17.

The middle disc 17B is shown in more detail in FIGS. 18-21. The middle disc 17B defines a plurality of non-threaded passageways P2 that extends therethrough.

Figure 23:
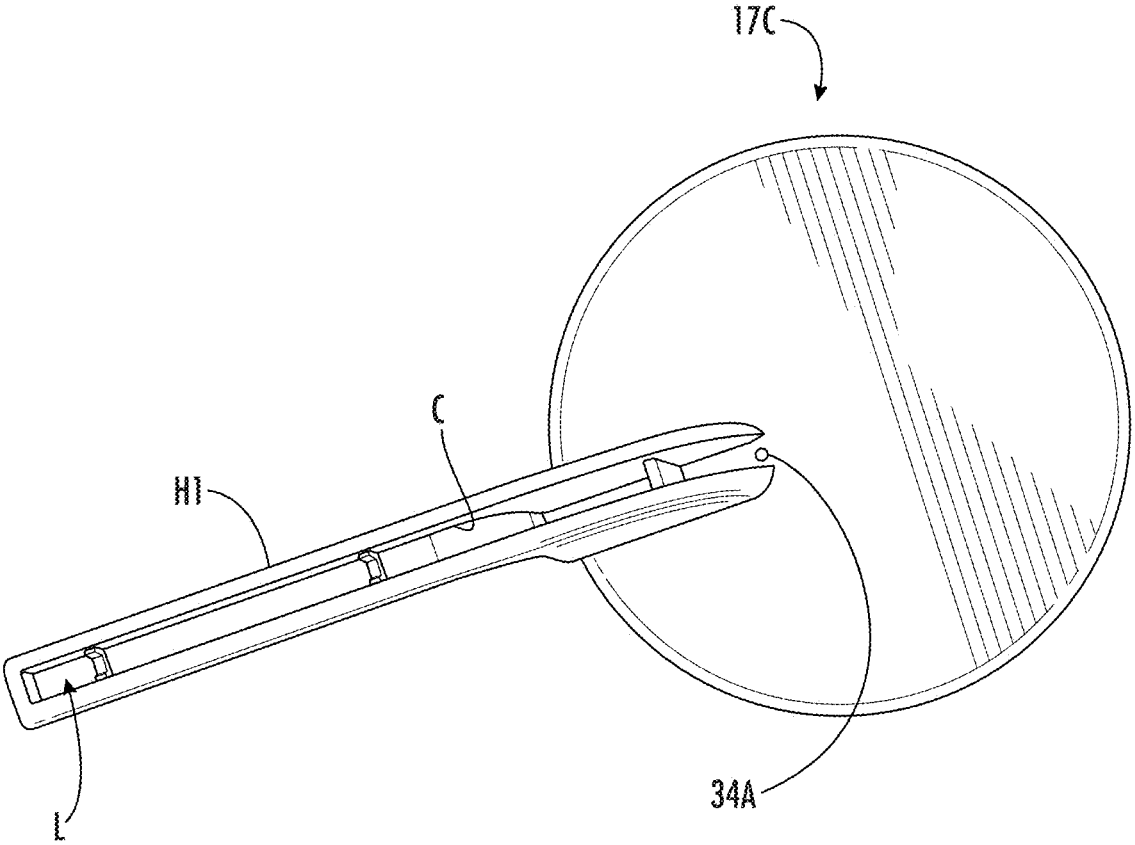
Figure 24:
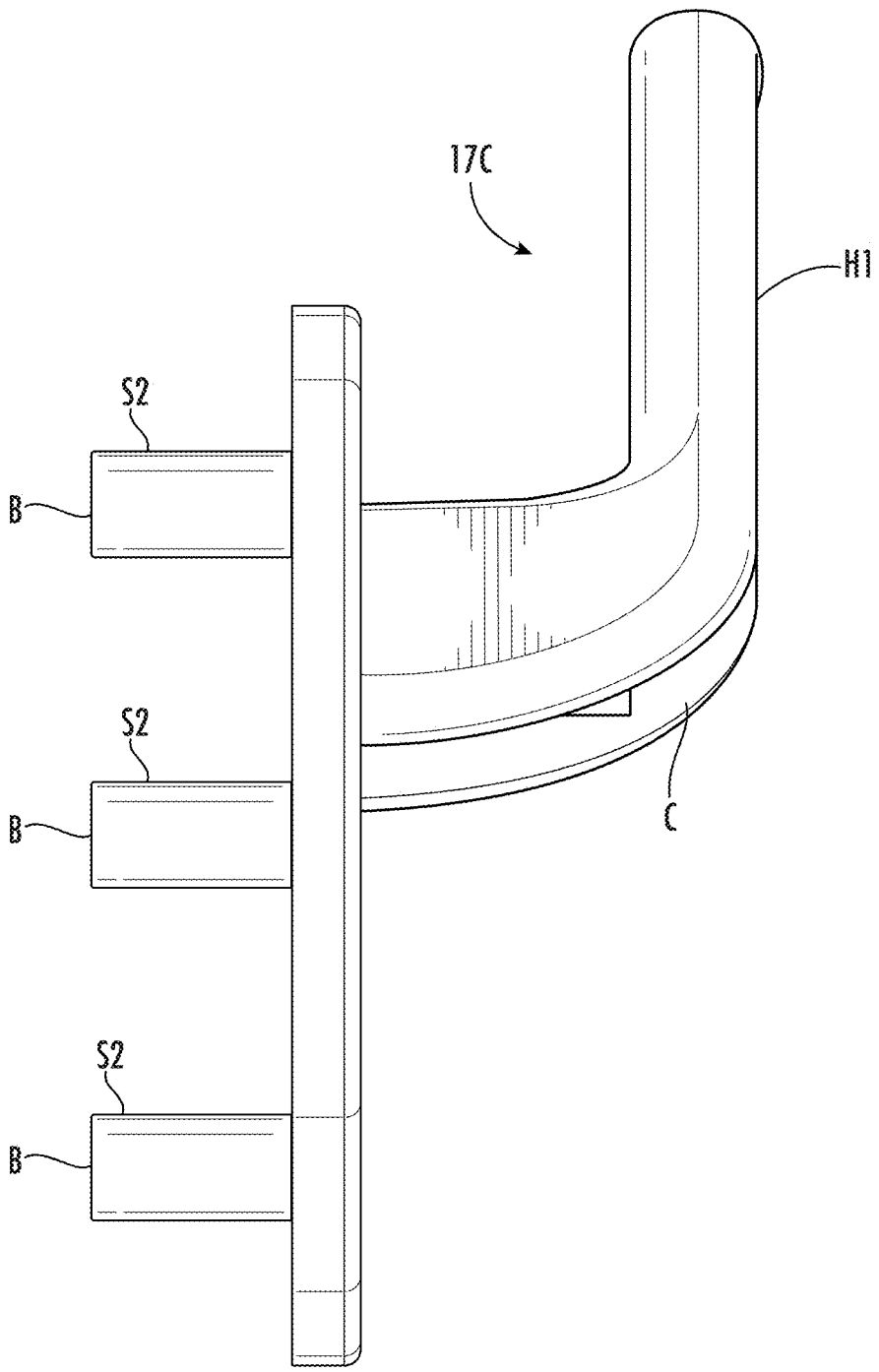
Figure 25:
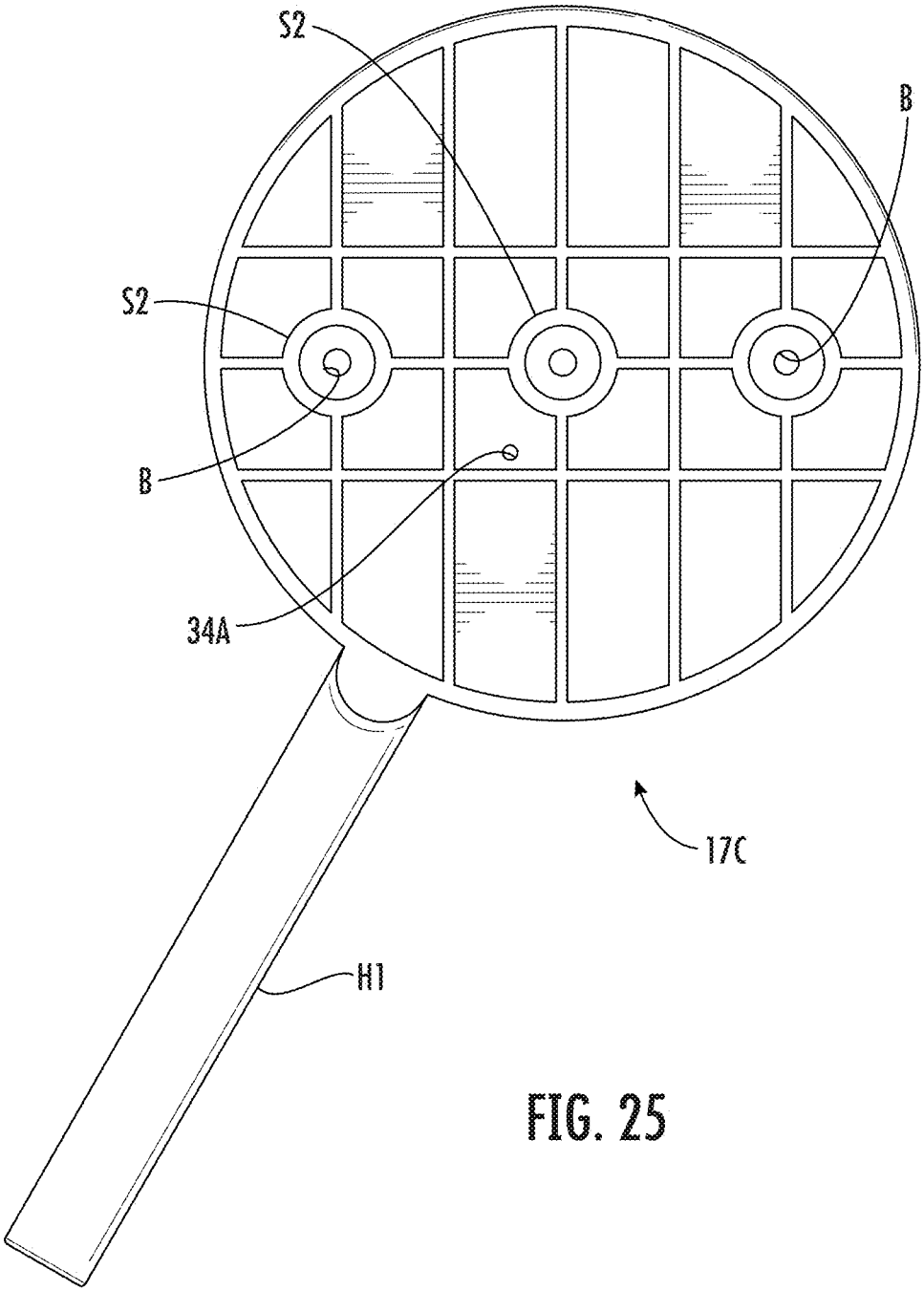
Figure 26:
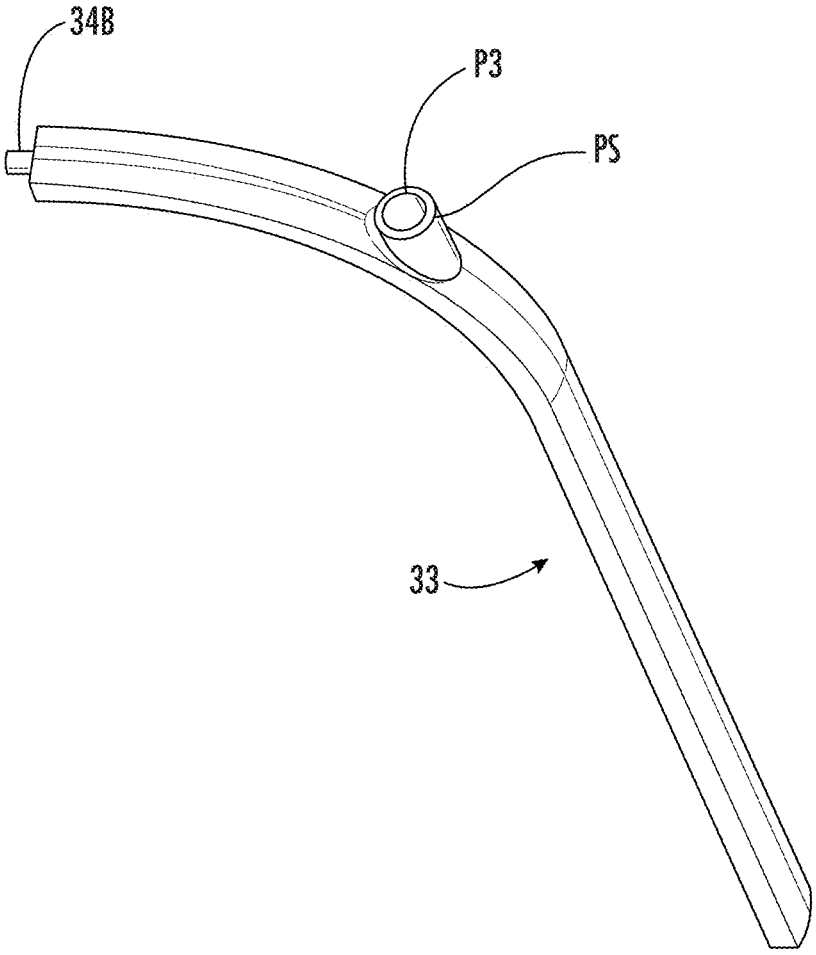
FIGS. 26-30 show various views of the covering member of the junction assembly of FIG. 11 that is configured to cover the cavity of the back disc of the junction assembly of FIG. 11.
Figure 27:
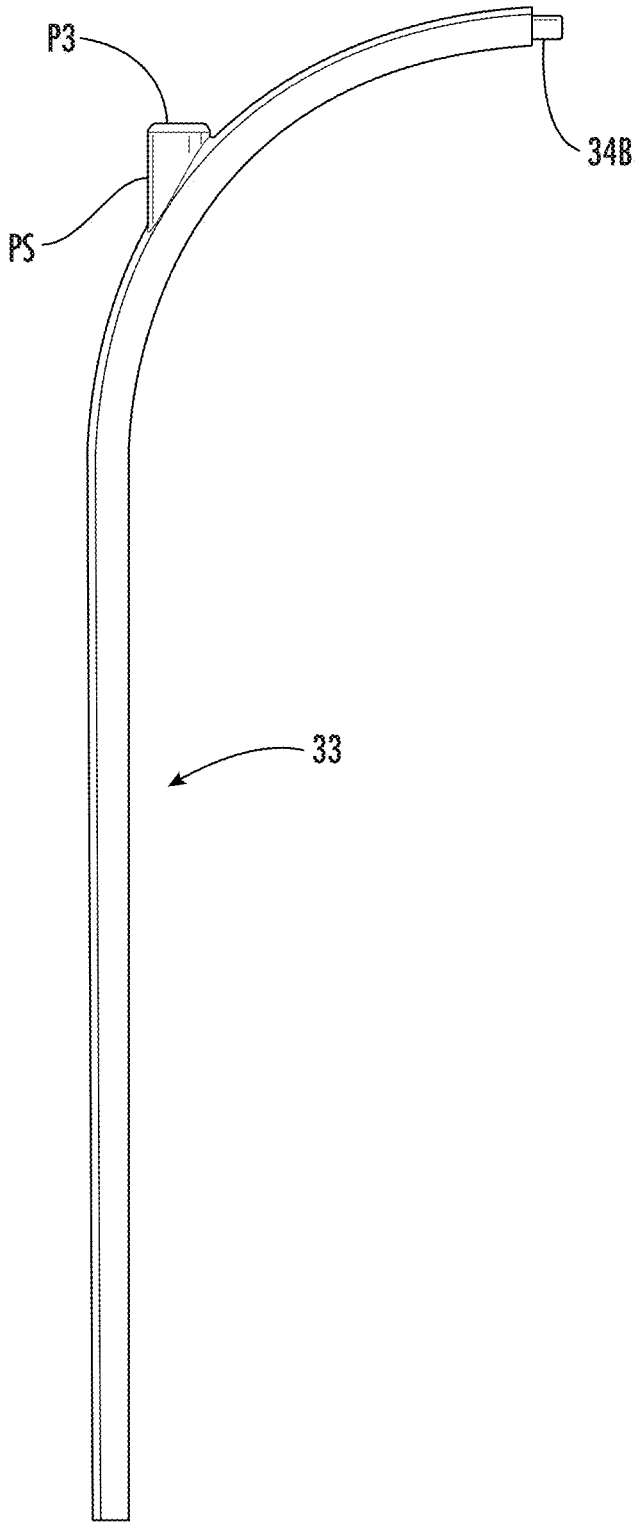
Figure 28:
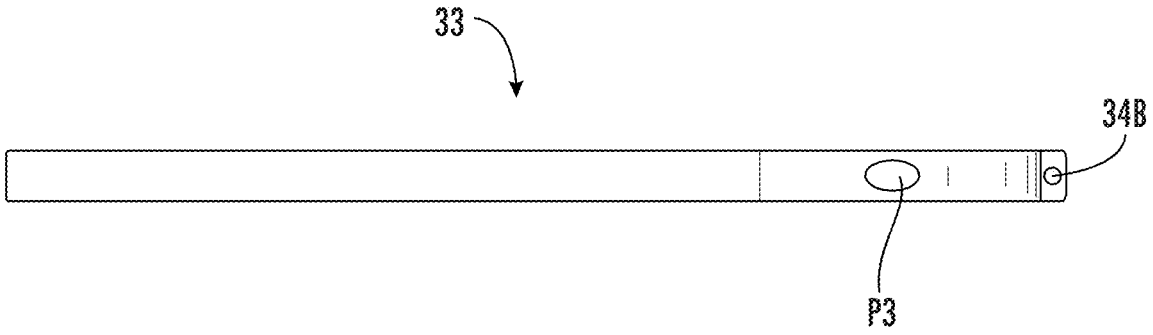
Figure 29:
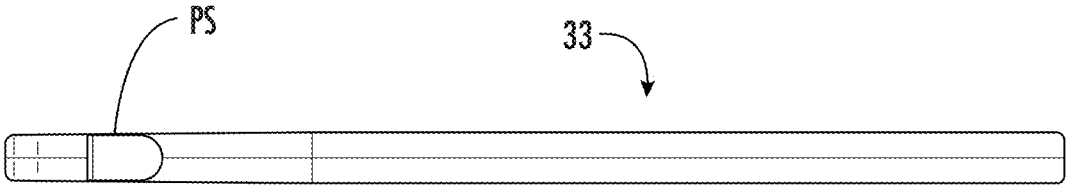
Figure 30:
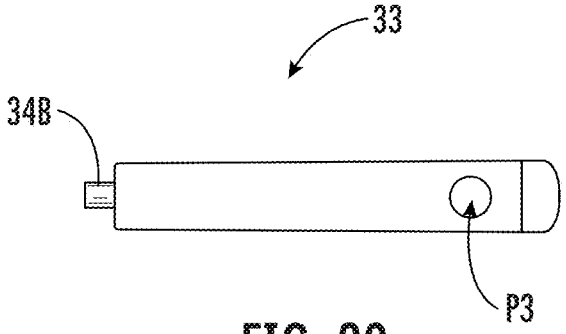

The back disc 17C is shown in more detail in FIGS. 22-25. The back disc 17C includes a plurality of posts or stand-offs S2, each defining an internally threaded blind bore B. The disc-shaped portion of the back disc 17C has defined therein an aperture 34A as shown in FIGS. 23 and 25. The back disc 17C further includes a handle H1 that defines a cavity C configured to receive part of a bungie cord therein as will be discussed below.

As shown in FIGS. 26-30, the junction assembly 16 further includes a covering member 33 configured to cover the cavity C. The covering member 33 is configured be secured to the handle H1 in a snap fit manner. The cover member 33 includes a stud 34B which is configured to be received in the aperture 34A of the disc-shaped portion of the back disc 17C when the cover member is snap-fit connected to the disc-shaped portion of the back disc 17C. The cover member also includes a passage structure PS that defines a passageway P3 therethrough. The passageway P3 is configured to allow a bungee cord to extend therethrough as will be discussed in more detail below.

A grip G1 is slid over a portion of the handle H1 (see FIGS. 11, 71, 72, 80) to establish a friction fit connection therebetween. The grip G1 is made from a rubber material and has defined therein a rib structure on its outer surface so as to increase friction between a user's hand and the grip G1.

Figure 31:
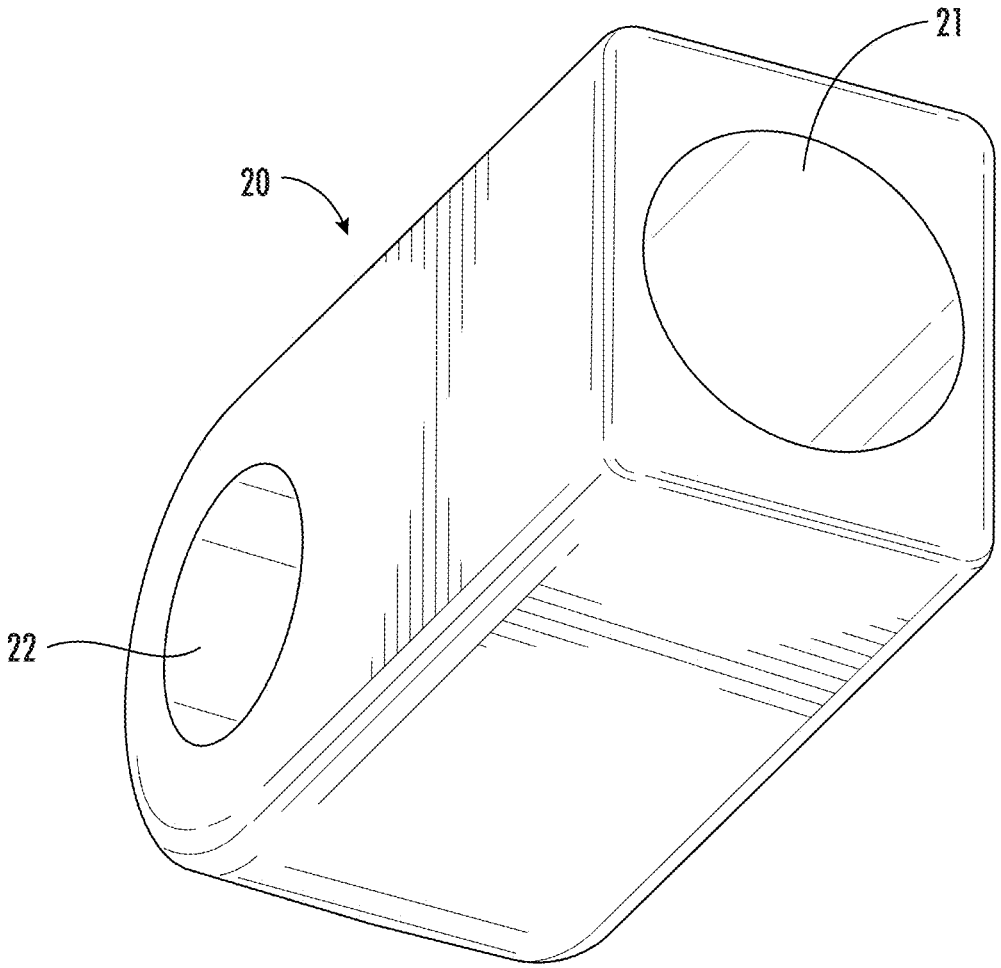
FIGS. 31-33 show various views of the pivot members of the junction assembly of FIG. 11.
Figure 32:
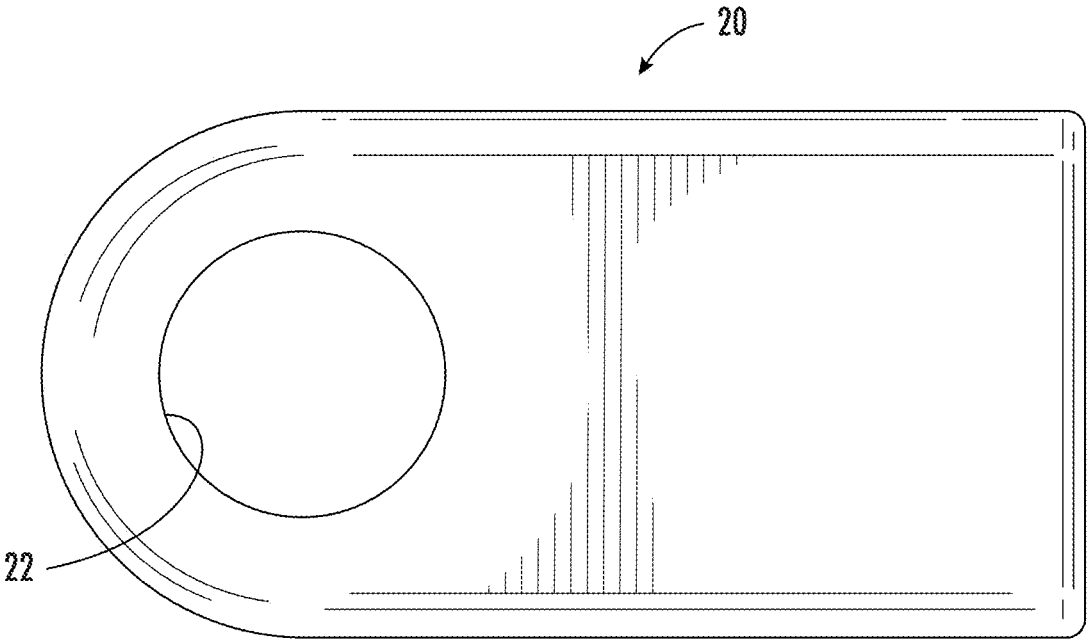
Figure 33:
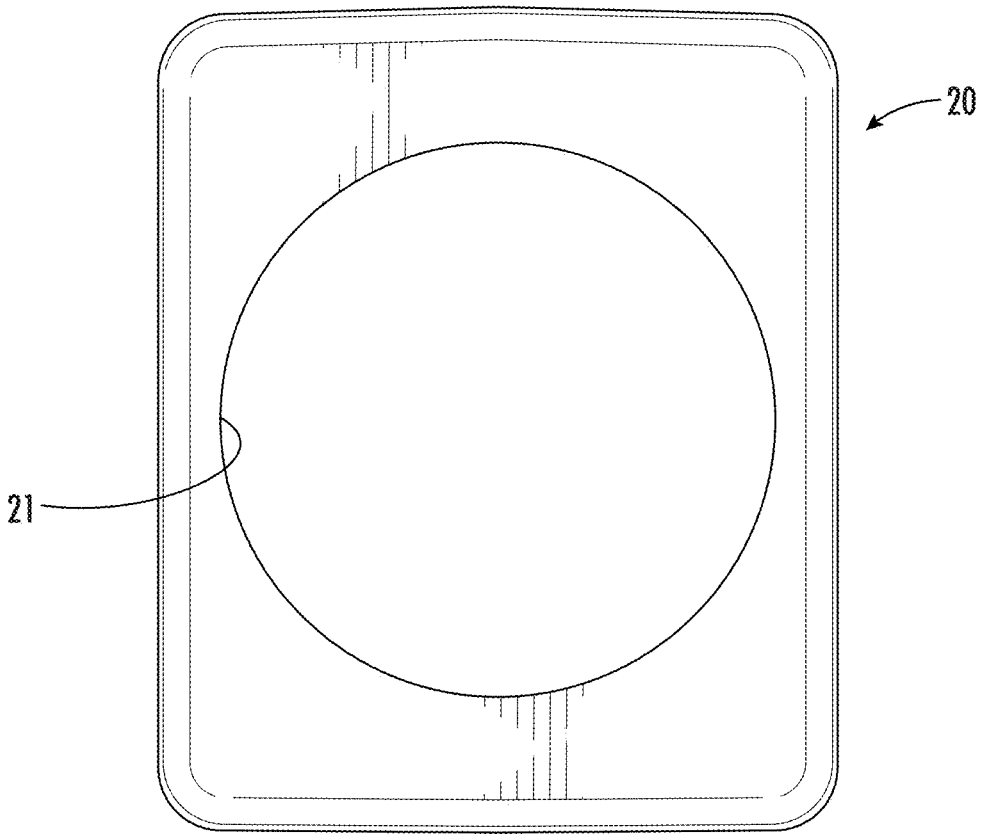

As shown in FIGS. 11-12, the junction assembly 16 further includes a plurality of pivot members 20. The pivot members 20 are shown in detail in FIGS. 31-33. Each of the pivot members 20 defines a blind bore 21 and a passageway 22 that extends therethrough. The passageway 22 is configured to receive a respective bolt 18 therethrough, while the blind bore 23 is configured to receive an end portion of a cylindrical-shaped member therein such as a leg strut, an arm strut, or an actuator component as will be described below. The operation of the junction assembly 16 will be discussed in further detail below as well.

Pedestal Assembly

The pedestal assembly 12 includes a plurality of legs that are movable with respect to each other. The pedestal assembly 12 is configured to be moved between an expanded configuration as shown in FIGS. 1-8 and a collapsed configuration as shown in FIGS. 10, 73, 73A. The plurality of legs includes a leg 38A and a leg 38B (see, e.g., FIG. 2). While the pedestal assembly 12 includes only two legs in the embodiments shown in the present disclosure, it should be appreciated that alternative embodiments of the pedestal assembly 12 may include more than two legs such as three or four legs.

Turning now to FIGS. 34-38 and 40, the leg 38A includes a leg strut 38A-S and a leg extension 38A-E. Similarly, the leg 38B includes a leg strut 38B-S and a leg extension 38B-E. The leg struts 38A-S, 38B-S and the leg extensions 38A-E, 38B-E are made from fiberglass poles and possess an outer diameter of 0.5 inches, but may possess a different outer diameter such as 0.625 inches or 0.375 inches. Alternatively, the leg struts 38A-S, 38B-S and the leg extensions 38A-E, 38B-E may be made from aluminum or steel poles. The leg struts 38A-S, 38B-S and the leg extensions 38A-E, 38B-E may be made from the same materials used to make posts of commercially available portable chairs comprised of flexible material and pivoting posts.

Figure 49:
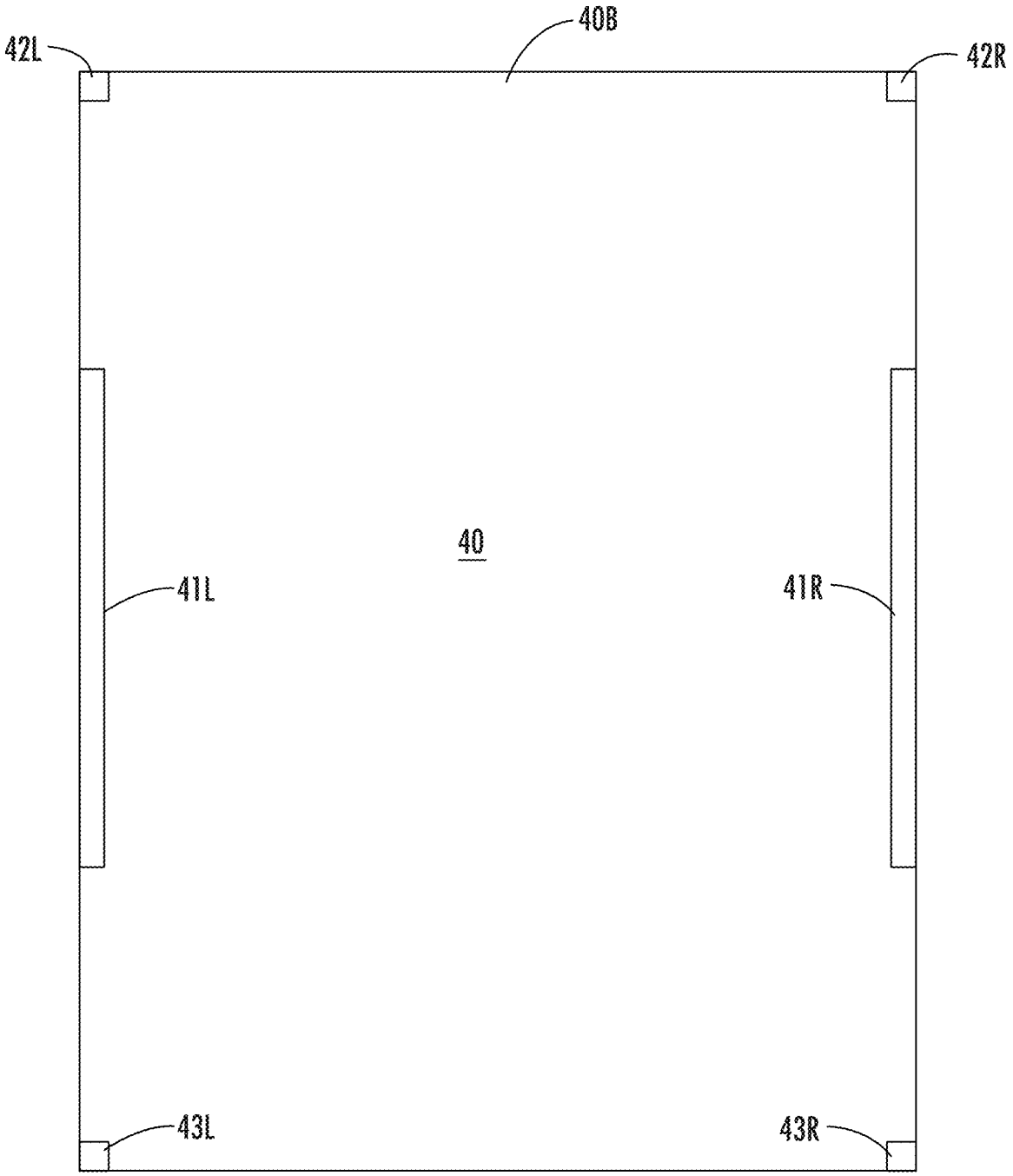
FIG. 49 is an elevational view of the flooring of the portable barrier of FIGS. 1-8, showing its top surface.

The pedestal assembly 12 further includes a limiter or flooring 40 that is connected to the leg 38A and the leg 38B. In particular, the flooring 40 includes a base 40B as shown in FIG. 49. The flooring 40 further includes a left lateral sleeve 41L and a right lateral sleeve 41R that are sewn to a top surface of the base 40B so as to be securely attached thereto. The left lateral sleeve 41L and the right lateral sleeve 41R are made from a nylon fabric material commonly used in the manufacture of lightweight tents, and may alternatively be made from the same fabric material from which the flooring base 40B is made. The sleeves 41L, 41R each define a passageway configured to receive a respective leg extension therethrough as will be discussed below. The flooring 40 further includes a left front pocket 42L and a right front pocket 42R that are sewn to the top surface of the base 40B so as to be securely attached thereto. The left front pocket 42L and the right front pocket 42R are made from an elastic fabric material such as spandex so that the pockets can stretch to a degree sufficient to enable attachment of the flooring 40 to the leg extensions 38A-E, 38B-E as will be discussed below. In addition, the flooring 40 includes a left rear pocket 43L and a right rear pocket 43R that are sewn to the top surface of the base 40B so as to be securely attached thereto. The left rear pocket 43L and the right rear pocket 43R are made from a nylon or polypropylene strap (or webbing) material which does not have elastic characteristics and thereby would not be able to meaningfully stretch in comparison to the front pockets 42L, 42R.

The flooring base 40B is made from a polypropylene fabric material commonly used in the manufacture of outdoor furniture. Alternatively, the flooring base 40B may be made of a fabric material such as a polyethylene fabric or polyester fabric. As one example, the flooring may be made from a 1000 Denier 130 g/m$^2$ polyethylene sheeting treated for water resistance and flame resistance. The flooring 40B may be made from the same material that is used to make the flooring of commercially available tents. Alternatively, the flooring 40B may be made from the same materials used to make the seat portion of commercially available portable chairs comprised of flexible material and pivoting posts.

The flooring 40 is configured to be moved between its expanded configuration as shown in FIGS. 1-8 and its collapsed configuration as schematically shown in FIG. 73A. It should be appreciated that the flooring 40 is positioned in its expanded configuration when the portable barrier is positioned in its protection mode of operation as shown in FIGS. 1-8, while the flooring is positioned in its collapsed configuration when the portable barrier is positioned in its storage mode of operation as shown in FIG. 73A.

It should be appreciated that the flooring is positioned in its collapsed flooring configuration when the portable barrier 10 is positioned in the carrier bag 30 as shown in FIG. 10. To provide further understanding of the configuration of the flooring when it is positioned in its collapsed configuration, reference is made to FIG. 13 of the '365 Patent which shows its portable barrier 10 positioned in its storage mode in which its flooring is positioned in a collapsed configuration.

Figure 34:
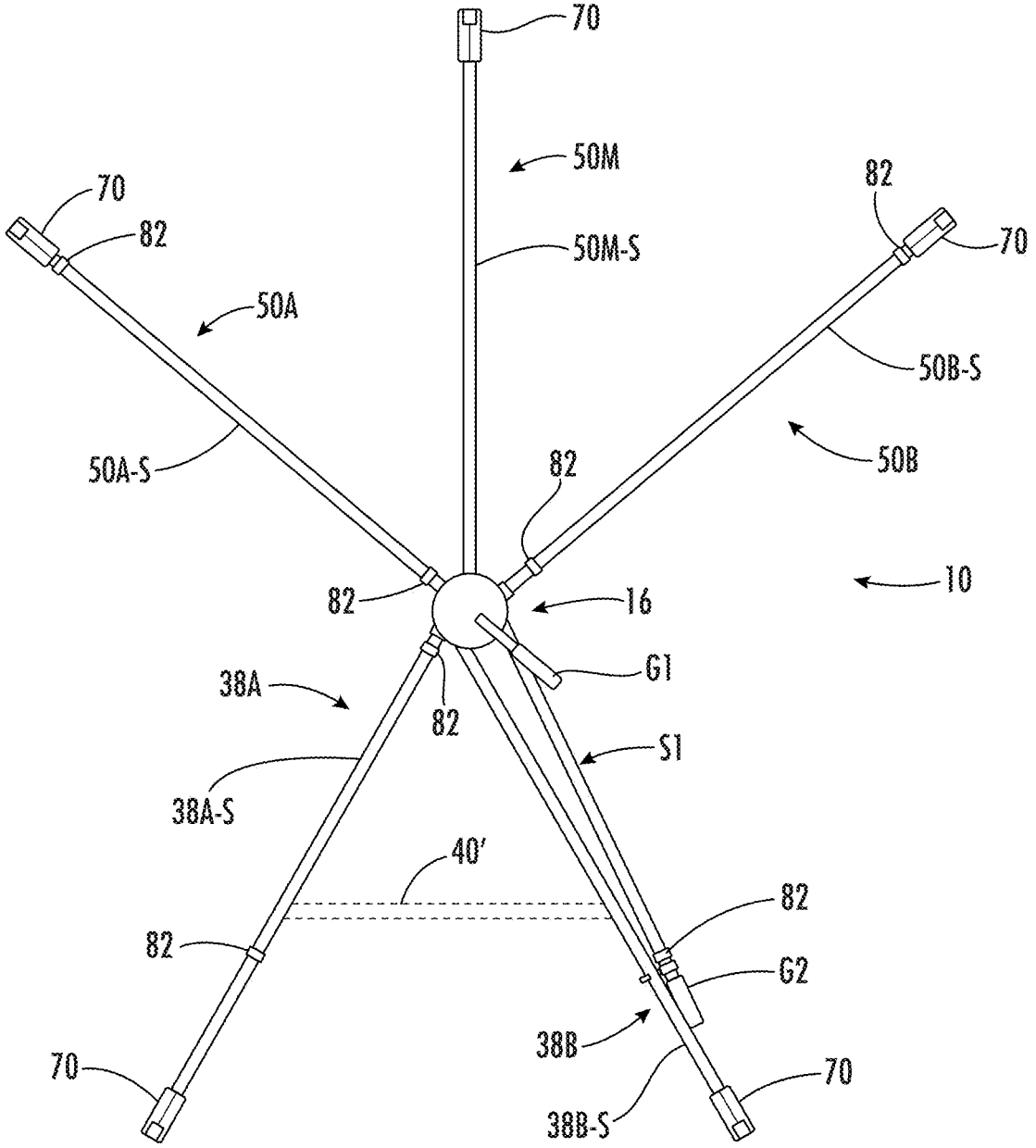
FIGS. 34-40 show various views of the framework of the portable barrier of FIGS. 1-8, wherein the framework includes the various components of the portable barrier with its covering, flooring, back panels, and tensioner removed.
Figure 35:
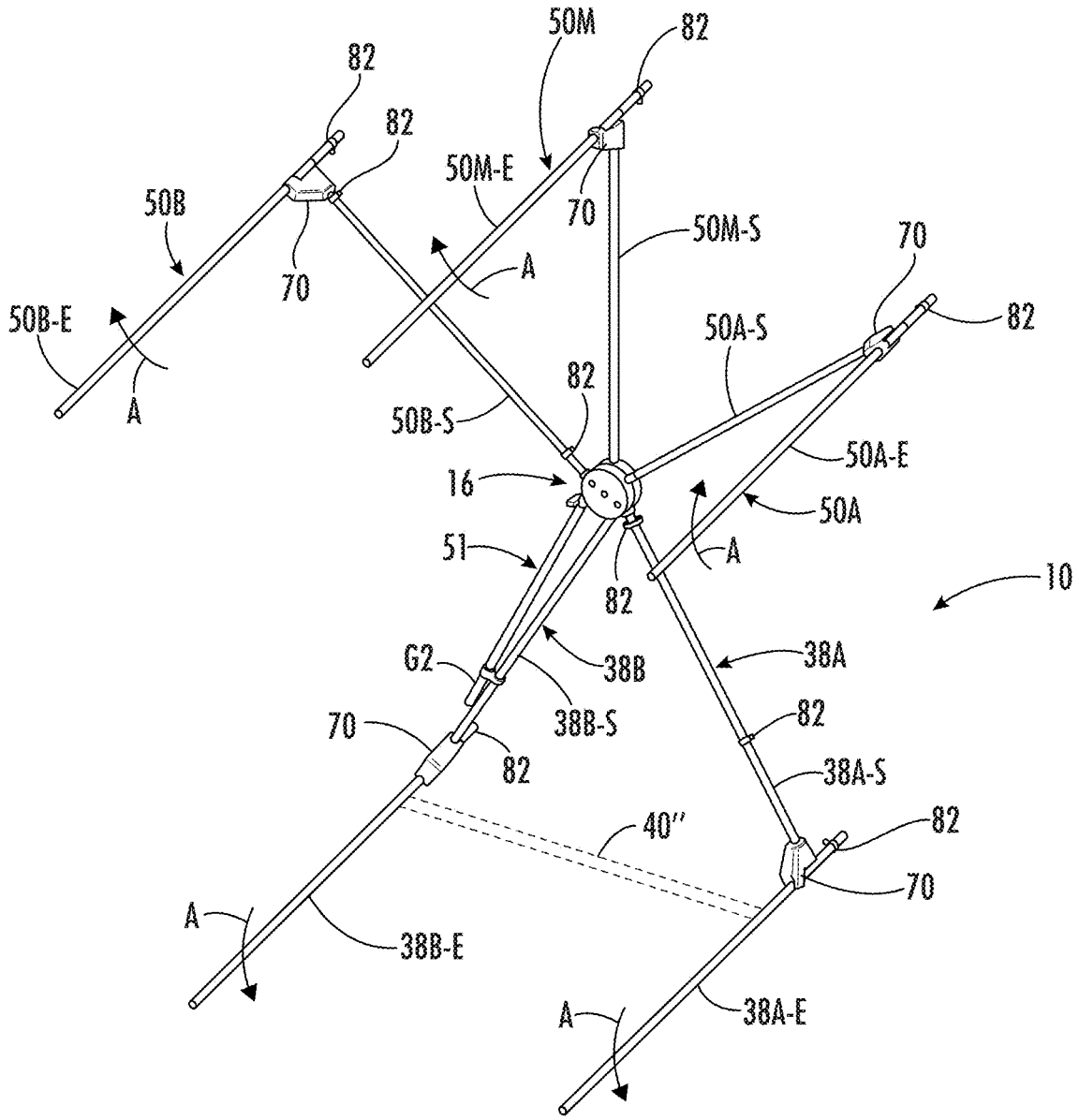

In some possible alternative embodiments, as shown in FIGS. 34 and 35, the limiter is not a flooring (i.e. the portable barrier does not include a flooring), but rather the limiter 40 is a strap 40" (depicted in dashed lines). One example of a suitable strap is a segment of 1" wide polypropylene webbing. In one alternative embodiment, the strap 40' may be connected between the leg strut 38A-S and the leg strut 38B-S (see FIG. 34). In another alternative embodiment, the strap 40" may be connected between the leg extension 38A-E and the leg extension 38B-E (see FIG. 35). The strap 40', 40" may be held in place by the use of fasteners or the like (see FIG. 38) or made be held in place in the same manner that the various back screen panels are held in place in the portable barrier 10 of the present disclosure as will be discussed below In still another alternative embodiment, the limiter may be a fabric back screen panel BSP that is connected between the leg strut 38A-S and the leg strut 38B-S and held in place by fasteners or the like (see FIG. 38) or made be held in place in the same manner that the other back screen panels are held in place in the portable barrier 10 of the present disclosure, as will be discussed below. In such an alternative embodiment, no flooring or strap is present in the portable barrier.

The leg struts 38A-S, 38B-S are each pivotably connected to the junction assembly 16 with the use of pivot members 20. In particular, the end portions of each of the leg struts 38A-S, 38B-S are attached to a respective pivot member 20 by use of an adhesive. More specifically, the end portions of each of the leg struts 38A-S, 38B-S are inserted in the blind bores 21 of their respective pivot members 20 and then glued in place. Then, the respective pivot member 20 is secured between appropriate disc components as shown in FIGS. 11-12, and thereafter a respective screw 18 is advanced through the passageway 22 of the respective pivot member 20 so as to pivotably retain the pivot member 20 in relation to the disc-like components 17A, 18B, 17C.

During movement of the portable barrier 10 from its protection mode (see FIGS. 1-8) to its storage mode (see FIGS. 10, 73, 73A), both leg struts 38A-S, 38B-S pivot about an axis defined by its respective screw 18 as shown in FIGS. 11-12. Pivoting of the leg struts 38A-S, 38B-S cause a corresponding pivoting of the leg extensions 38A-E, 38B-E. It should be appreciated that the flooring 40 is attached to the leg extensions 38A-E, 38B-E so that the extent of movement or distance between the leg extension 38A-E and the leg extension 38B-E is limited by the flooring 40. More specifically, the leg extension 38A-E is allowed to move in relation to the leg extension 38B-E from a collapsed configuration of the pedestal assembly 12 shown in FIGS. 73, 73A to an expanded configuration of the pedestal assembly shown in FIGS. 1-8, in which the leg extensions 38A-E, 38B-E are separated by a maximum distance shown in FIGS. 1-8.

Back Screen Panels

The portable barrier 10 further includes a left lateral back screen panel 112, a right lateral back screen panel 114, and a middle back screen panel 110. The back screen panels 110, 112, 114 are made from a fabric material. As one example, the back screen panels are made from a Denier Nylon Ripstop with Urethane Coat material that is treated for water resistance and flame resistance.

The back screen panels 110, 112, 114 are configured to be moved between their expanded configuration as shown in FIGS. 1-8 and their collapsed configuration as schematically shown in FIG. 73A. It should be appreciated that the back screen panels 110, 112, 114 are positioned in their expanded configuration when the portable barrier is positioned in its protection mode of operation as shown in FIGS. 1-8, while the back screen panels 110, 112, 114 are positioned in their collapsed configuration when the portable barrier is positioned in its storage mode of operation as shown in FIG. 73A.

It should be appreciated that the back screen panels 110, 112, 114 are positioned in their collapsed configuration when the portable barrier 10 is positioned in the carrier bag 30 as shown in FIG. 10. To provide further understanding of the configuration of the back screen panels 110, 112, 114 when they are positioned in their collapsed configuration, reference is made to FIG. 13 of the '365 Patent which shows its portable barrier 10 positioned in its storage mode in which its back screen is positioned in a collapsed configuration.

Cover Assembly

The cover assembly 14 includes a plurality of arms 50A, 50B, 50M that are movable with respect to each other (see, e.g., FIG. 4), and a covering 52 attached to each of the plurality of arms. The cover assembly 14 is configured to be moved between an expanded configuration as shown in FIGS. 1-8 and a collapsed configuration as shown in FIGS. 10, 73, 73A. As shown in FIG. 1-8, the cover assembly 14 is supported above the pedestal assembly 12 when (i) the portable barrier 10 is positioned in the protection mode, and (ii) the pedestal assembly 10 is supported on a generally horizontal surface (see, e.g., FIG. 1) such as the ground adjacent to a sports field or a sandy surface at a beach.

Figure 2:
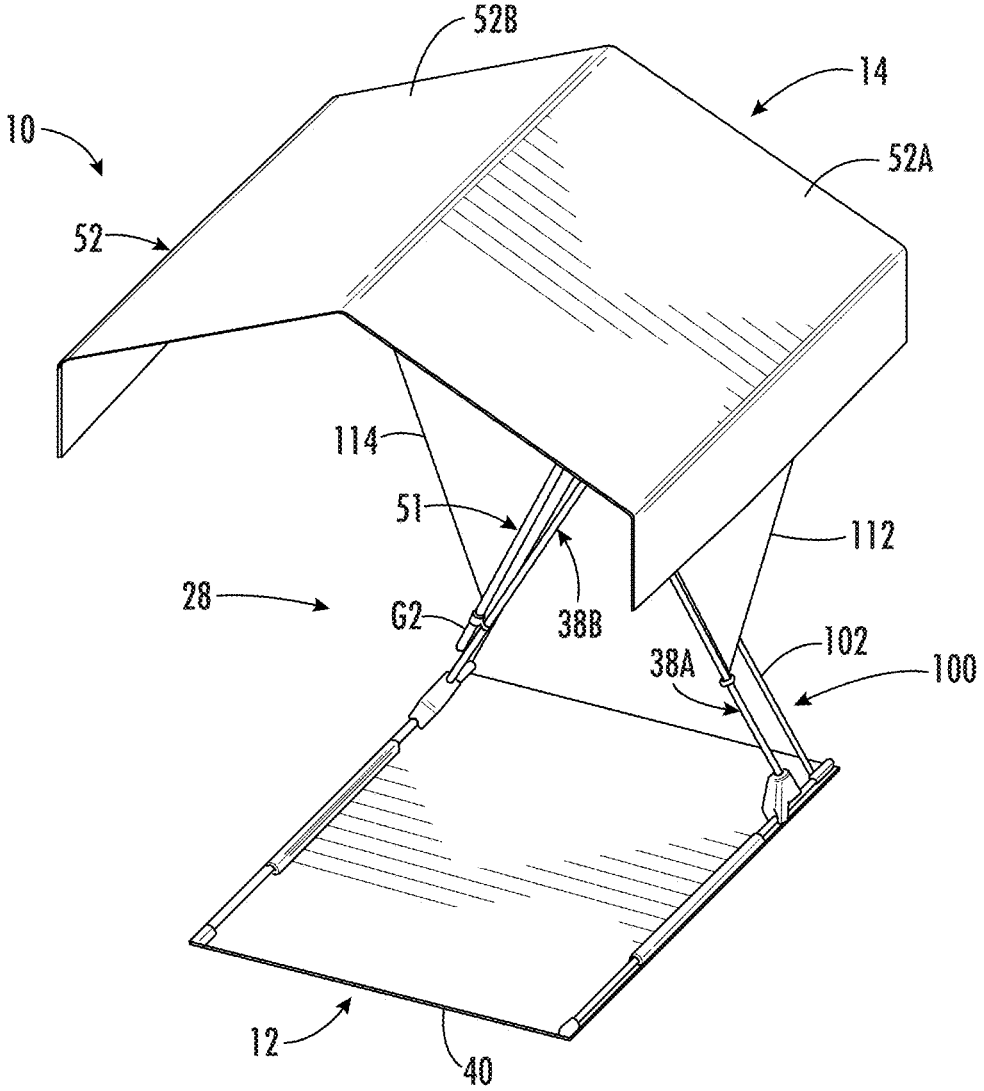
Figure 3:
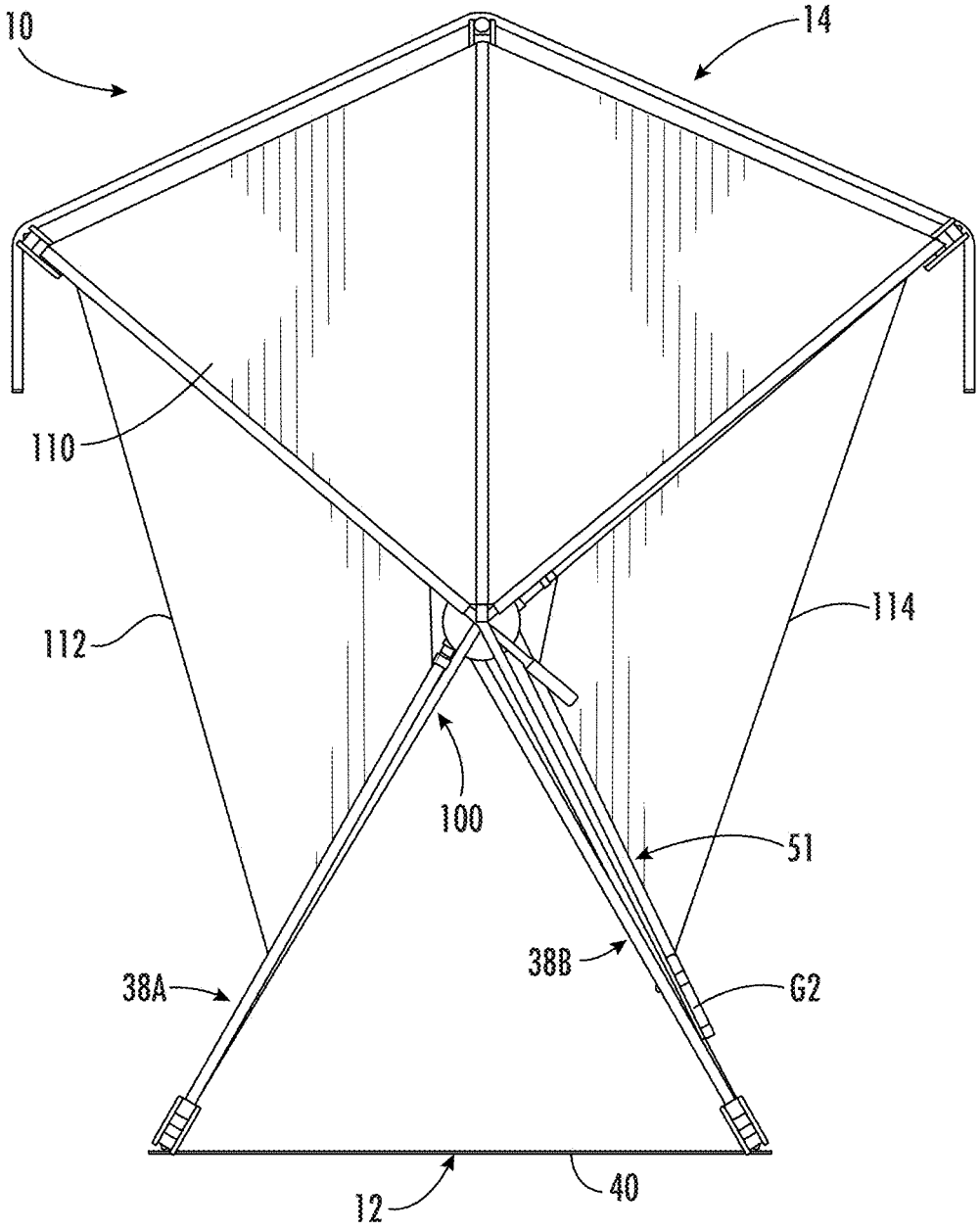
Figure 4:
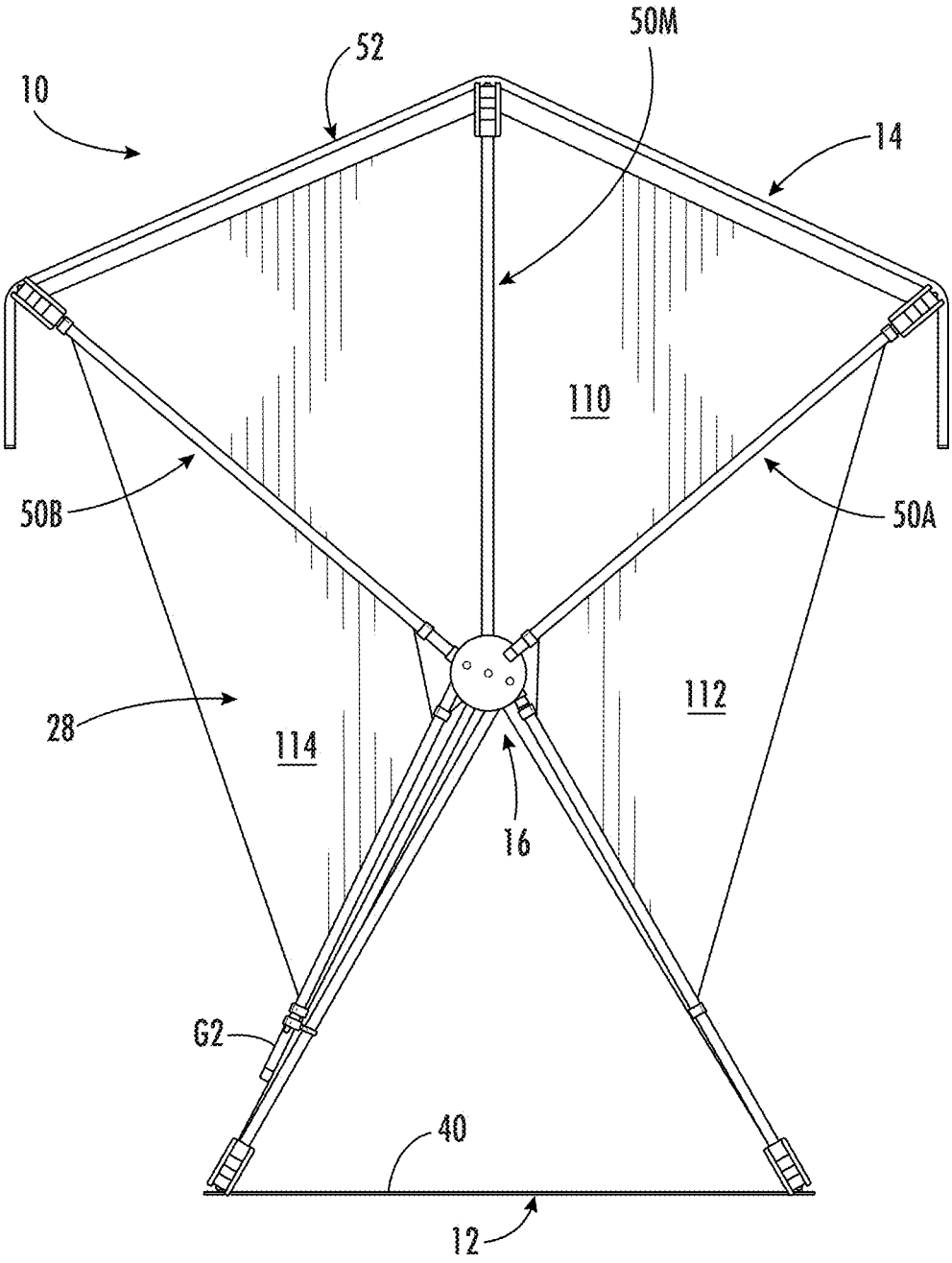

The plurality of arms includes an arm 50A, an arm 50B, and an intermediate arm 50M interposed therebetween. Note that the portable barrier 10 also includes an actuator component 51 (or actuator arm or supplemental component) which is not part of the cover assembly 14. As shown in FIG. 2 (see also FIGS. 34-35 and 64-66), the actuator component 51 is positioned adjacent to the leg strut 38B-S when the portable barrier 10 is positioned in the protection mode. A grip G2 is slid over the free end portion of the actuator component 51 to establish a friction fit connection therebetween. The grip G2 is made from a rubber material and has defined therein a rib structure on its outer surface so as to increase friction between a user's hand and the grip G2.

Figure 62:
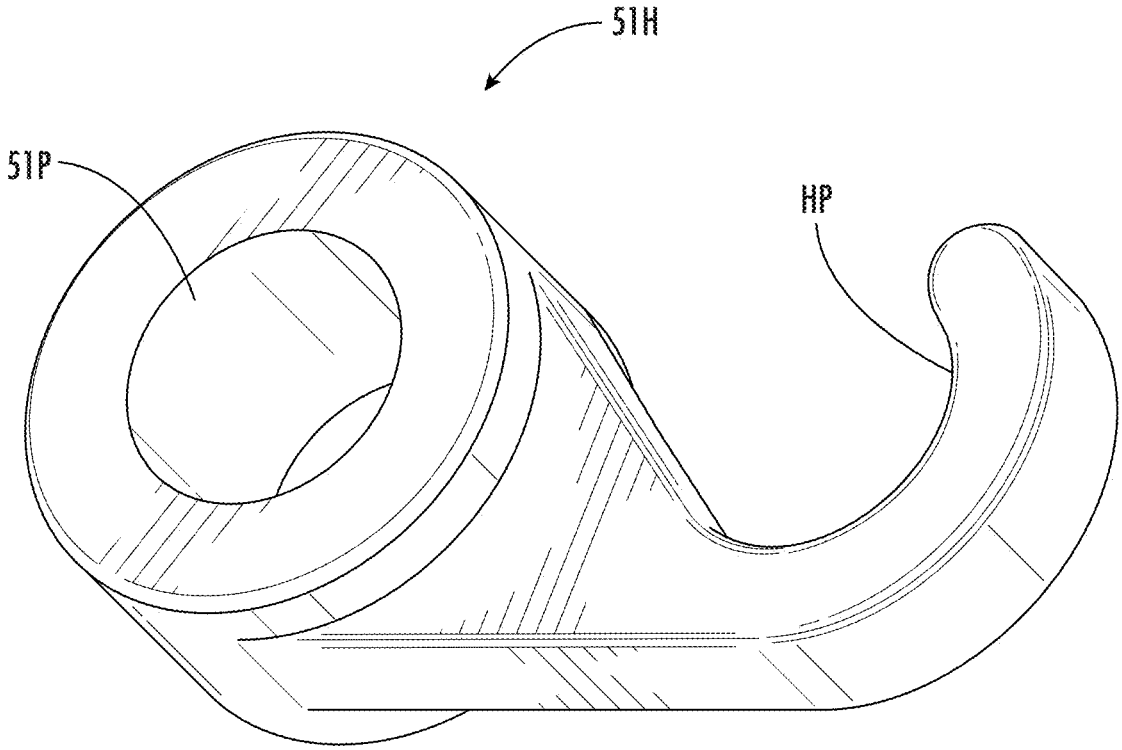
FIGS. 62-63 show views of the rod hook of the portable barrier of FIGS. 1-8.
Figure 63:
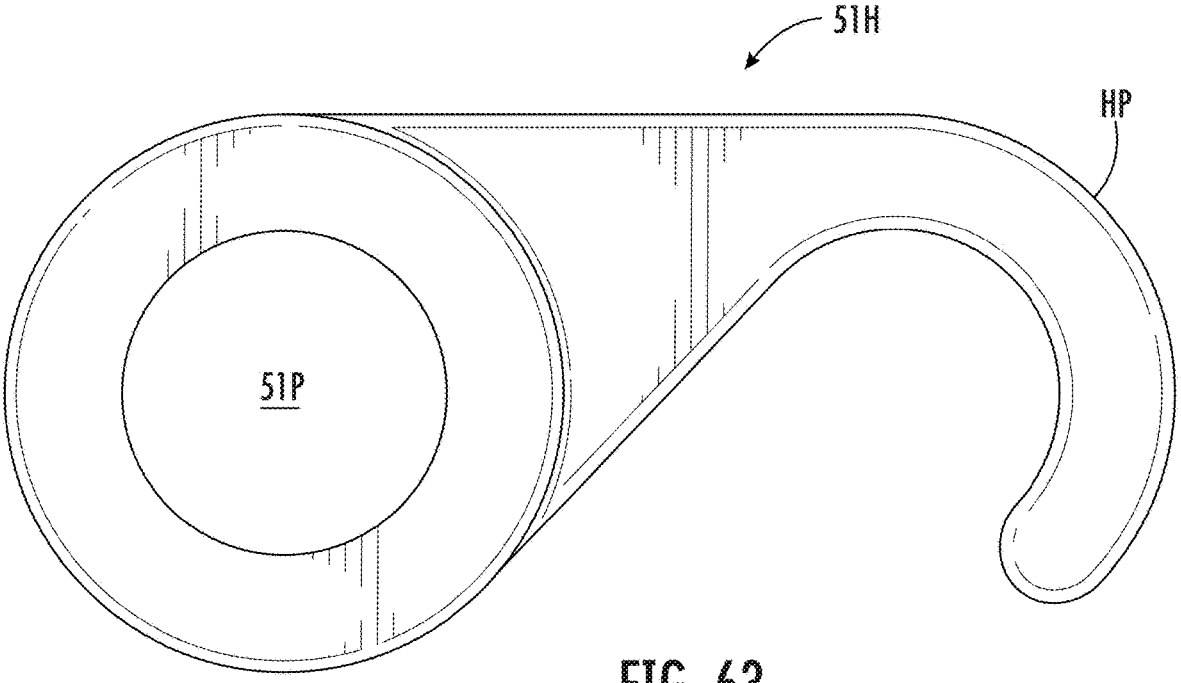
Figure 64:
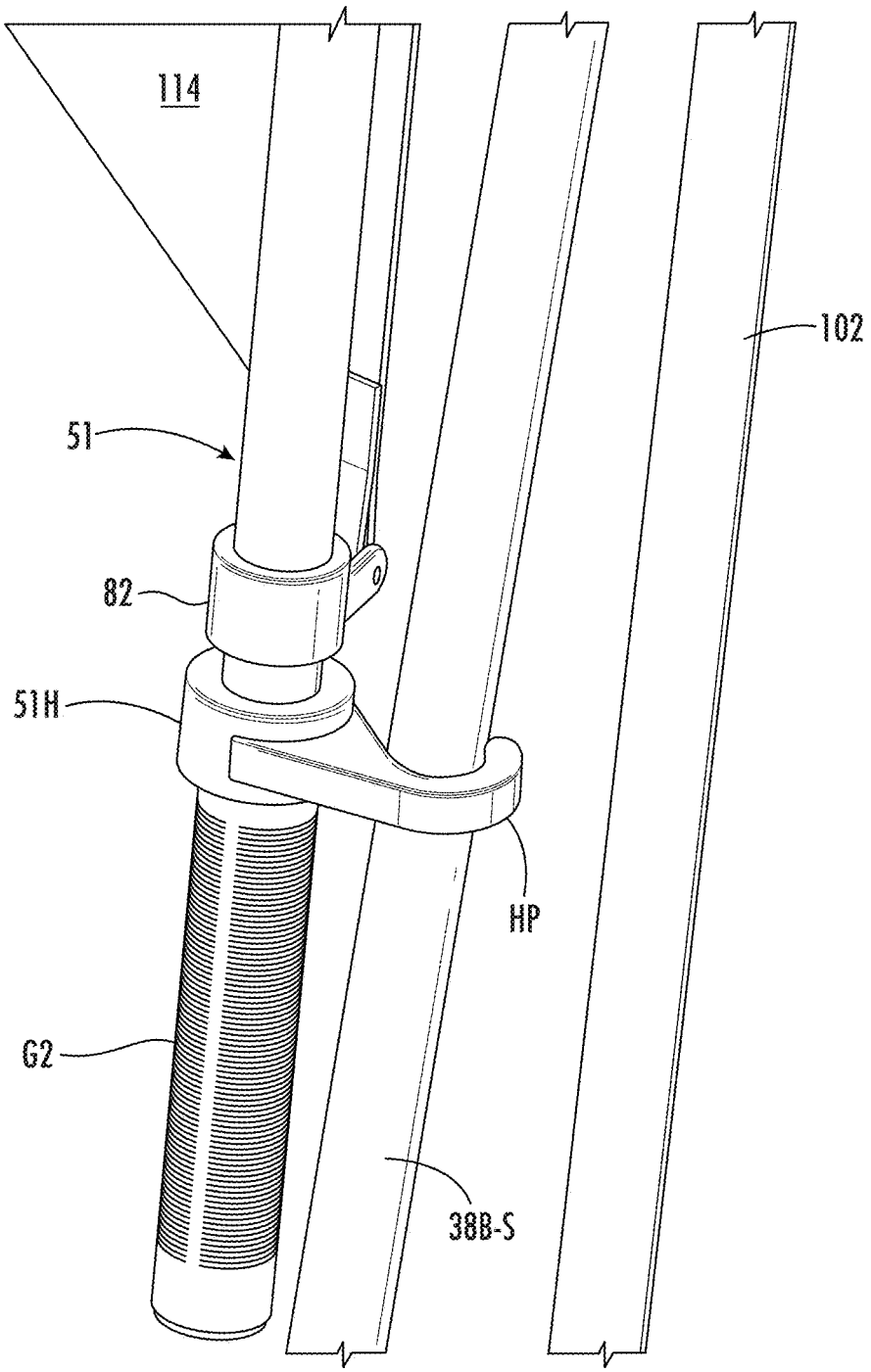
FIG. 64 is a fragmentary perspective view of a portion of the portable barrier of FIGS. 1-8, showing the position of the rod hook of FIGS. 62-63 just after it has been positioned in mating relationship with the right leg strut so as to secure the portable barrier in its protection mode of operation.
Figure 65:
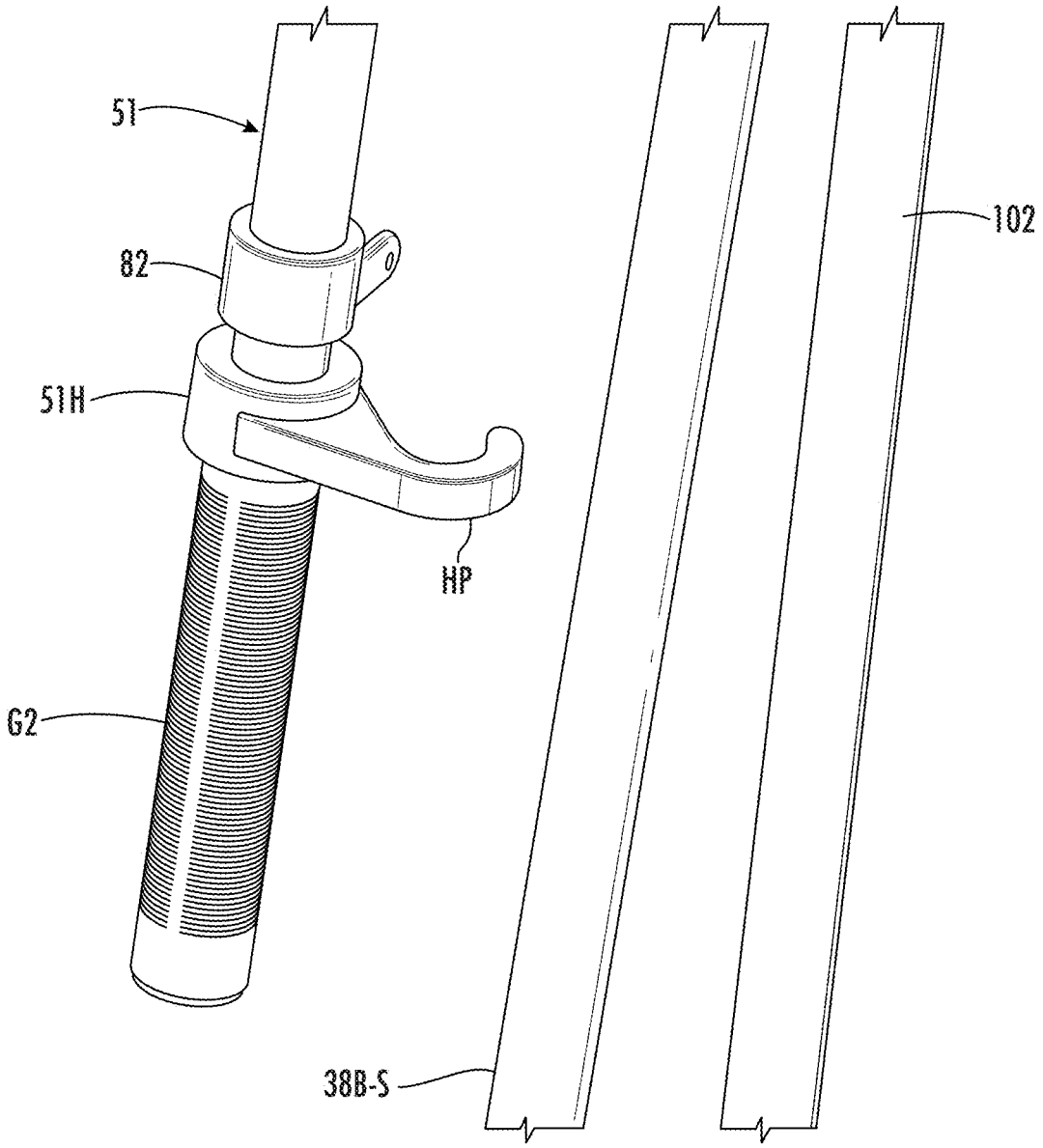
FIG. 65 is a fragmentary perspective view of the portion of the portable barrier of FIGS. 1-8 that was depicted in FIG. 64, but showing the position of the rod hook in relation to the right leg strut during the set-up process of the portable barrier of FIGS. 1-8 at a time just prior to being advanced into the mating relationship shown in FIG. 64.
Figure 66:
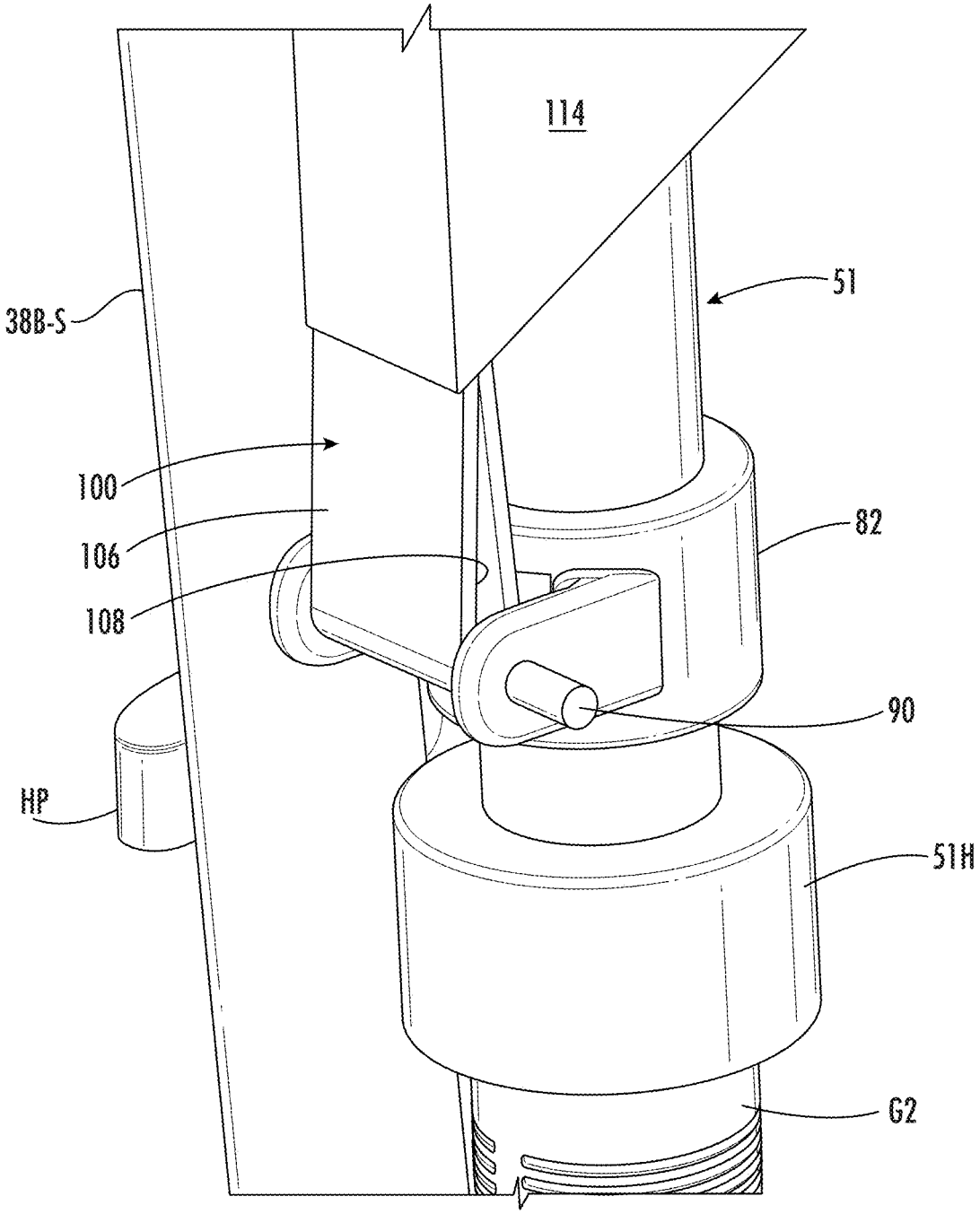
FIG. 66 is an enlarged fragmentary perspective view of the portion of the portable barrier of FIGS. 1-8 that is depicted in FIG. 64, but showing the pin 90 moved somewhat out of its normal operational position for clarity of description.

The actuator component 51 carries a rod hook 51H at one end of the grip G2 as shown in FIGS. 64-66. The rod hook 51H is fixed in relation to the actuator component 51 with glue. The rod hook 51H is shown in more detail in FIGS. 62-63. In particular, the rod hook 51H defines a passageway 51P through which the actuator component 51 extends. The rod hook 51H also includes a hook portion HP which is configured to partially receive the leg strut 38B-S therein as shown in FIGS. 64 and 66. In operation, the rod hook 51H is used to secure the portable barrier in its protection mode. As shown in FIGS. 64-65, at the final stage of setting up the portable barrier 10, the actuator component 51 is moved from its position shown in FIG. 65 to its position shown in FIG. 64 so that the hook portion HP partially extends around the outer contour of the leg strut 38B-S so that the portable barrier 10 is securely locked in its protection mode.

While the cover assembly 14 possesses three arms in the embodiments shown in the present disclosure, it should be appreciated that alternative embodiments of the cover assembly 14 may include more or less than three arms such as two, four, or five arms.

Turning now to FIGS. 34-40 (and FIGS. 41-48), the arm 50A includes an arm strut 50A-S and an arm extension 50A-E. Similarly, the arm 50B includes an arm strut 50B-S and an arm extension 50B-E. And the arm 50M includes an arm strut 50M-S and an arm extension 50M-E. The arm struts 50A-S, 50B-S, 50M-S and the arm extensions 50A-E, 50B-E, 50M-E are made from fiberglass poles and possess an outer diameter of 0.5 inches, but may possess a different outer diameter such as 0.625 inches or 0.375 inches. Alternatively, the arm struts 50A-S, 50B-S, and the arm extensions 50A-E, 50B-E, 50M-E may be made from aluminum or steel poles. The arm struts 50A-S, 50B-S, 50M-S and the arm extensions 50A-E, 50B-E, 50M-E may be made from the same materials used to make posts of commercially available portable chairs comprised of flexible material and pivoting posts. The actuator component 51 is made of the same material and possesses the same outer diameter as the arm struts 50A-S, 50B-S, 50M-S and the arm extensions 50A-E, 50B-E, 50M-E.

Figure 50:
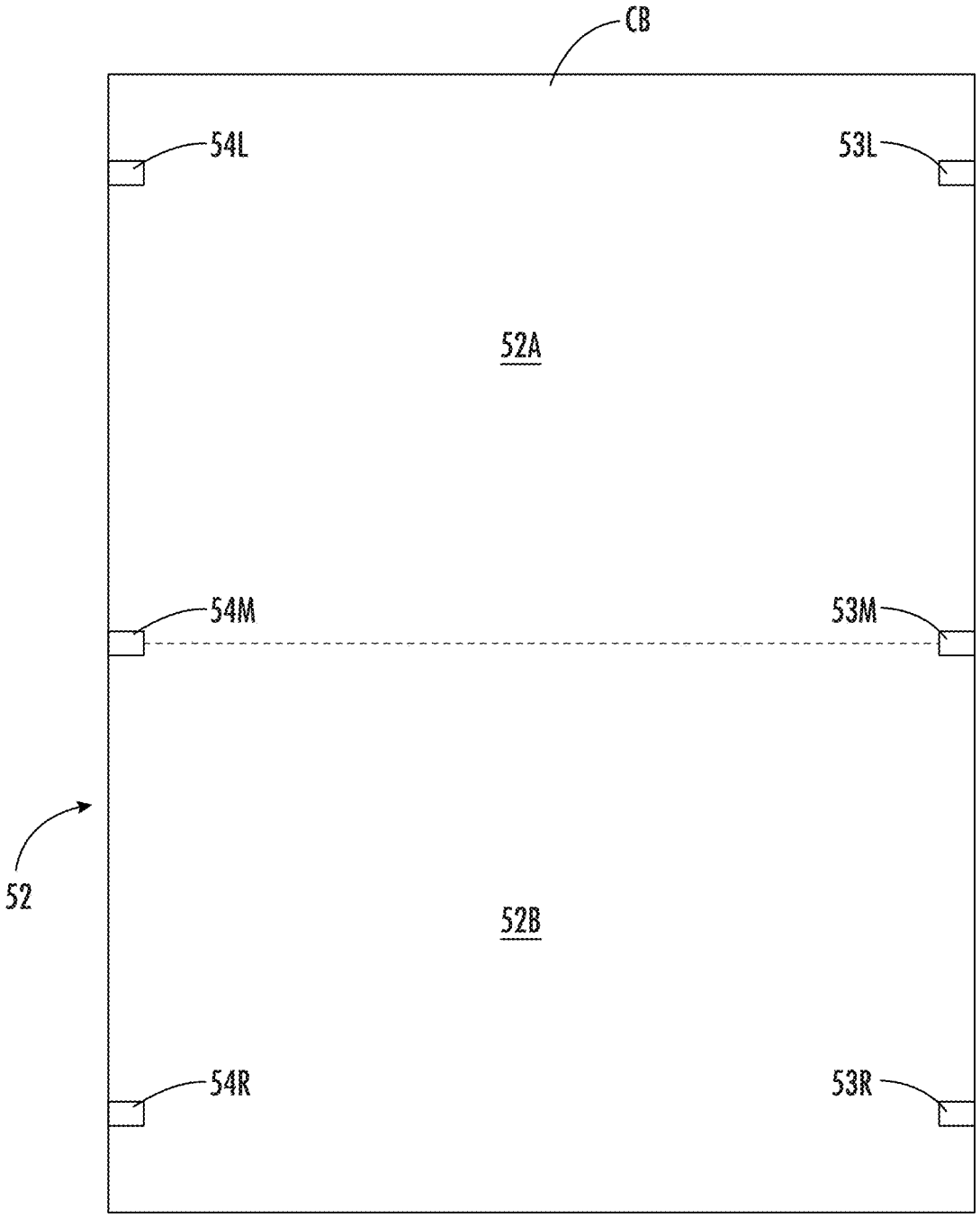
FIG. 50 is an elevational view of the covering of the portable barrier of FIGS. 1-8, showing its bottom surface.
Figure 51:
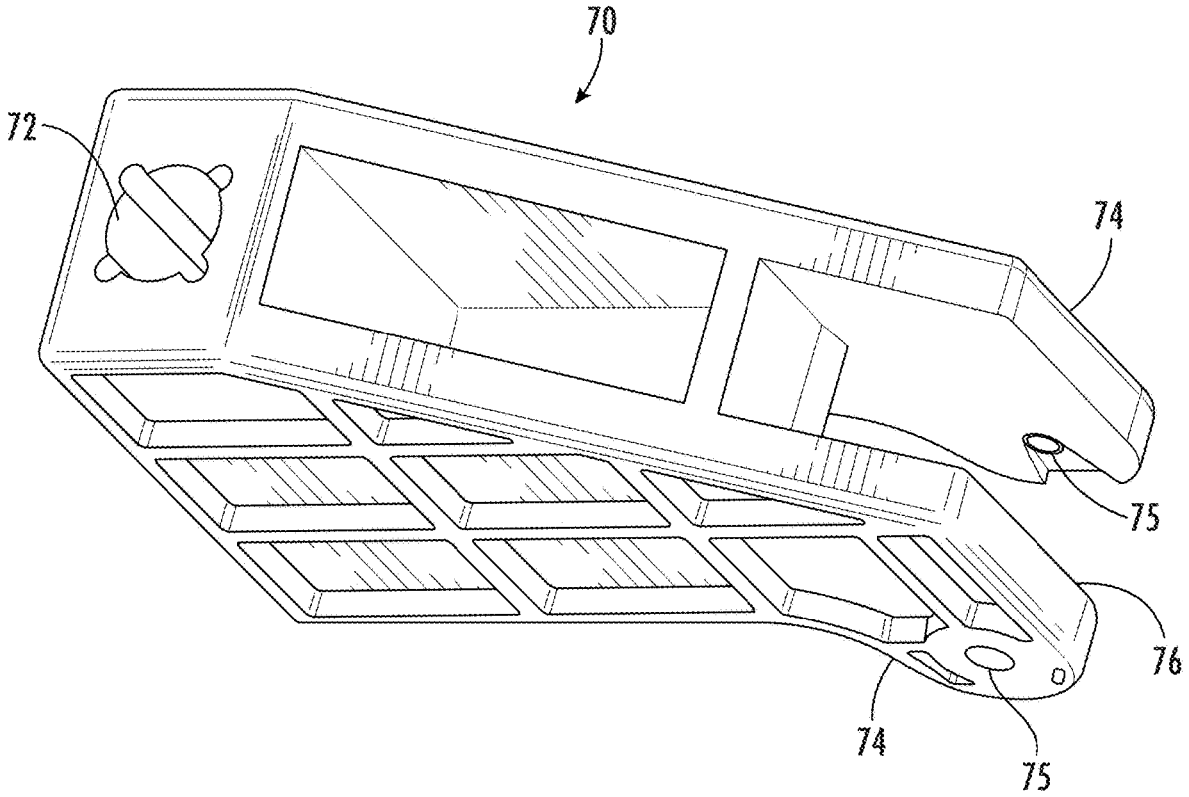
FIGS. 51-56 show various views of the hinge components of the portable barrier of FIGS. 1-8.
Figure 52:
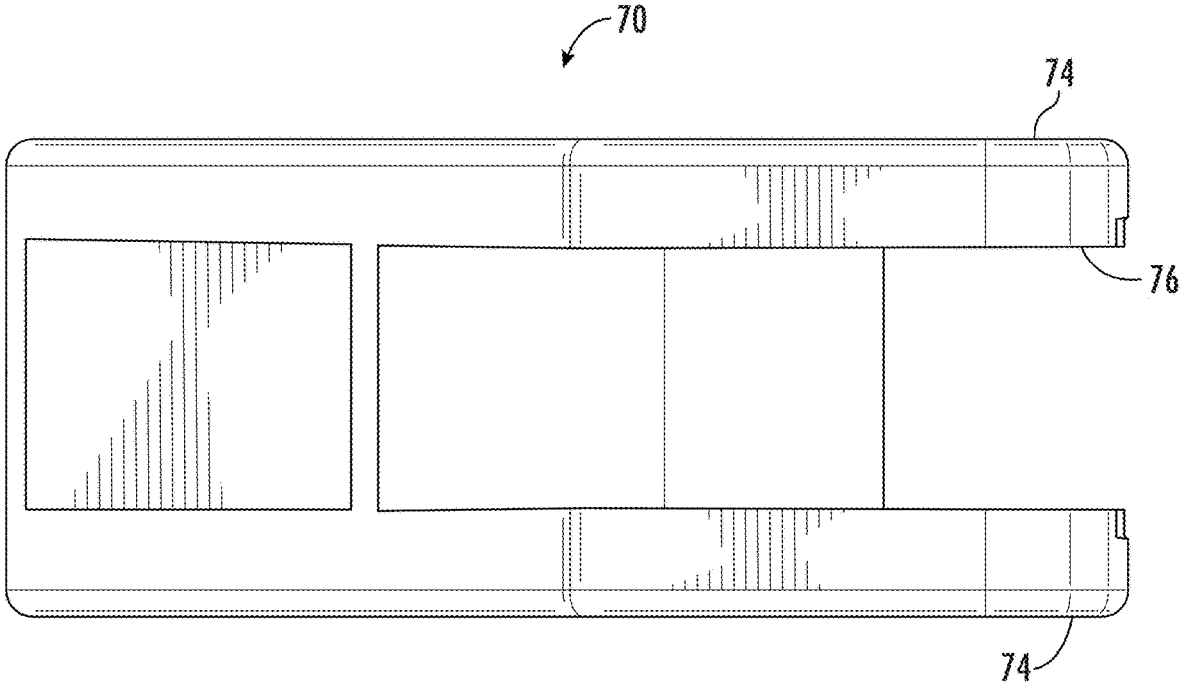
Figure 53:
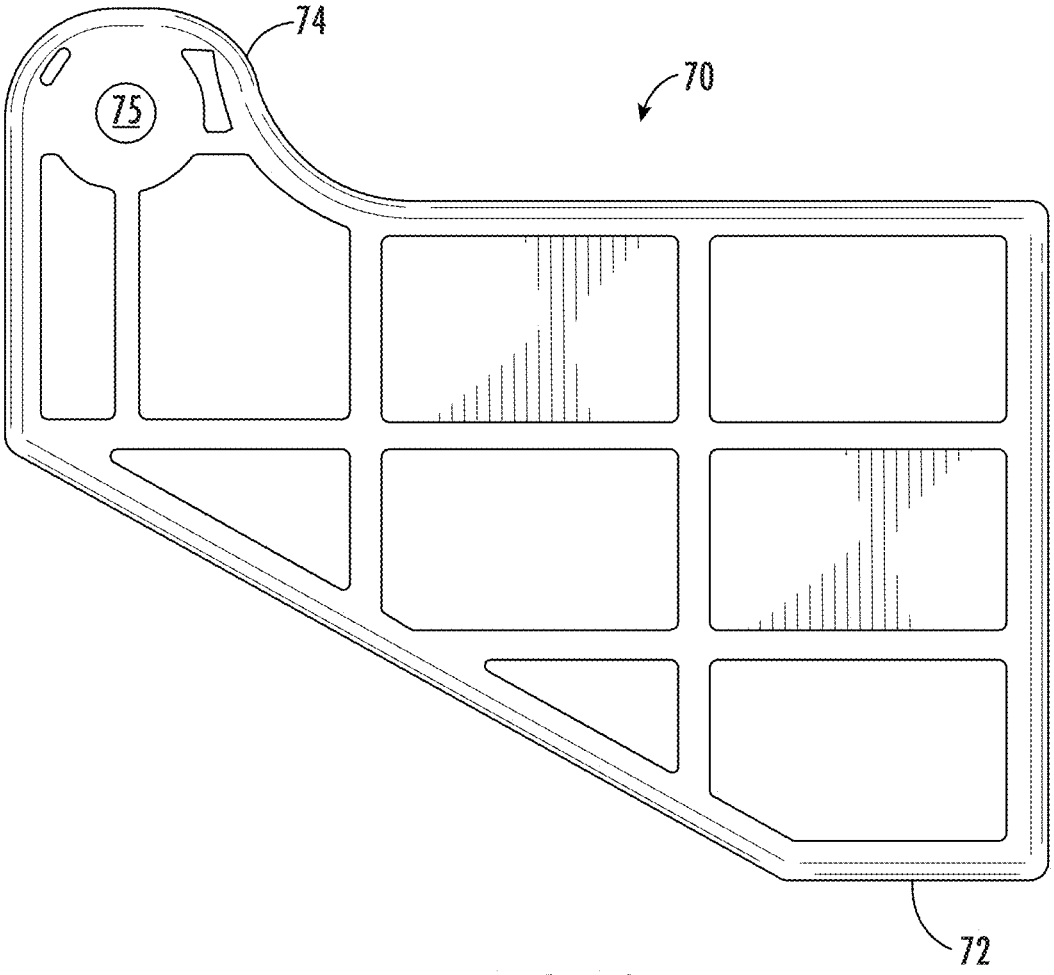
Figure 54:
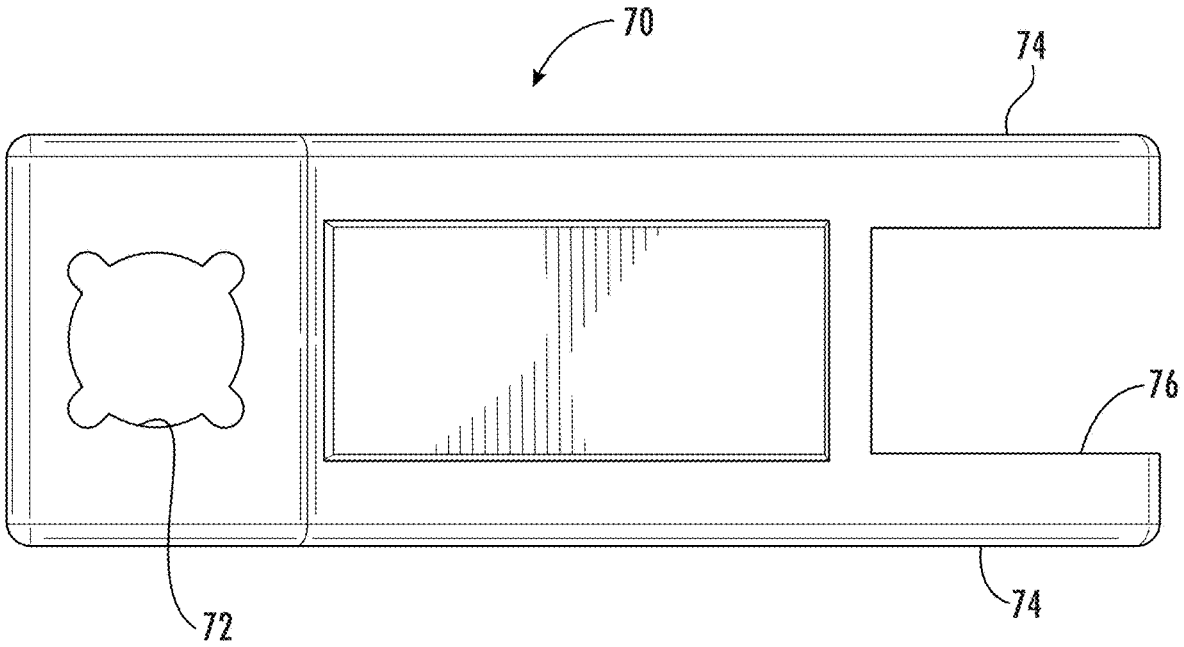
Figure 55:
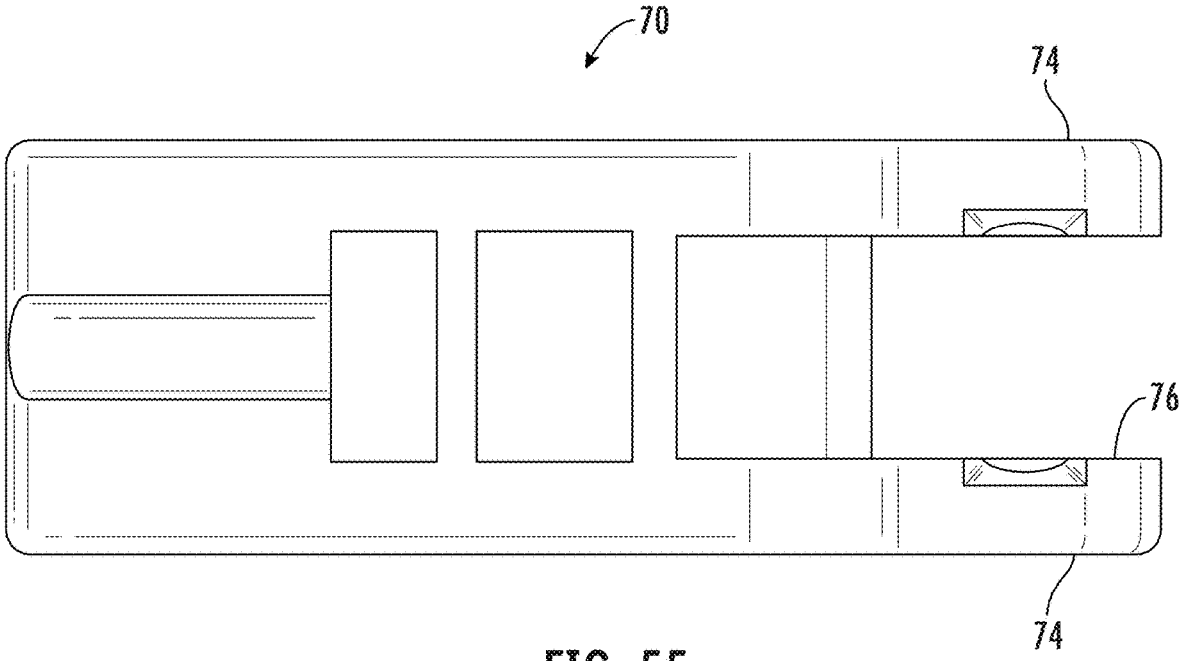
Figure 56:
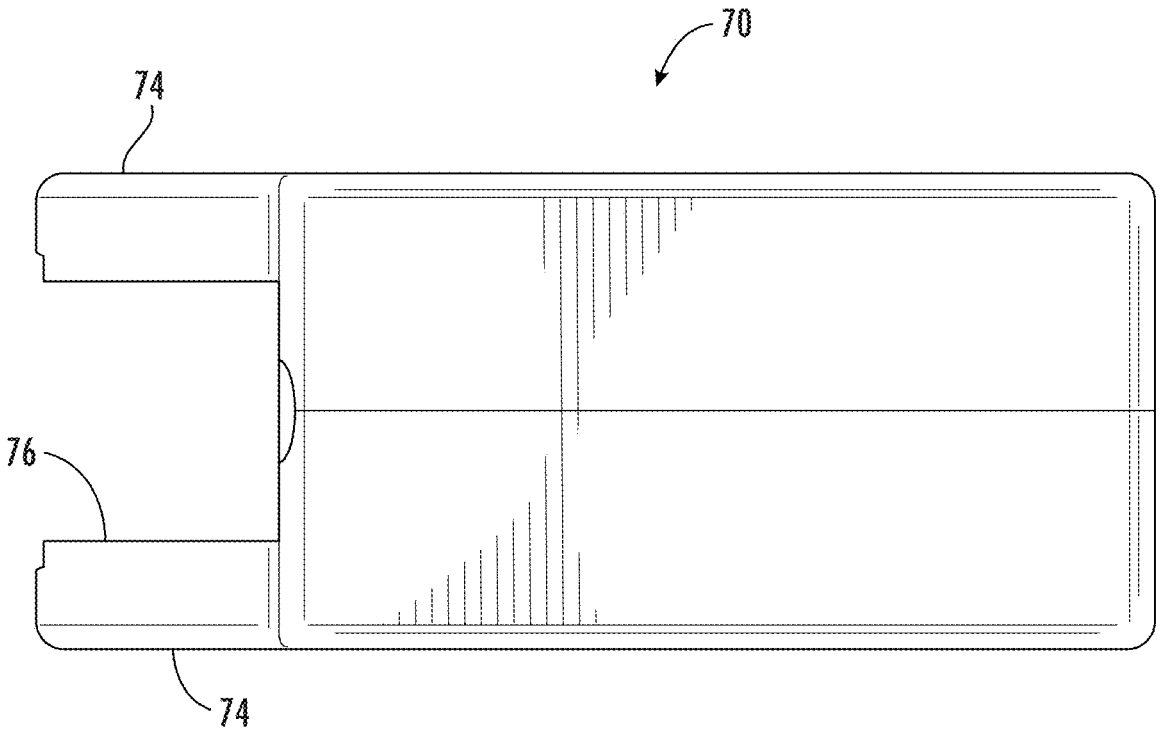
Figure 57:
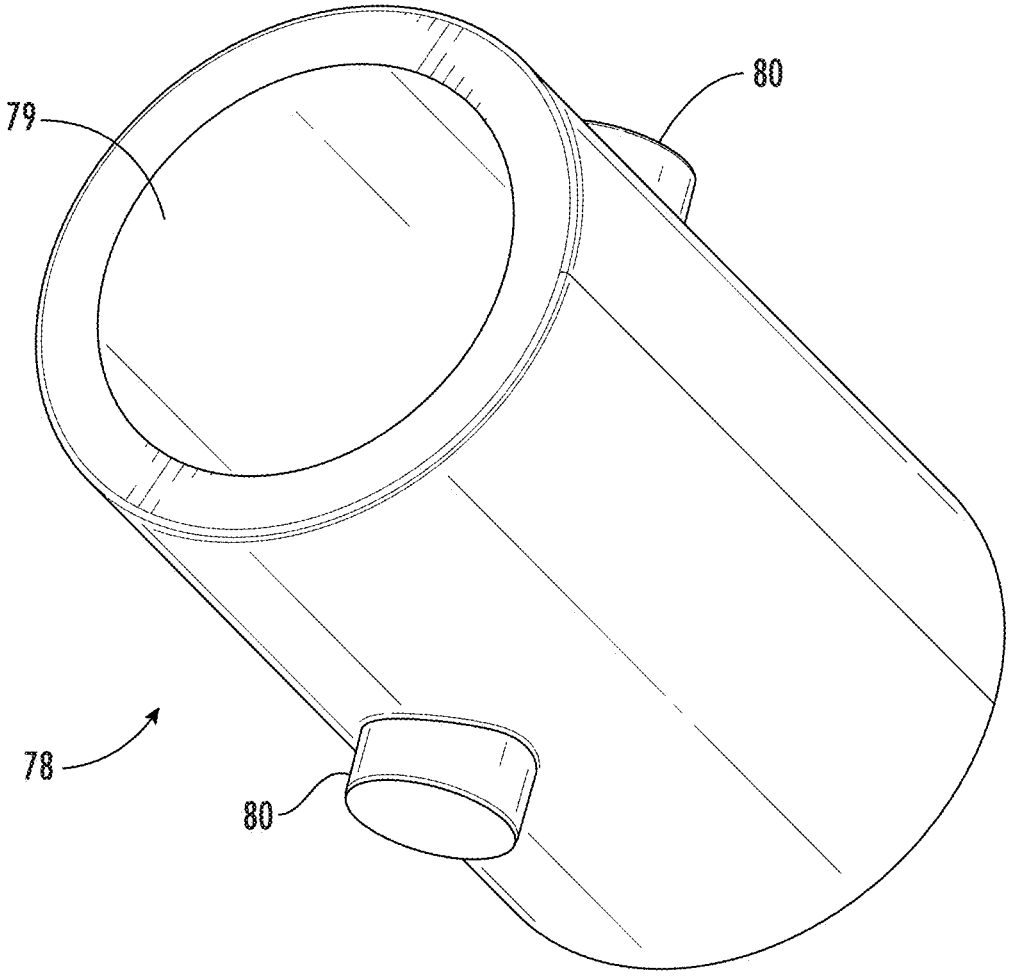
FIGS. 57-59 show various views of the hinge adapters of the portable barrier of FIGS. 1-8.
Figure 58:
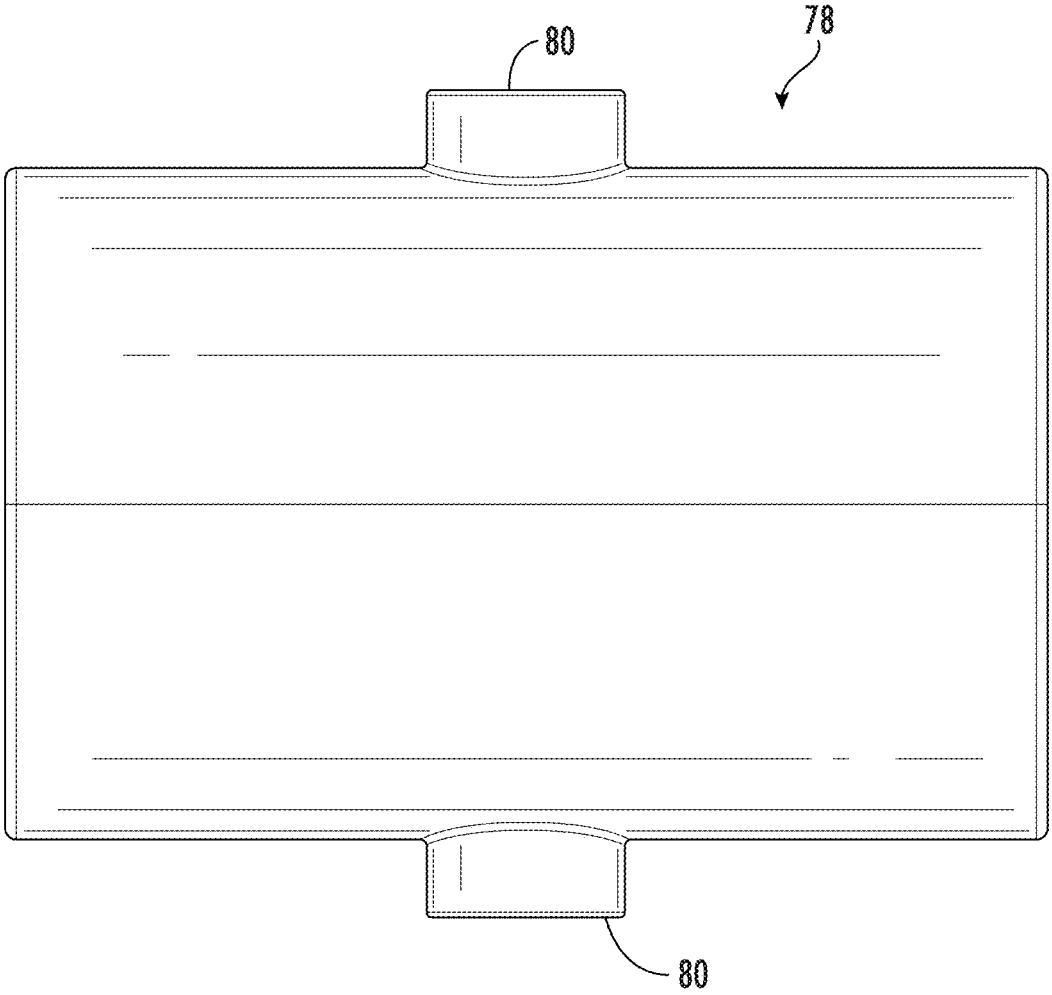
Figure 59:
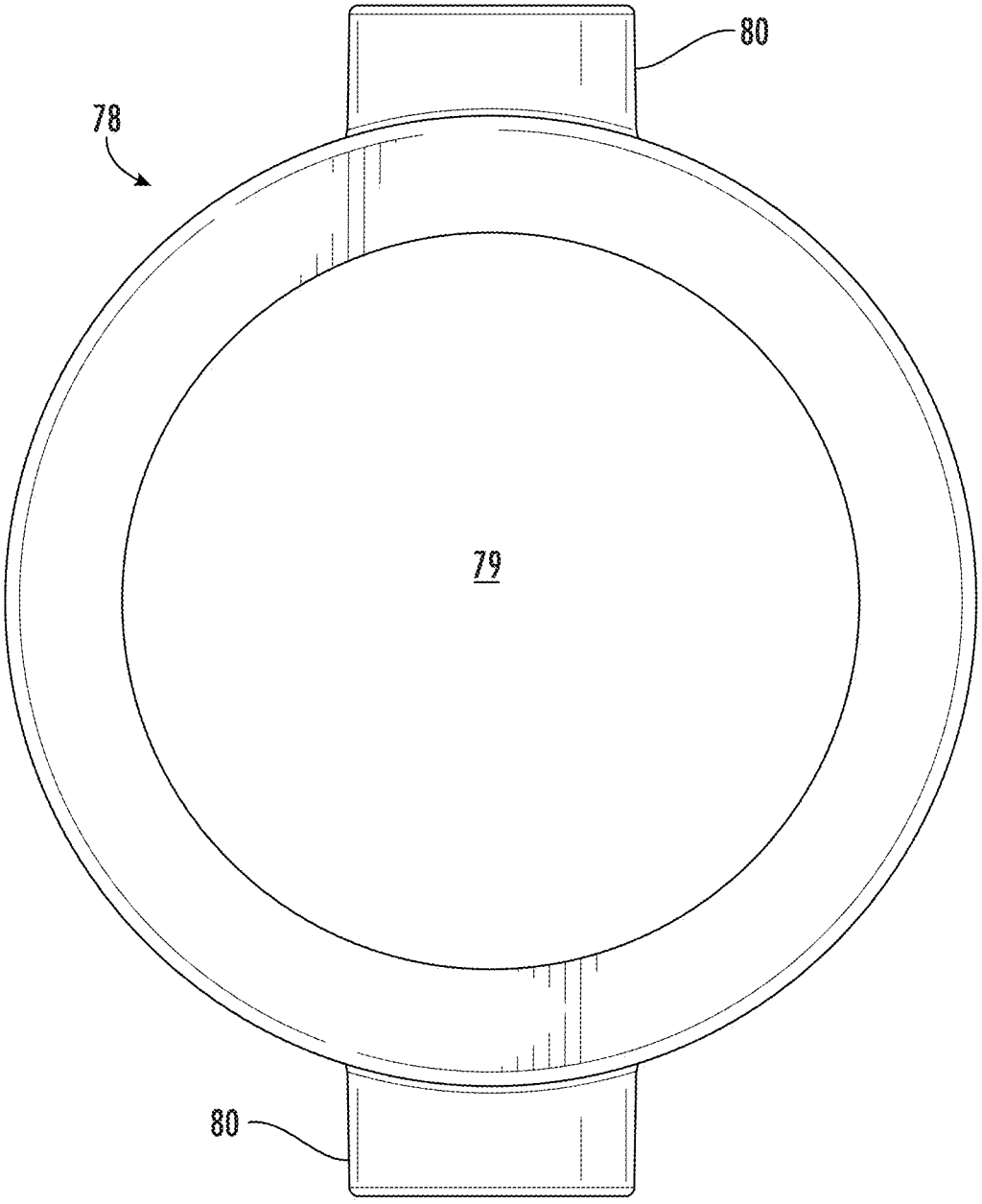

The cover assembly 14 further includes the covering 52 as shown in FIGS. 1, 2 and 50. The covering 52 includes a base CB that has a cover portion or segment 52A and a cover portion or segment 52B. The cover segment 52A and the cover segment 52B are constructed integrally with one another so as to form the covering 52 as a single sheet as shown in FIG. 50. The covering 52 may include a border member or piping (not shown). The cover segment 52A extends between the arm 50A and the intermediate arm 50M, while the cover segment 52B extends between the intermediate arm 50M and the arm 50B. In addition, the covering 52 is connected to the arm 50A, the intermediate arm 50M, and the arm 50B.

The covering 52 further includes a left front pocket 53L, a right front pocket 53R, and a middle front pocket 53M that are sewn to the bottom surface of the base CB so as to be securely attached thereto. The left front pocket 53L, the right front pocket 53R, and the middle front pocket 53M are made from an elastic fabric material such as spandex so that the pockets can stretch to a degree sufficient to enable attachment of the covering 52 to the arm extensions 50A-E, 50B-E, 50M-E as will be discussed below. In addition, the covering 52 further includes a left rear pocket 54L, a right rear pocket 54R, and a middle rear pocket 54M that are sewn to the bottom surface of the base CB so as to be securely attached thereto. The left rear pocket 54L, the right rear pocket 54R, and the middle rear pocket 54M are made from a nylon or polypropylene strap or webbing material which does not have elastic characteristics and thereby would not be able to meaningfully stretch in comparison to the front pockets 54L, 54R, 54M.

In order to secure the covering 52 to the arm extensions 50A-E, 50B-E, 50M-E, the front pockets 53L, 53M, 53R and the rear pockets 54L, 54M, 54R of the covering are utilized. Specifically, a rear end portion of an arm extension is slid into a cavity defined by a respective rear pocket of the covering 52. Then, a respective front pocket is elastically deformed so as to enable a front end portion of the arm extension to be slid into a cavity defined by the respective front pocket. Thereafter, the front pocket is allowed to return to its relaxed state thereby trapping the arm extension between the rear pocket and the front pocket so as to attach the covering 52 to the arm extension. This process is repeated for the other two arm extensions so as to effectively secure the covering 52 to the arms 50A, 50B, 50M.

A similar process is used to secure the flooring 40 to the leg extensions 38A-E, 38B-E whereby the front pockets 42L, 42R, the rear pockets 43L, 43R, and the lateral sleeves 41L, 41R of the flooring are utilized. Specifically, a rear end portion of a leg extension is slid into a passageway defined by a respective lateral sleeve. Then, the leg extension is advanced until the rear end portion enters a cavity defined by a respective rear pocket of the flooring 40. Then, a respective front pocket is elastically deformed so as to enable a front end portion of the leg extension to be slid into a cavity defined by the respective front pocket. Thereafter, the front pocket is allowed to return to its relaxed state thereby trapping the leg extension between the rear pocket and the front pocket so as to attach the flooring 40 to the leg extension. This process is repeated for the other leg extension so as to effectively secure the flooring 40 to the legs 38A, 38B.

Alternatively, a plurality of fasteners (not shown), such as screws or rivets, may be used to connect the covering 52 to the arms 50A, 50B, 50M. Similarly, a plurality of fasteners (not shown), such as screws or rivets, may alternatively be used to connect the flooring 40 to the legs 38A, 38B. In any event, the same manner of securing the covering 52 to the arms 50A, 50B, may be used to secure the flooring 40 to the legs 38A, 38B.

The covering 52 is made from a fabric material. As one example, the covering is made from a 70 Denier Nylon Ripstop with Urethane Coat material that is treated for water resistance and flame resistance. The covering 52 may be made from the same material that is used to make the walls and ceilings of commercially available tents.

The covering 52 is configured to be moved between its expanded configuration as shown in FIGS. 1-8 and its collapsed configuration as schematically shown in FIG. 73A. It should be appreciated that the covering 52 is positioned in its expanded configuration when the portable barrier is positioned in its protection mode of operation as shown in FIGS. 1-8, while the covering 52 is positioned in its collapsed configuration when the portable barrier is positioned in its storage mode of operation as shown in FIG. 73A.

It should be appreciated that the covering is positioned in its collapsed configuration when the portable barrier 10 is positioned in the carrier bag 30 as shown in FIG. 10. To provide further understanding of the configuration of the covering when it is positioned in its collapsed configuration, reference is made to FIG. 13 of the '365 Patent which shows its portable barrier 10 positioned in its storage position in which its covering is positioned in a collapsed configuration.

The arm struts 50A-S, 50B-S, 50M-S are pivotally connected to the junction assembly 16 in the same manner as the connection of the leg struts 38A-S, 38B-S to the junction assembly 16. In particular, the arm struts 50A-S, 50B-S, 50M-S are each pivotably connected to the junction assembly 16 with the use of pivot members 20. In particular, the end portions of each of the arm struts 50A-S, 50B-S, 50M-S are attached to a respective pivot member 20 by use of an adhesive. More specifically, the end portions of each of the arm struts 50A-S, 50B-S, 50M-S are inserted in the blind bores 21 of their respective pivot members 20 and then glued in place. Then, the respective pivot member 20 is secured between appropriate disc-like components as shown in FIGS. 11-12, and thereafter a respective screw 18 is advanced through the passageway 22 of the respective pivot member 20 so as to pivotably retain the pivot member 20 in relation to the disc-like components 17A, 17B, 17C.

It should be appreciated that the actuator component 51 is pivotally connected to the junction assembly 16 in the same manner as the connection of the leg struts 38A-S, 38B-S to the junction assembly 16, and in the same manner as the connection of the arm struts 50A-S, 50B-S, to the junction assembly.

During movement of the portable barrier 10 from its protection mode (see FIGS. 1-8) to its storage mode (see FIGS. 73, 73A), the arm struts 50B-S, 50M-S pivot about their axis defined by its respective screw 18 as shown in FIGS. 11-12. Pivoting of the arm struts 50B-S, 50M-S cause a corresponding pivoting of the arm extensions 50B-E, 50M-E. Note that during movement of the portable barrier 10 from its protection mode (see FIGS. 1-8) to its storage mode (see FIGS. 73, 73A), the arm strut 50A-S does not pivot about the axis defined by its respective screw 18 as shown in FIGS. 11-12, but rather it is held in fixed relation to the junction assembly by use of the strut support 24 of the disc component 17A (see FIGS. 13-17 and FIG. 11).

It should be appreciated that the covering 52 is attached to the arm extensions 50A-E, 50M-E so that (i) the extent of movement or distance between the arm extension 50A-E and arm extension 50M-E is limited by the covering 52, and (ii) the extent of movement or distance between the arm extension 50M-E and arm extension 50B-E is also limited by the covering 52. More specifically, the arm extension 50A-E is allowed to move in relation to the arm extension 50M-E from a collapsed configuration of the cover assembly 12 shown in FIGS. 73, 73A to an expanded configuration of the cover assembly shown in FIGS. 1-8 (and 41-48) in which the arm extensions 50A-E, 50M-E are separated by a maximum distance shown in FIGS. 1-8. Similarly, the arm extension 50B-E is allowed to move in relation to the arm extension 50M-E from a collapsed configuration of the cover assembly 12 shown in FIGS. 73, 73A to an expanded configuration of the cover assembly shown in FIGS. 1-8 in which the arm extensions 50M-E are separated by a maximum distance shown in FIGS. 1-8 (and 41-48).

Hinge Components 70 and Hinge Adapters 78

As best seen in FIGS. 34-40, the portable barrier 10 possesses five hinge components 70 which are identical in construction and operation. More detail of the hinge components 70 are shown in FIGS. 51-56. Since all of the hinge components are identical in construction and operation, only one hinge component 70 will be described in detail. In particular, the hinge component 70 has defined therein a blind bore 72 configured to receive therein the end portion of a respective leg strut 38A-S, 38B-S, or arm strut 50A-S, 50B-S or 50M-S. It should be appreciated that each of the following components are secured to a respective hinge component by inserting an end portion of the component into the respective blind bore 72 and applying an adhesive between the component end portion and the hinge component 70: leg struts 38A-S, 38B-S and arm struts 50A-S, 50B-S, 50M-S. Glue channels are provided in the hinge component structure that defines the blind bore 72 in order to facilitate the application of glue.

The hinge component 70 further includes a pair of arms 74 that defines a channel 76 therebetween. Each of the arms 74 has an aperture 75 defined therein. The apertures 75 are configured to respectively receive studs of a hinge adapter 78 therein so as to allow the hinge adapter 78 to be secured to the hinge component 70, yet allow the hinge adapter 78 to freely pivot within the channel 76 as will be described below.

Figure 60:
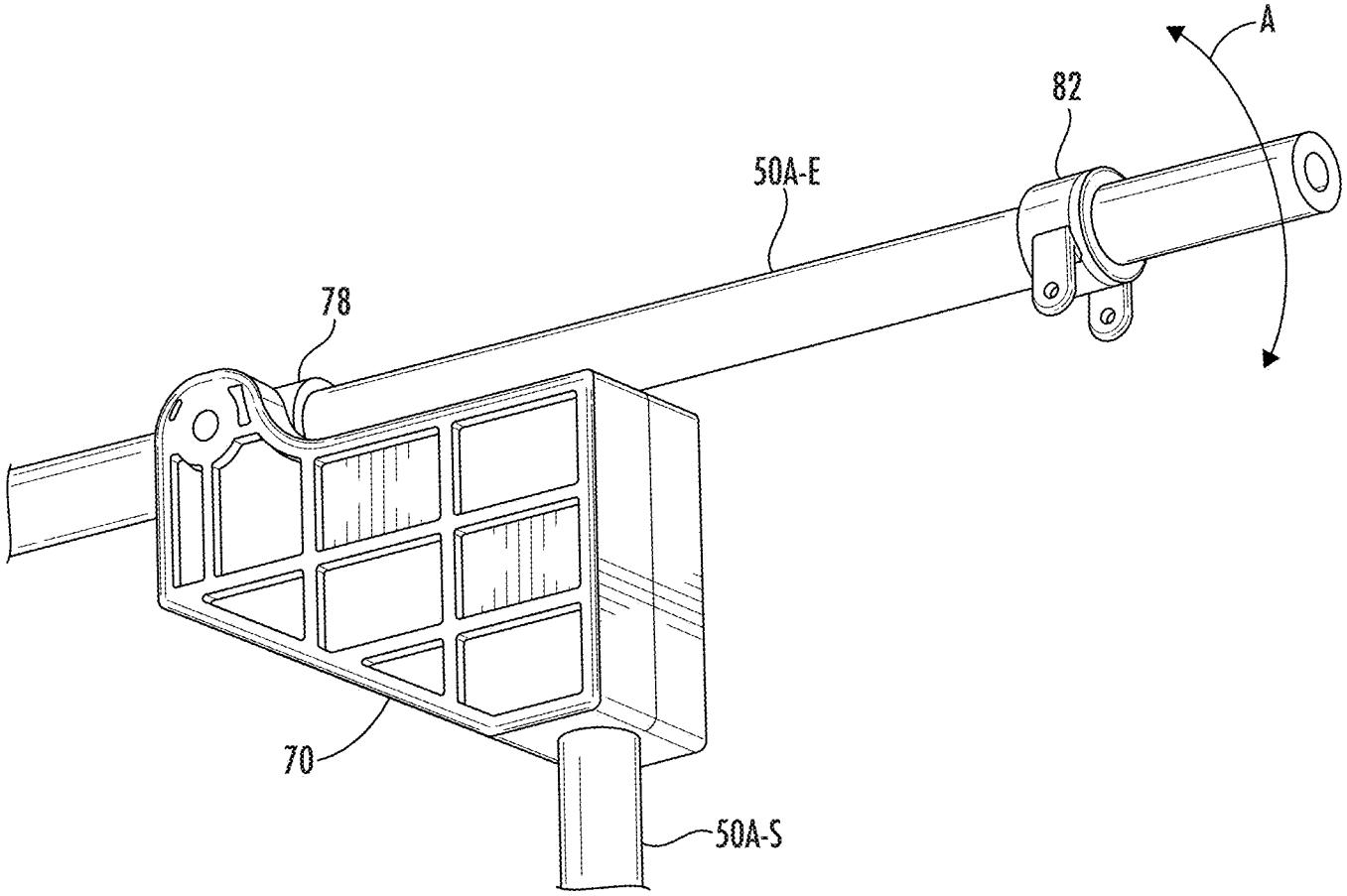
FIG. 60 is a fragmentary perspective view of a portion of the portable barrier of FIGS. 1-8, showing one of its hinge joints, and in particular one of the hinge components connecting one of the arm struts to one of the arm extensions via its respective hinge component and hinge adapter so that the arm extension is pivotably attached to the arm strut.
Figure 61:
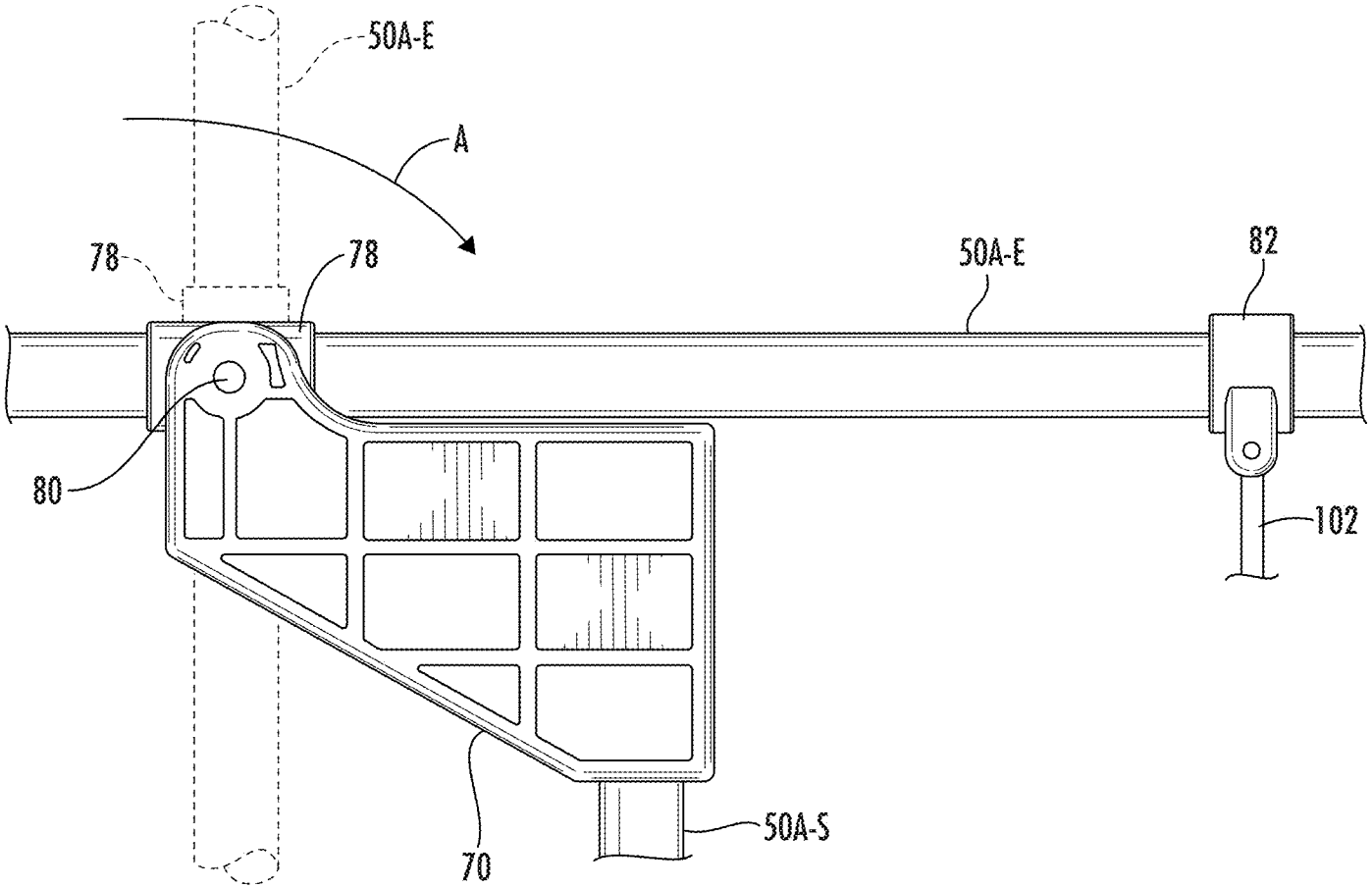
FIG. 61 is a fragmentary elevational view of the portion of the portable barrier shown in FIG. 60.

As best seen in FIGS. 57-61, the portable barrier 10 further possesses five hinge adapters 78 which are identical in construction and operation. Since all of the hinge adapters are identical in construction and operation, only one hinge adapter 78 will be described in detail. In particular, the hinge adapter 78 has defined therein a passageway 79 configured to receive the shaft of a respective leg extension 38A-E, 38B-E or arm extension 50A-E, 50B-E, 50M-E. Each of these extensions is secured in fixed relation to a respective hinge adapter 78 by gluing. As an example, FIGS. 60-61 show the arm extension 50A-E secured in fixed relation to a respective hinge adapter 78 after gluing.

As alluded to above, the hinge adapter 78 also includes a pair of studs 80 that are configured to be received in the apertures 75 defined by the arms 74 of the hinge component 70. The studs 80 and the apertures 79 are sized and configured to secure the hinge adapter 78 to the hinge component 70, yet allow the hinge adapter 78 to freely pivot in relation to the hinge component 70 within the channel 74.

FIGS. 60-61 show the arm extension 50A-E coupled to the hinge component 70 via the hinge adapter 78 so as to be pivotable in relation to the hinge component 70 about the axis defined by the pair of studs 80. Indeed, the arm extension 50A-E is pivotable from its position shown in phantom in FIG. 61 to it its position shown in solid in FIG. 61. It should be appreciated that when the portable barrier 10 is positioned in its storage mode of operation (see FIGS. 10, 73, 73A), the arm extension 50A-E is located at its position relative to the hinge component 70 as shown in phantom in FIG. 61. On the other hand, when the portable barrier 10 is positioned in its protection mode of operation (see FIGS. 1-8), the arm extension 50A-E is located at its position relative to the hinge component 70 as shown in solid in FIG. 61. While FIGS. 60-61 show the pivoting relationship between the arm extension 50A-E and its respective hinge component 70, it should be appreciated that all of the leg extensions 38A-E, 38B-E and arm extensions 50A-E, 50M-E are pivotably coupled in relation to its respective hinge component 70 in a similar manner.

In view of the above description of the hinge components 70 and the hinge adapters 78, it should be appreciated that the portable barrier 10 includes a number of hinge joints. In particular, (i) the leg 38A includes a hinge joint, and the leg extension 38A-E is configured to pivot with respect to the leg strut 38-S via this hinge joint, (ii) the leg 38B further includes a hinge joint, and the leg extension 38B-E is configured to pivot with respect to the leg strut 38B-E via this hinge joint, (iii) the arm 50A includes a hinge joint, and the arm extension 50A-E is configured to pivot with respect to the arm strut 50A-S via this hinge joint, (iv) the arm 50B further includes a hinge joint, and the arm extension 50B-E is configured to pivot with respect to the arm strut 50B-S via this hinge joint, and (v) the arm 50M further includes a hinge joint, and the arm extension 50M-E is configured to pivot with respect to the arm strut 50M-S via this hinge joint.

Panel Holders 82

Figure 67:
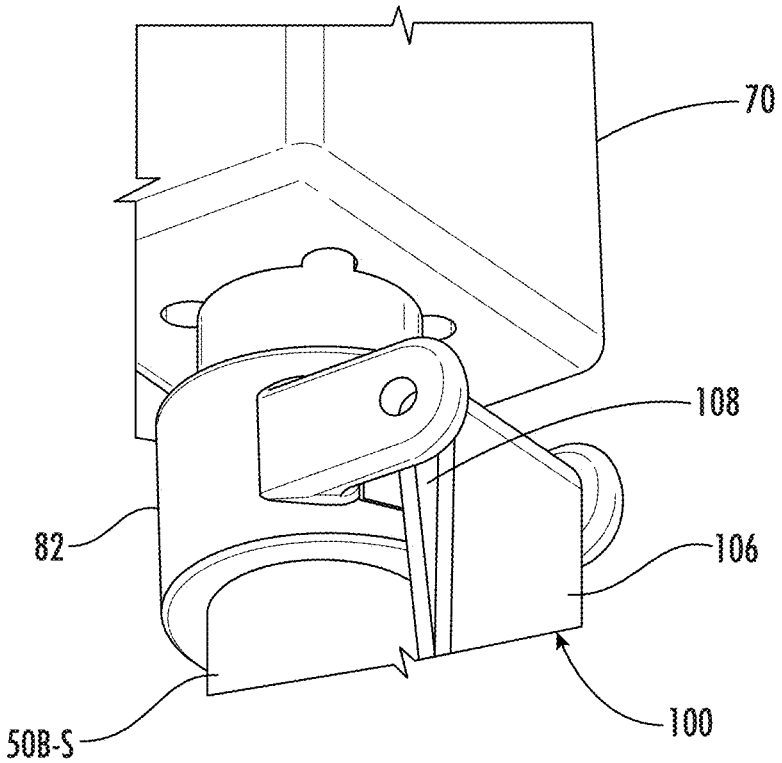
FIG. 67 is an enlarged perspective view of a portion of the portable barrier of FIGS. 1-8, showing an upper part of the right arm strut secured in fixed relation to its respective hinge component, and also showing a respective panel holder secured in fixed relation to the upper part of the right arm strut.
Figure 68:
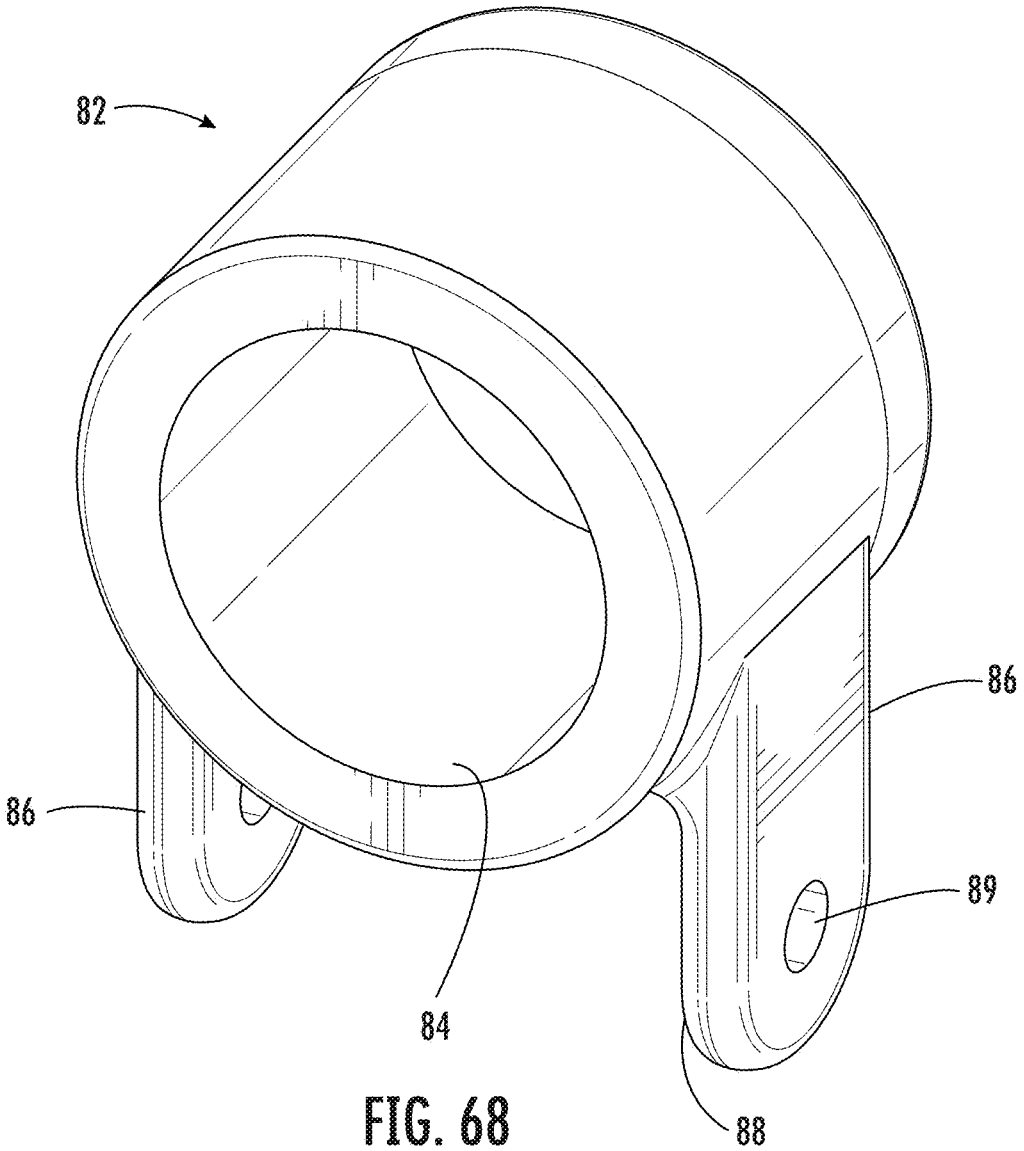
FIGS. 68-70 show various views of the panel holders of the portable barrier of FIGS. 1-8.
Figure 69:
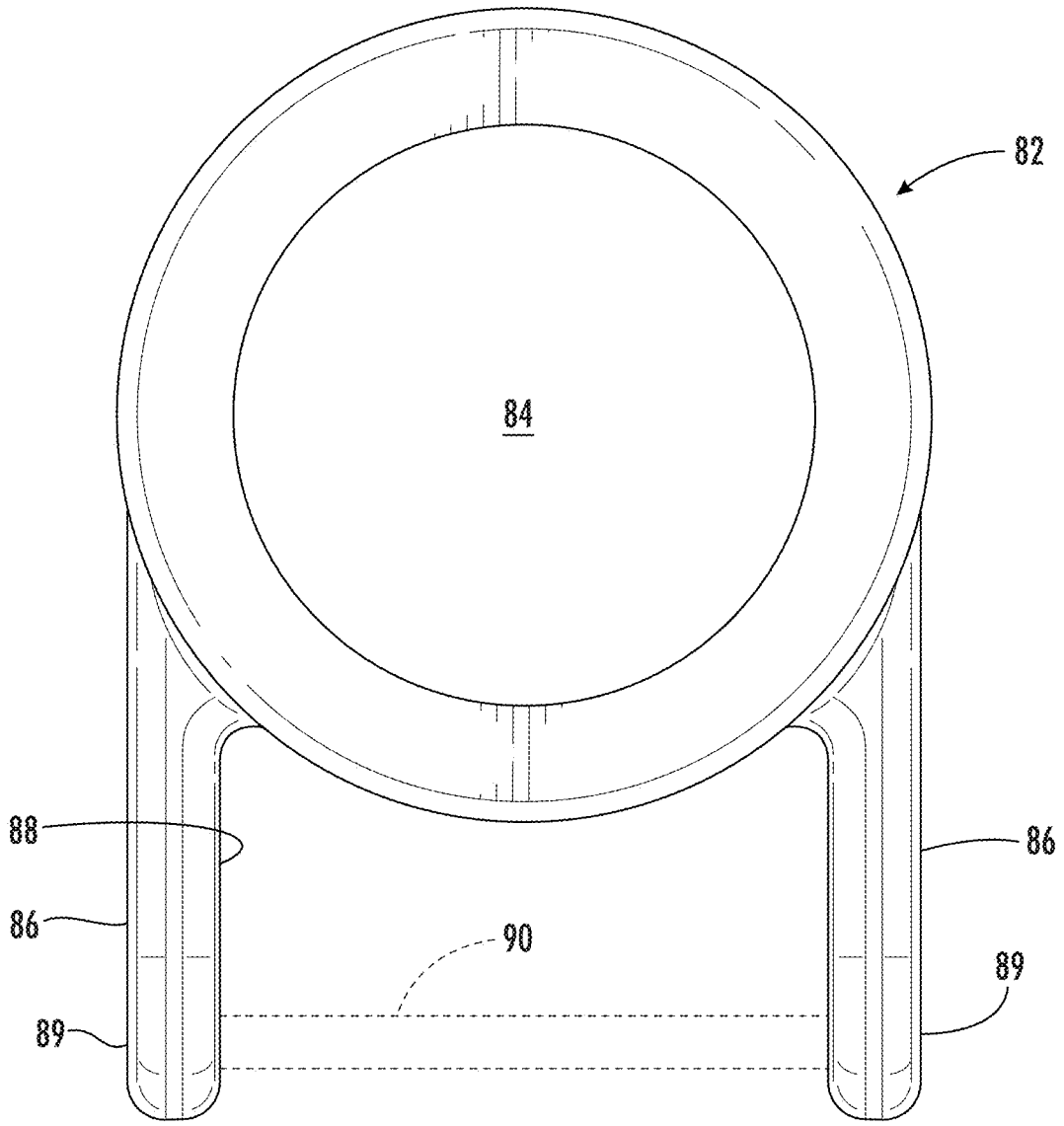
Figure 70:
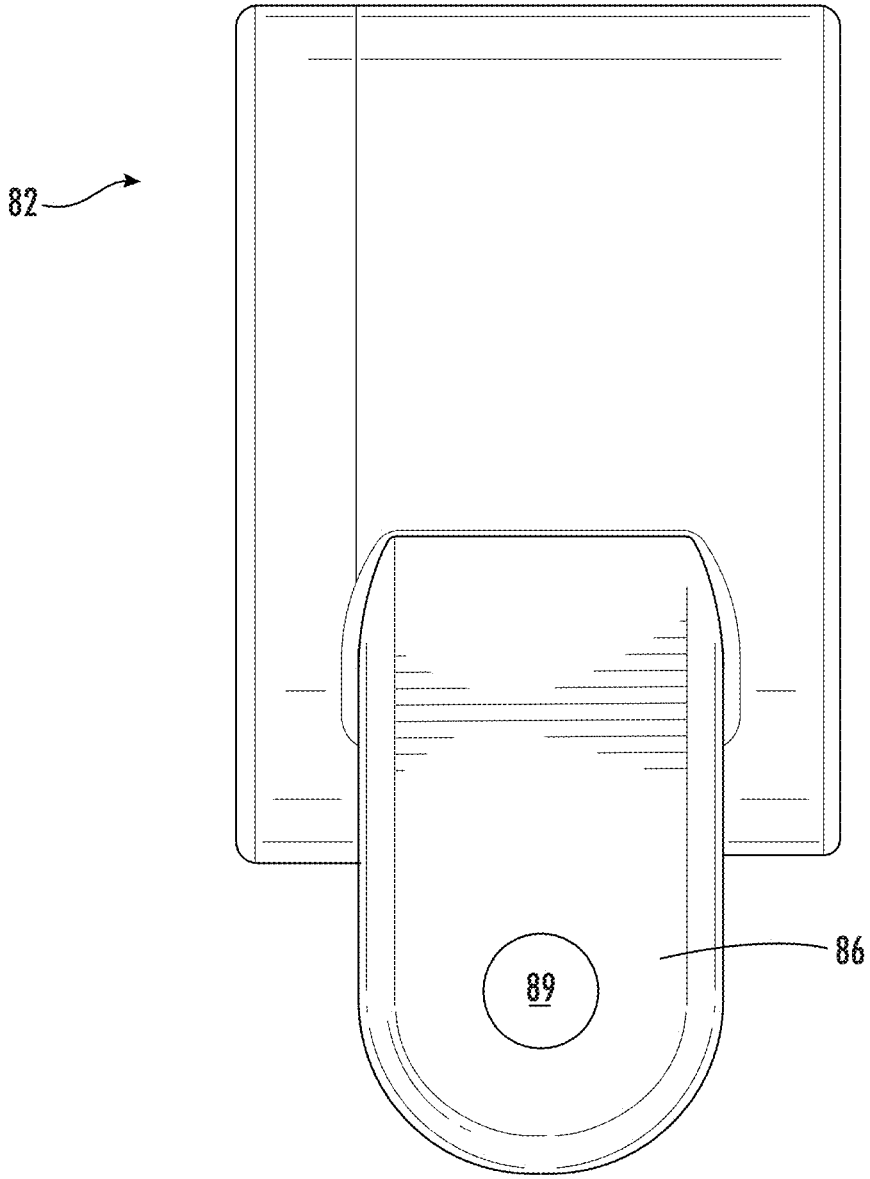

As best seen in FIGS. 66-70, the portable barrier 10 possesses a number of panel holders 82 which are identical in construction and operation. Since all of the panel holders are identical in construction and operation, only one panel holder 82 will be described in detail. In particular, the panel holder 82 defines a passageway 84 to receive the shaft of a respective leg strut 38A-S, arm strut 50A-S, 50B-S, or actuator component 51. (See FIGS. 68-70.) Each panel holder is secured in fixed relation to each of these extensions and actuator component by gluing. As an example, FIG. 66 shows a respective panel holder 82 secured in fixed relation to the actuator component 51 after it is glued thereto. As another example, FIG. 67 shows a respective panel holder 82 secured in fixed relation to the arm strut 50B-S after it is glued thereto. It should be appreciated that each of the following components are secured to a respective panel holder 82 by advancing part of its shaft therethrough and applying an adhesive between the component end portion and the panel holder: leg struts 38A-S, arm struts 50A-S, 50B-S, and actuator component 51.

The panel holder 82 further includes a pair of arms 86 that defines a channel 88 therebetween. Each of the arms 86 has an aperture 89 defined therein. The apertures 89 are configured to respectively receive the ends of a pin 90 therein in a friction fit manner so as to allow the pin 90 to be secured in fixed relation to the panel holder 82. The pin 90 is used to secure a loop of strap or webbing to be coupled to the panel holder 82 as will be described in further detail below. Note that FIG. 66 shows a respective pin 90 partially advanced to its operational position for clarity of understanding. Also note that every panel holder 82 will have an associated pin 90 with it to secure an associated loop of strap or webbing in fixed relation to the respective panel holder 82.

Tensioner 100

Figure 71:
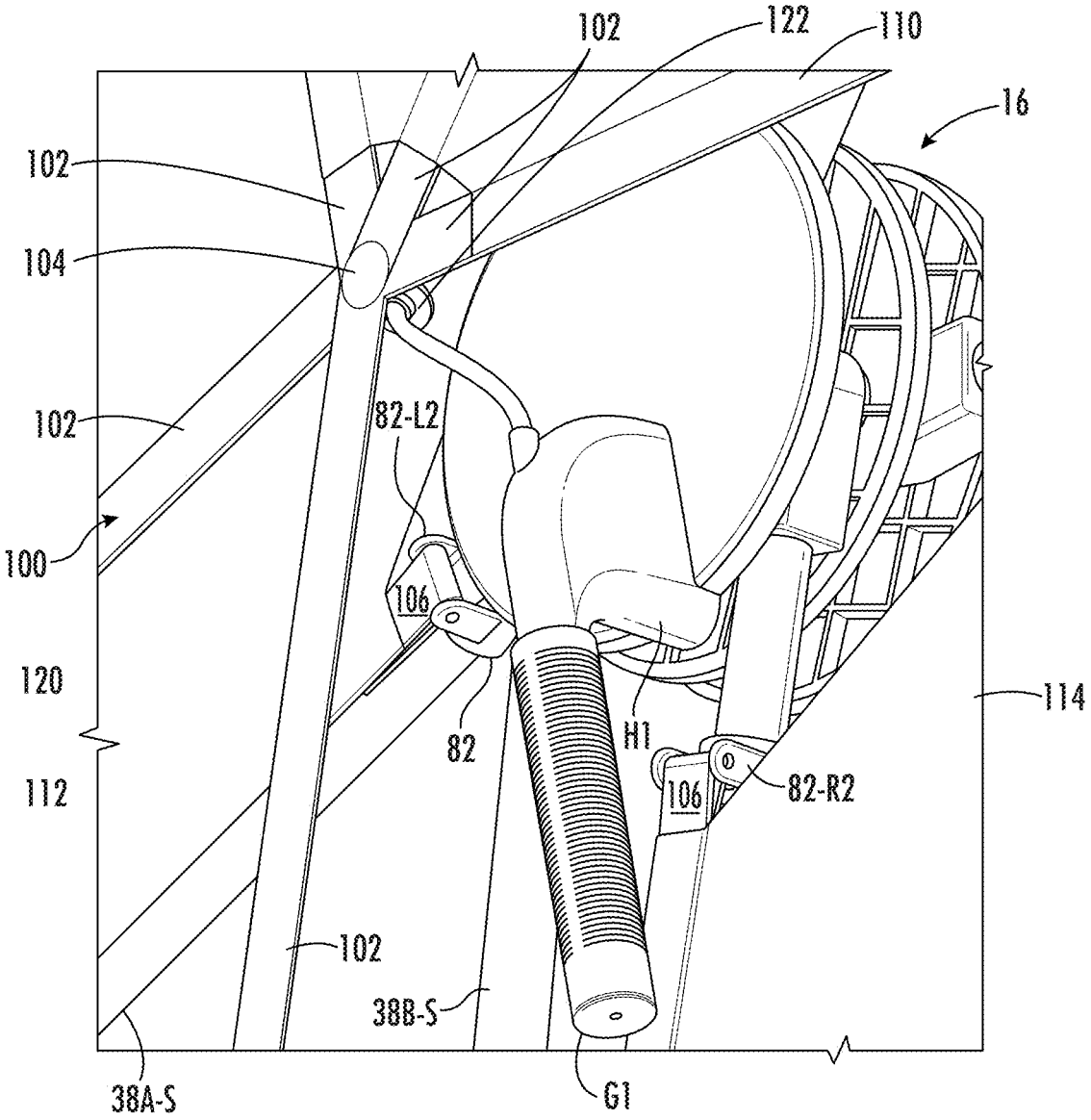
FIG. 71 shows an enlarged perspective view of a portion of the portable barrier of FIGS. 1-8, showing the elastic cord that flexibly attaches the junction assembly to the tensioner.
Figure 72:
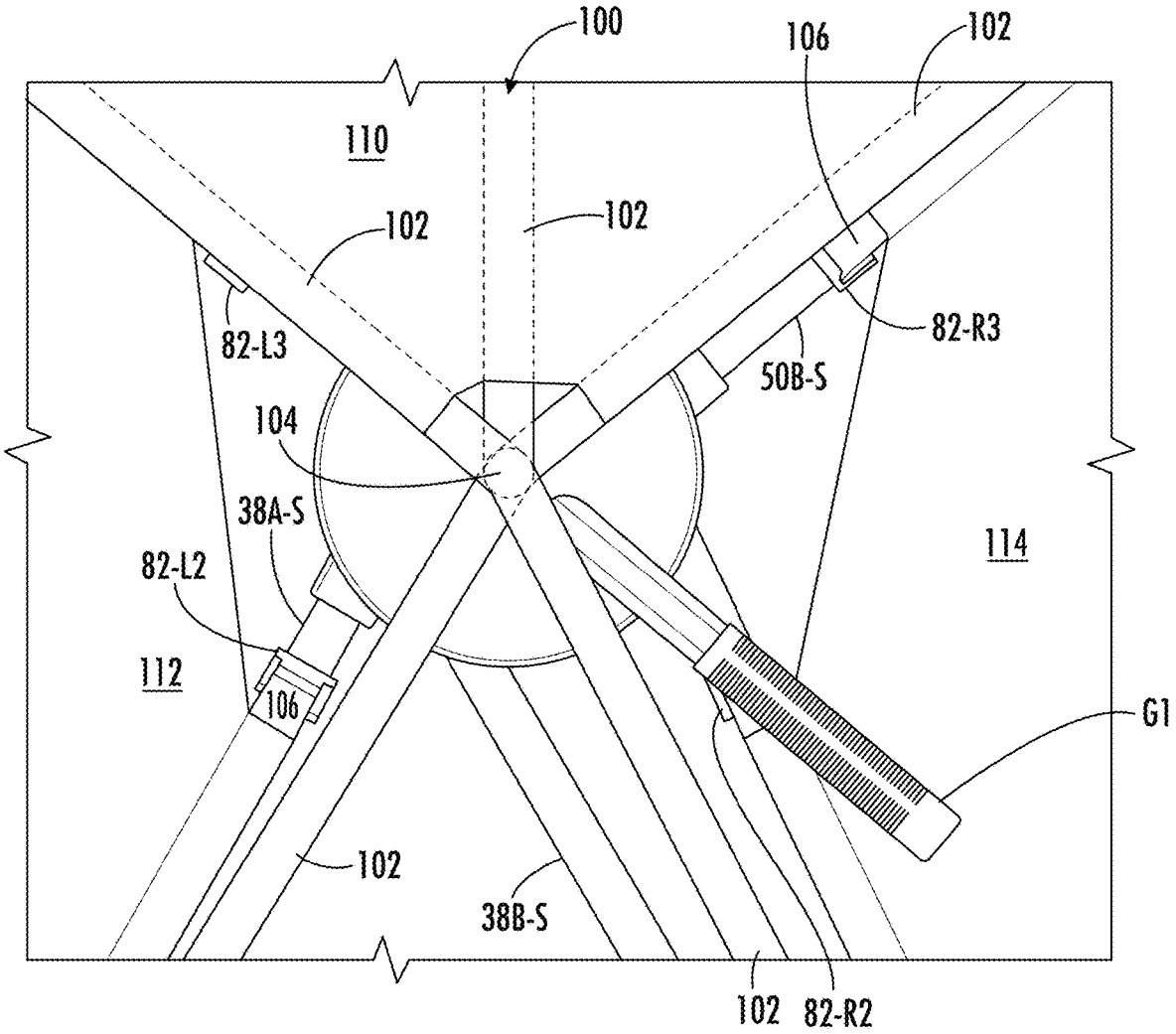
FIG. 72 shows a rear elevational view of approximately the same region of the portable barrier of FIGS. 1-8 that is shown in FIG. 71, but showing the elastic cord removed for clarity of description.

The portable barrier 10 further includes a tensioner 100 as best shown in FIGS. 1, 3, 41-48, 73B, and 81-82. The tensioner 100 includes five tension lines 102 that each extend outwardly in different directions from a central connection location 104. All five tension lines 102 are commonly connected to each other at the central connection location 104 by sewing as shown in FIGS. 71-72. Each of the tension lines 102 is made from a segment of strap or webbing material such as a 1" wide polypropylene webbing. Alternatively, each of the tension lines may be made from a segment of rope or tent cord. The five tension lines 102 may have differing lengths in comparison to each other. Alternatively, the five tension lines 102 may possess the same length in relation to each other.

Each of the five tension lines 102 includes an attachment loop 106 as shown in FIG. 67. The attachment loop 106 is created by folding over an end segment of the tension line back upon itself and sewing it to an adjacent part of the tension line. The attachment loop 106 defines a passageway 108 as also shown in FIG. 67. All the attachment loops 106 of the tension lines 102 are constructed in the same manner and possess the same structural configuration as each other.

The tension lines 102 are respectively attached to the pole structures, namely, the leg extensions 38A-E, 38B-E and the arm extensions 50A-E, 50B-E, 50M-E in the same manner. Specifically, the panel holders 82 are respectively fixedly secured to the pole structures with glue at the locations shown in FIGS. 35-37 and 39-40 (see also FIGS. 42-45 and 47-48). In order to attach the tension lines 102 to their respective pole structures, the attachment loop 106 is advanced into the channel 88 of the panel holder 82 so that the passageway 108 is aligned with the pair of apertures 89. Then, the pin 90 is advanced through a first aperture 89 of the aperture pair, and then the passageway 108 of the attachment loop, and finally into the second aperture 89 of the aperture pair so as to secure the attachment loop 106 to the panel holder 82. In this manner, the pin 90 becomes secured to the panel holder 82 in a friction fit manner so that the attachment loop 106 and thus the tension line 102 becomes fixedly secured to the respective pole structure. It should be appreciated that FIG. 73B shows the attachments loops 106 of the tension lines 102 respectively attached to the panel holders 82 of the leg extensions and arm extensions in a schematic manner.

Figure 80:
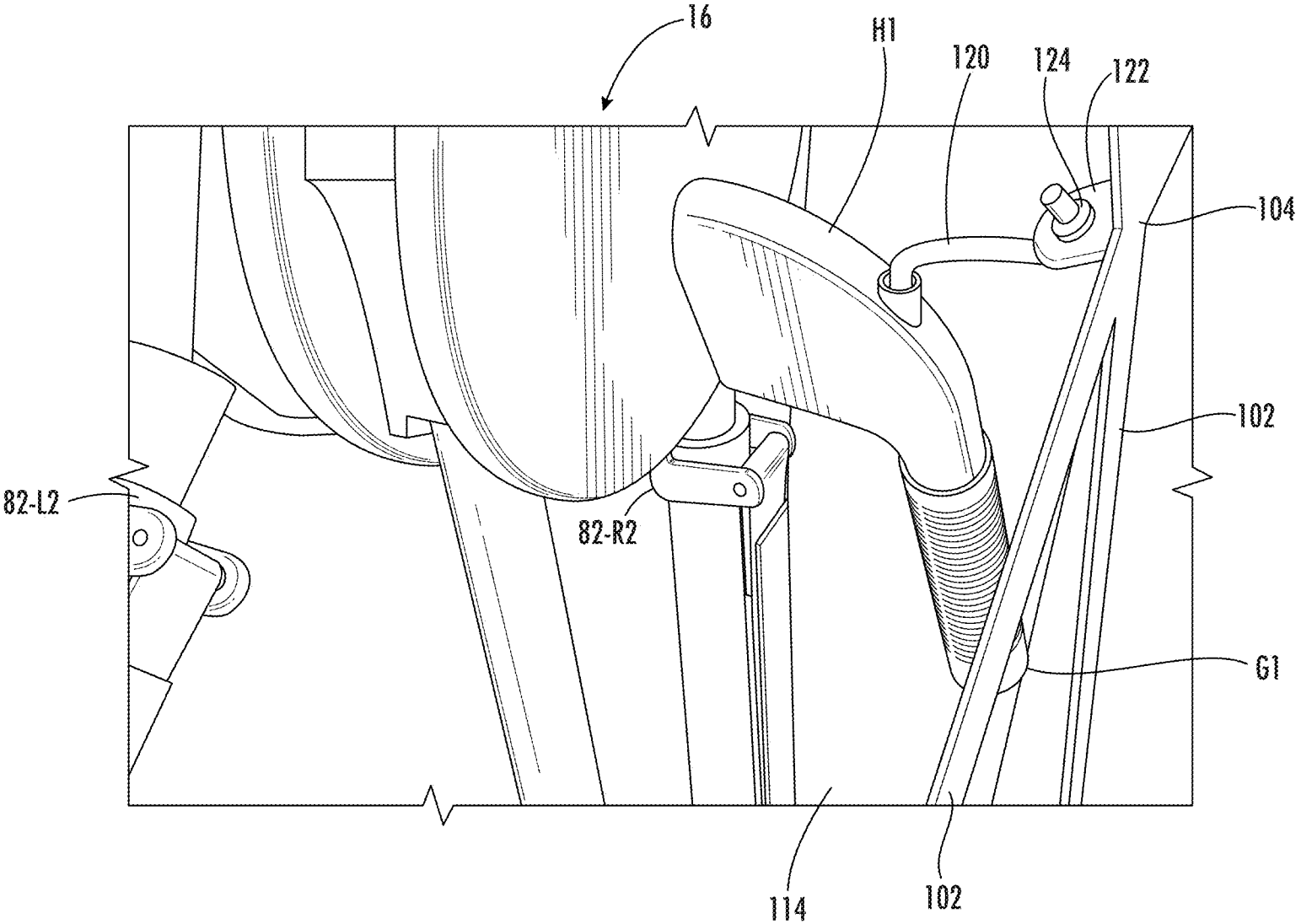
FIG. 80 shows a different perspective view of approximately the same region of the portable barrier of FIGS. 1-8 that is shown in FIG. 71.
Figure 81:
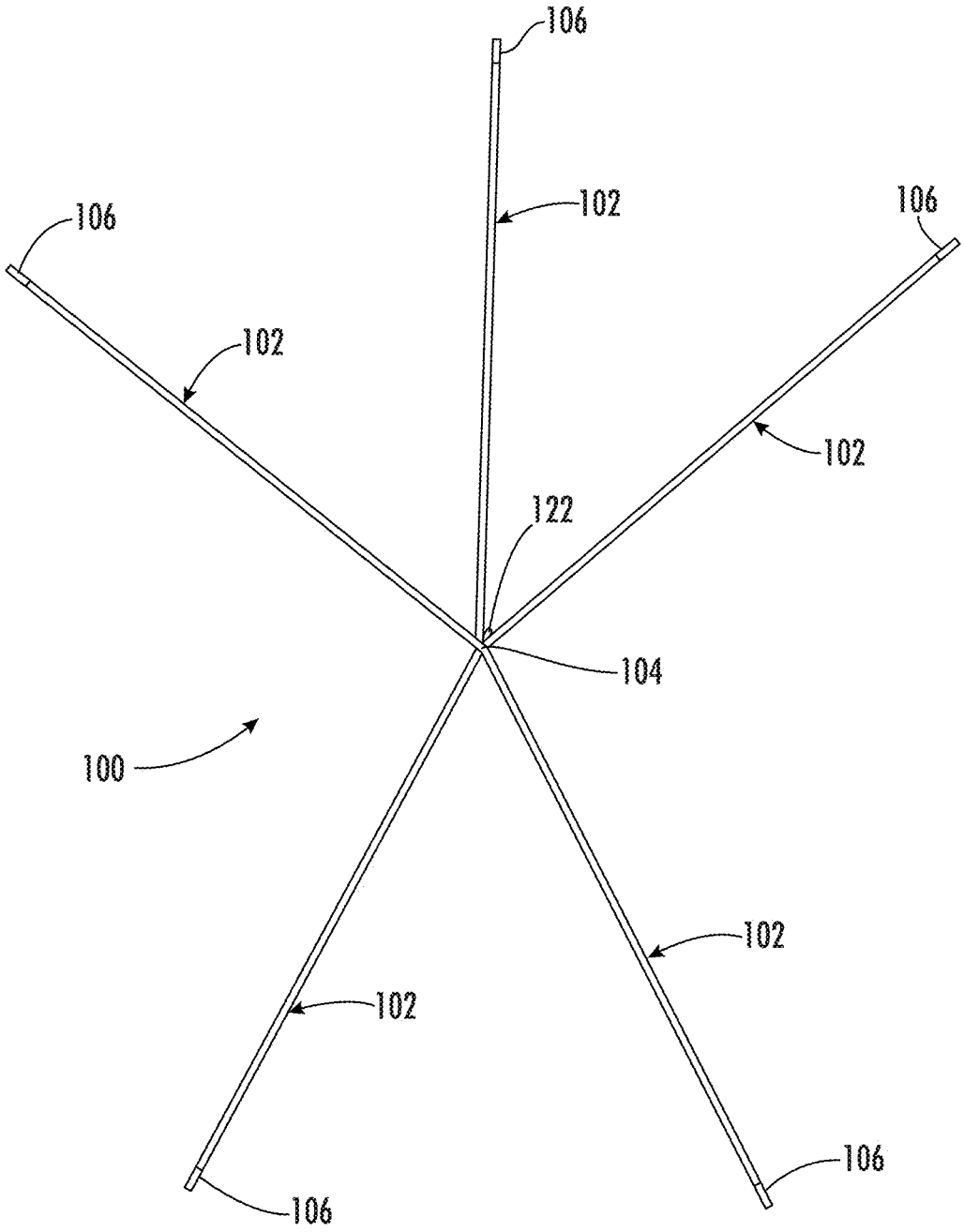
FIG. 81 is an elevational view of the tensioner of the portable barrier of FIGS. 1-8, with the tensioner shown positioned in its expanded configuration.

The tensioner 100 further includes a tensioner tab 122 extending from the tension lines 102 near the connection location 104 on the side of the tensioner 100 that faces the junction assembly 16 as shown in FIGS. 71 and 80. The tensioner tab 122 carries a grommet defining a hole though the tensioner tab 122. The purpose of the tensioner tab 122 will be described below.

Figure 73B:
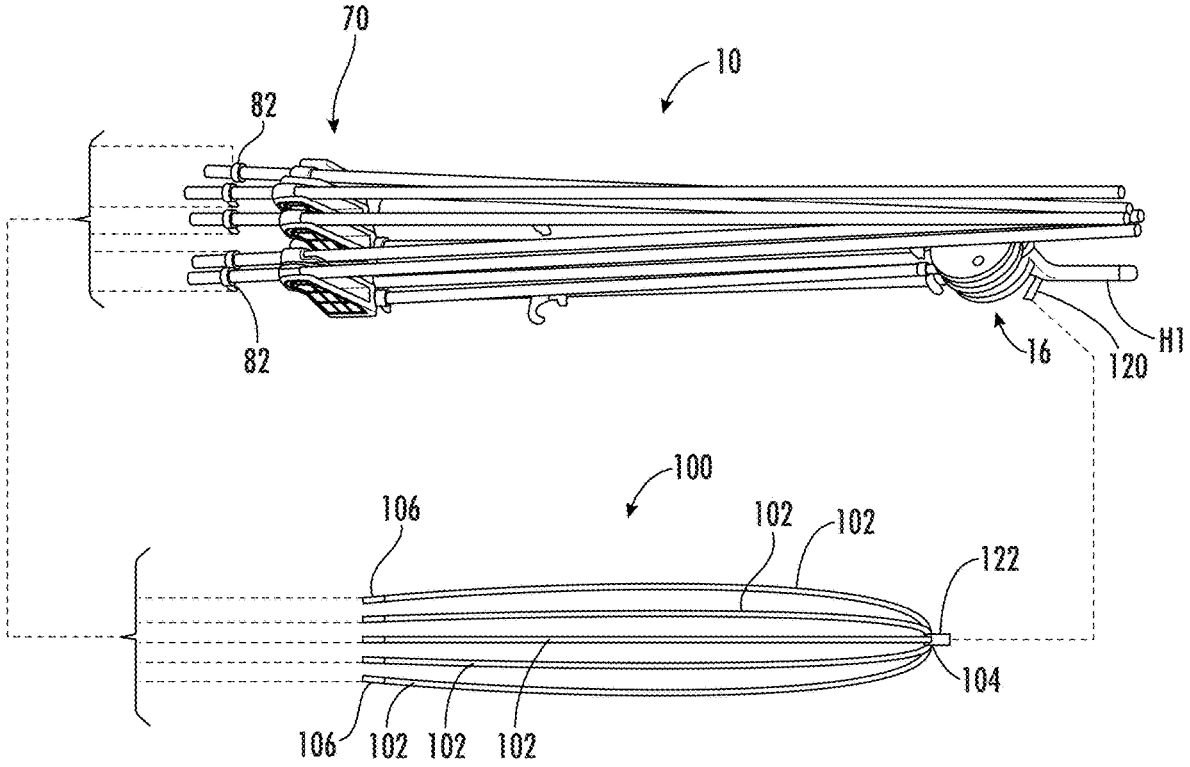
FIG. 73B schematically shows the tensioner coupled to the framework of FIG. 73A, with the tensioner shown positioned in its collapsed configuration.
Figure 82:
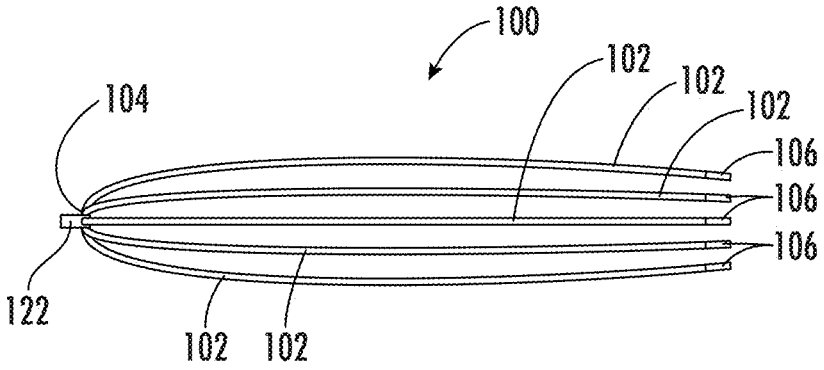
FIG. 82 is an elevational view of the tensioner of the FIG. 81, but with the tensioner shown positioned in its collapsed configuration.
Figure 83:
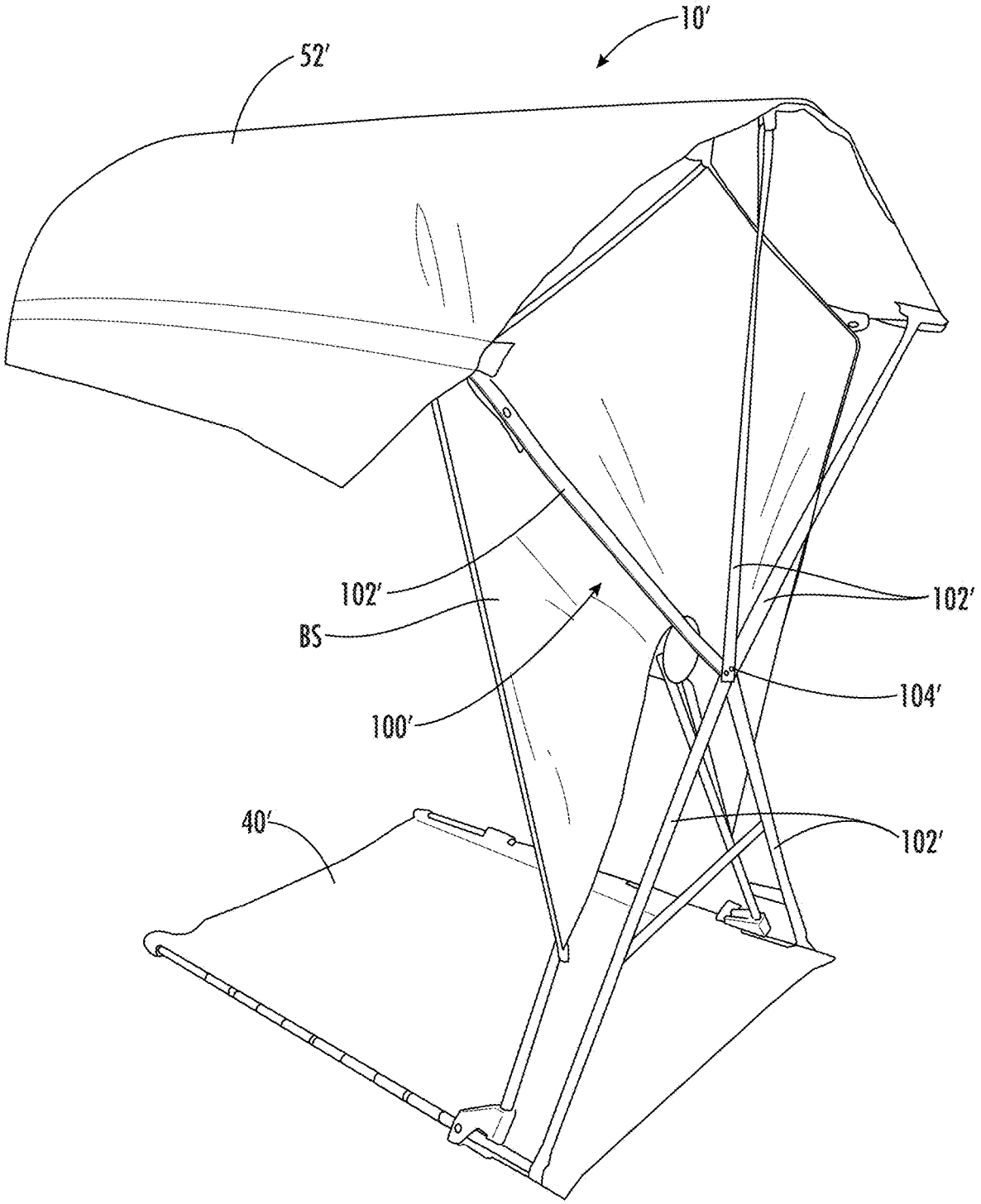
FIGS. 83-86 show various perspective views of an alternative embodiment of a portable barrier of the present disclosure, with the portable barrier shown in its protection mode of operation.
Figure 84:
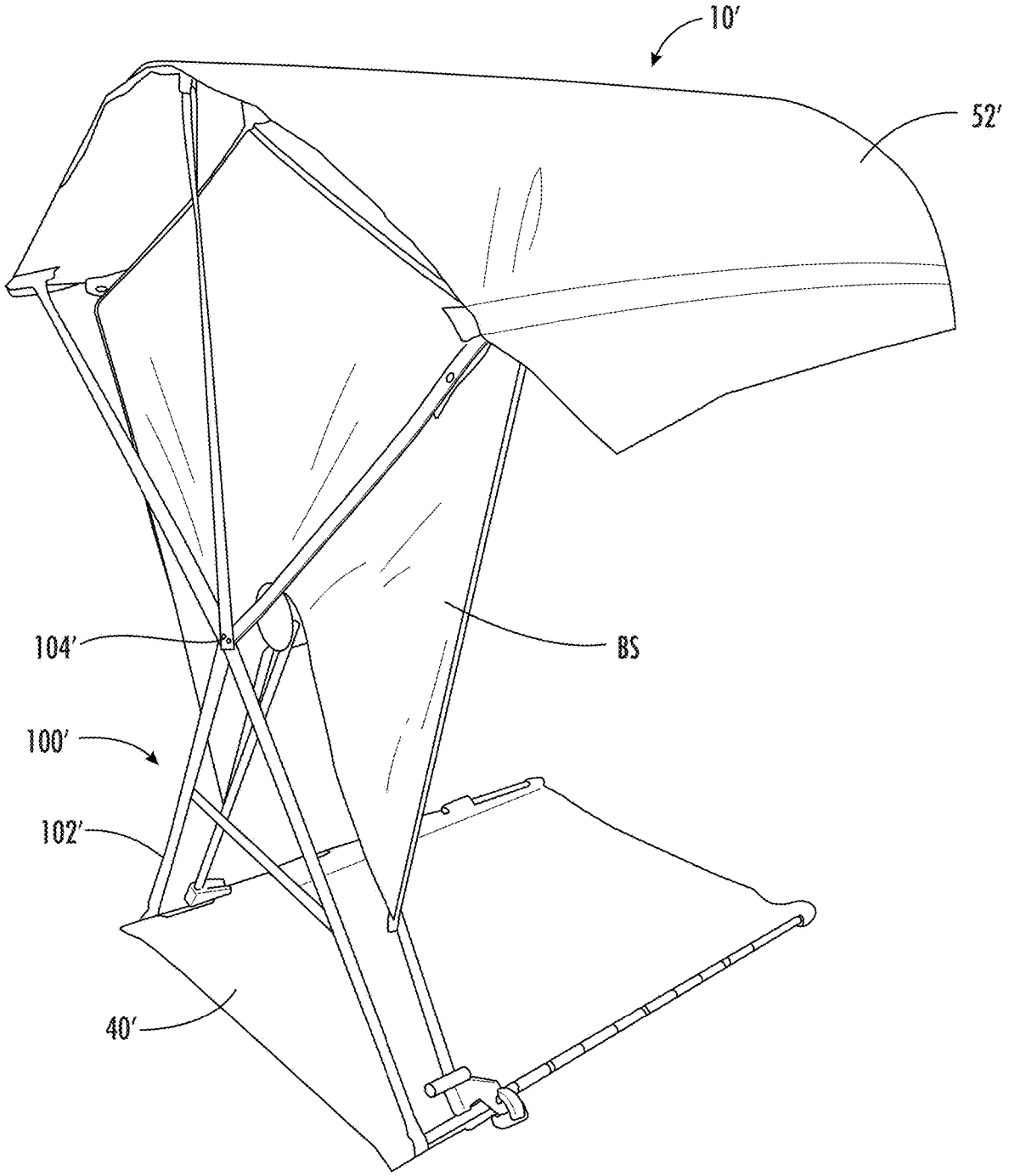
Figure 85:
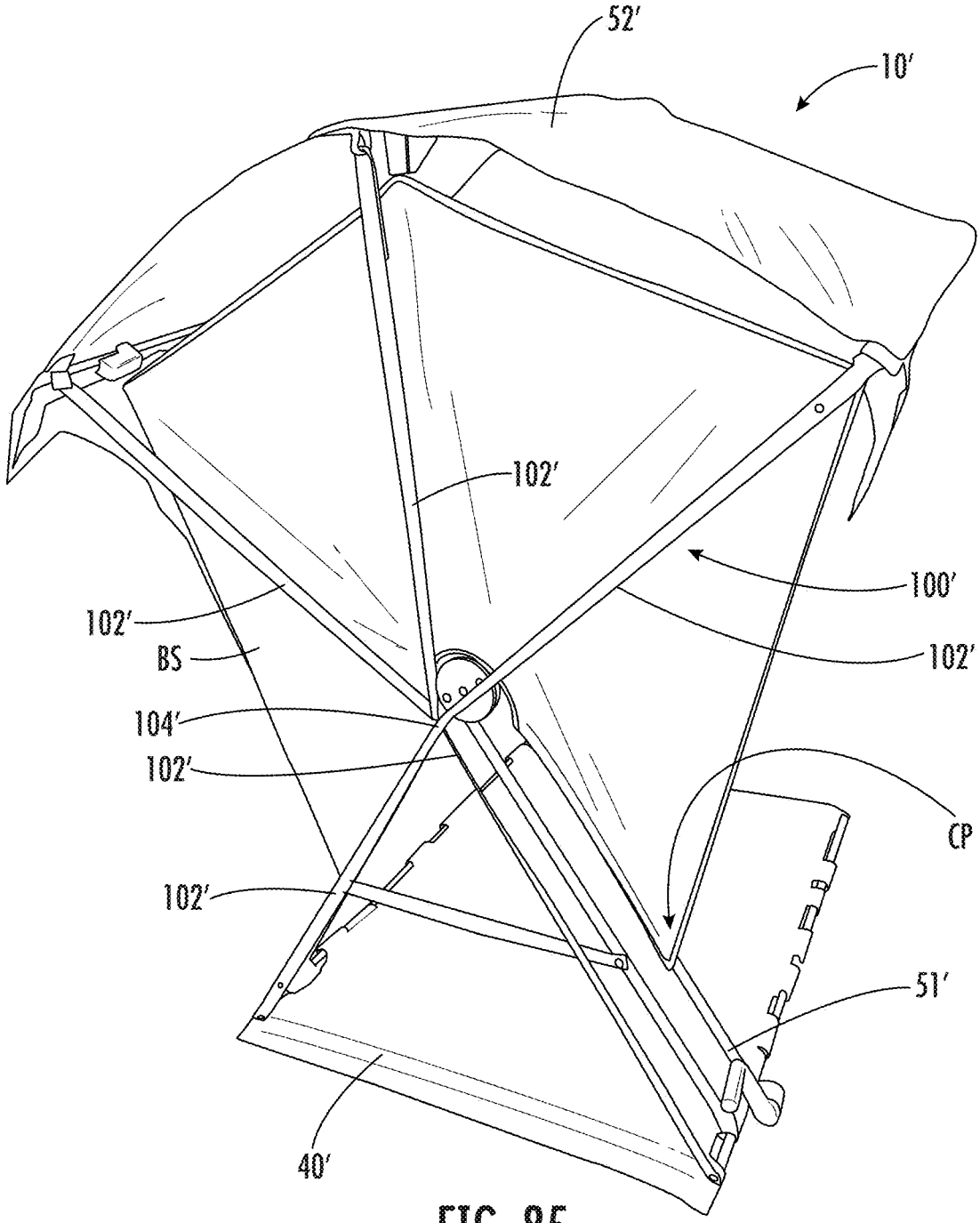
Figure 86:
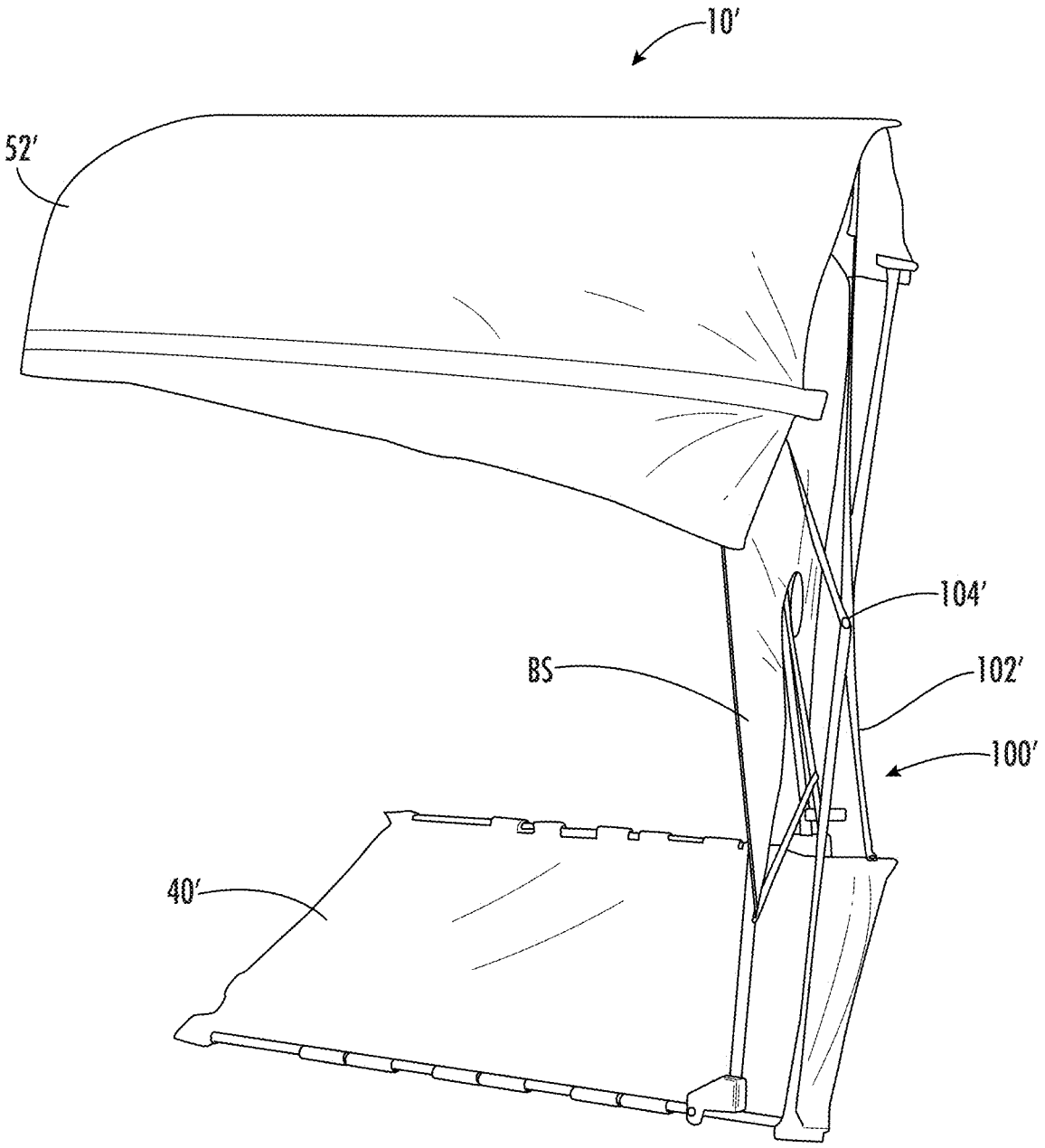

The tensioner 100 is configured to be moved between an expanded configuration as shown in FIGS. 41-48, FIG. 81 (see also FIGS. 1-8) and a collapses configuration as schematically shown in FIG. 73A (see also FIGS. 73B, 82). It should be appreciated that the tensioner 100 is positioned in its expanded configuration when the portable barrier is positioned in its protection mode of operation as shown in FIGS. 1-8 (and FIGS. 41-48), while the tensioner 100 is positioned in its collapsed configuration when the portable barrier is positioned in its storage mode of operation as shown in FIGS. 73A, 73B. It should be appreciated that the tensioner 100 is positioned in its collapsed configuration when the portable barrier 10 is positioned in the carrier bag 30 as shown in FIG. 10.

Figure 43:
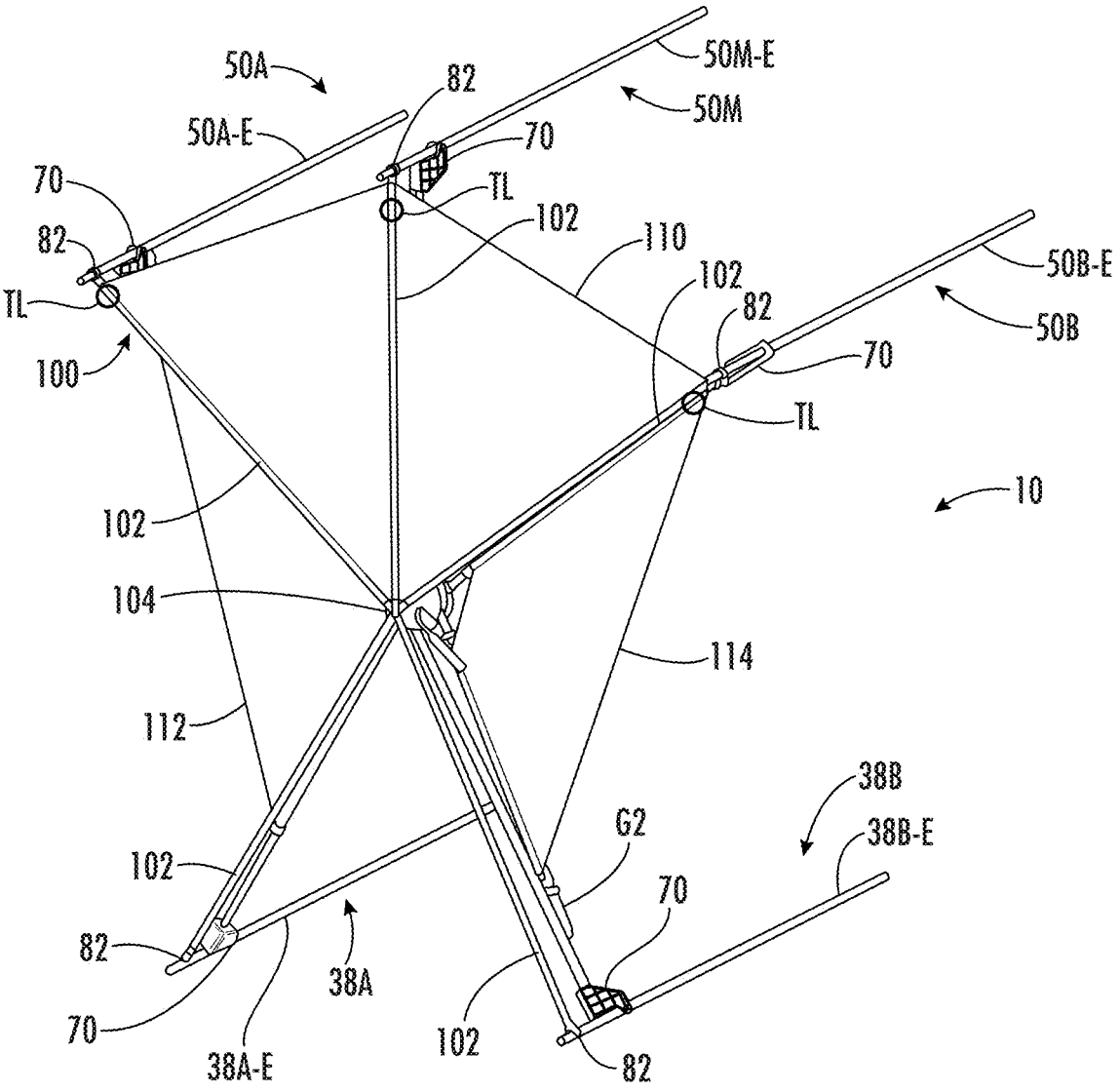
Figure 44:
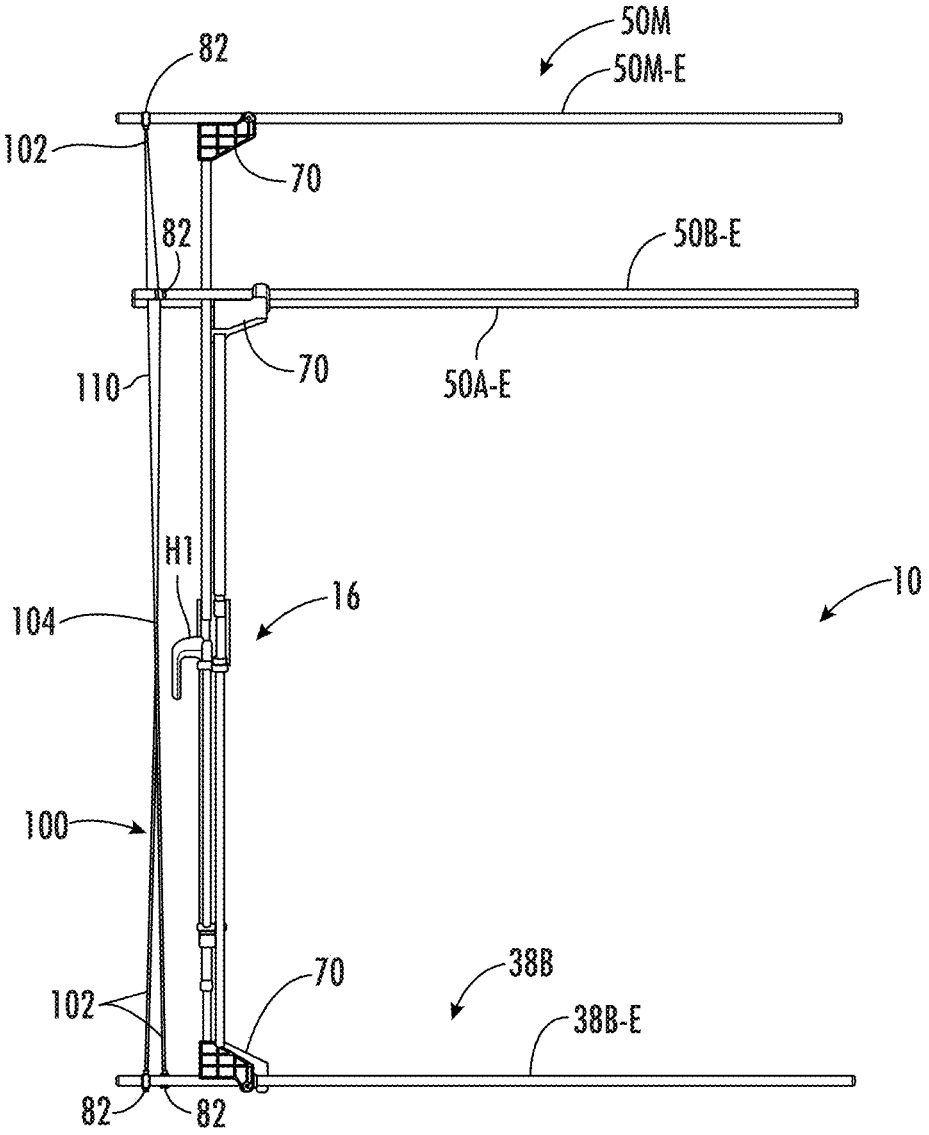
Figure 45:
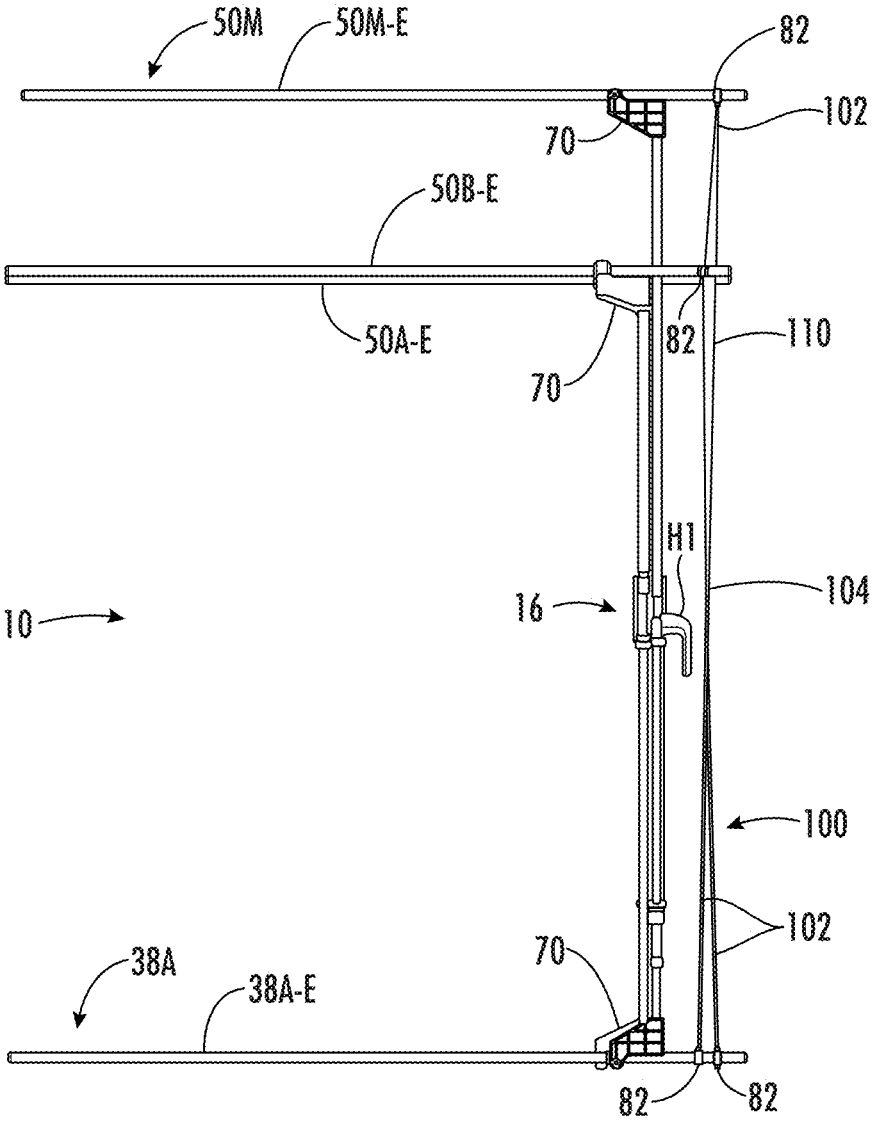

While not necessary to the operation of the portable barrier 10, the tensioner 100 may further include three tether loops TL as shown in FIG. 43 that are attached to the three upper tension lines 102 near the hinges 70 and adjacent to the arm struts 50A-S, 50B-S, 50M-S. Each of the tether loops TL include a segment of ¼" wide strap or webbing material that is formed in a loop and sewn respectively to the three upper tension lines 102. The tether loops TL are each configured to couple to a tether system (not shown) that is used to secure the portable barrier 10 in fixed relation to the ground when wind conditions require fixation to the ground. The tether system (not shown) would include (i) a ground fixation device such as an auger (to be used in turf such as at a soccer field) or a sand bag (to be used on sand such as at a beach), (ii) a snap hook (not shown) configured to releasably attach to the tether loop TL, and (iii) a tether line (not shown) that extends between the ground fixation device and the snap hook.

Further Discussion Regarding Back Screen Panels 110, 112, 114

As mentioned above, the portable barrier 10 includes back screen panels 110, 112, 114 as shown in FIGS. 1, 3, and 41-48. The back screen panel 110 is secured to the tensioner 100. More specifically, the back screen panel 110 is sewn to the upper three tension lines 102 so that the back screen panel 110 is directly supported by the tensioner 100 when the portable barrier is positioned in the protection mode of operation.

Figure 42:
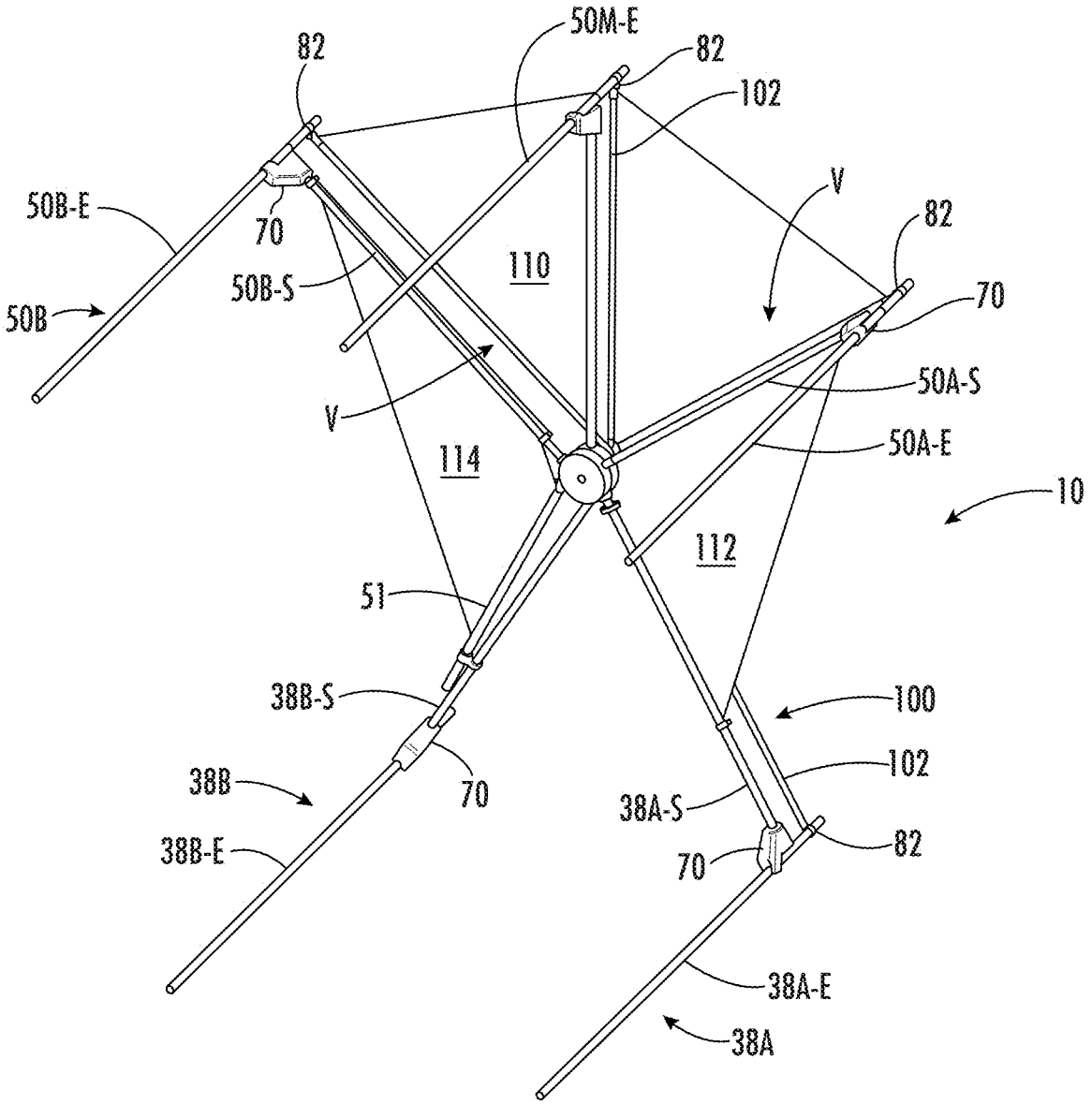

In contrast, the back screen panels 112, 114 are secured to respective pole structures, namely, the leg strut 38A-S, the arm strut 50A-S, the arm strut 50B-S, and the actuator component 51. In particular, the back screen 112 is attached to the leg strut 38A-S and the arm strut 50A-S so the back screen 112 extends between these two pole structures when the portable barrier is in the protection mode of operation as shown in FIG. 42. Similarly, the back screen 114 is attached to the actuator component 51 and the arm strut 50B-S so the back screen 114 extends between these two poles structures when the portable barrier is in the protection mode of operation as also shown in FIG. 42. In this manner, the back screen panels 112, 114 act as movement limiters.

It should be appreciated that the manner in which the back screen panels 112, 114 are secured to their respective pole structures are similar to the manner in which the tension lines 102 are secured to their respective pole structures. In particular, each of the back screen panels 112, 114 includes two separate segments of strap or webbing material such as a 1" wide polypropylene webbing. Each end of each strap segment includes an attachment loop 106 that defines a passageway 108 extending therethrough. As with the attachment loops of the tension lines 102, the attachment loops 106 of the back screen panels 112, 114 are created by folding over an end segment of the strap segment back upon itself and sewing it to an adjacent part of the strap segment. The back screen panel attachment loop 106 defines a passageway 108 as shown in FIG. 66. All the attachment loops 106 of the back screen panels 112, 114 are constructed in the same manner and possess the same structural configuration as each other.

As mentioned above, each of the back screen panels 112, 114 includes a piece of fabric material. Each of the back screen panels 112, 114 further includes two separate segments of strap or webbing material. The two segments of strap of the back screen panel 112 are sewn to the piece of fabric material of the back screen panel 112. Similarly, the two segments of strap of the back screen panel 114 are sewn to the piece of fabric material of the back screen panel 114.

Figure 46:
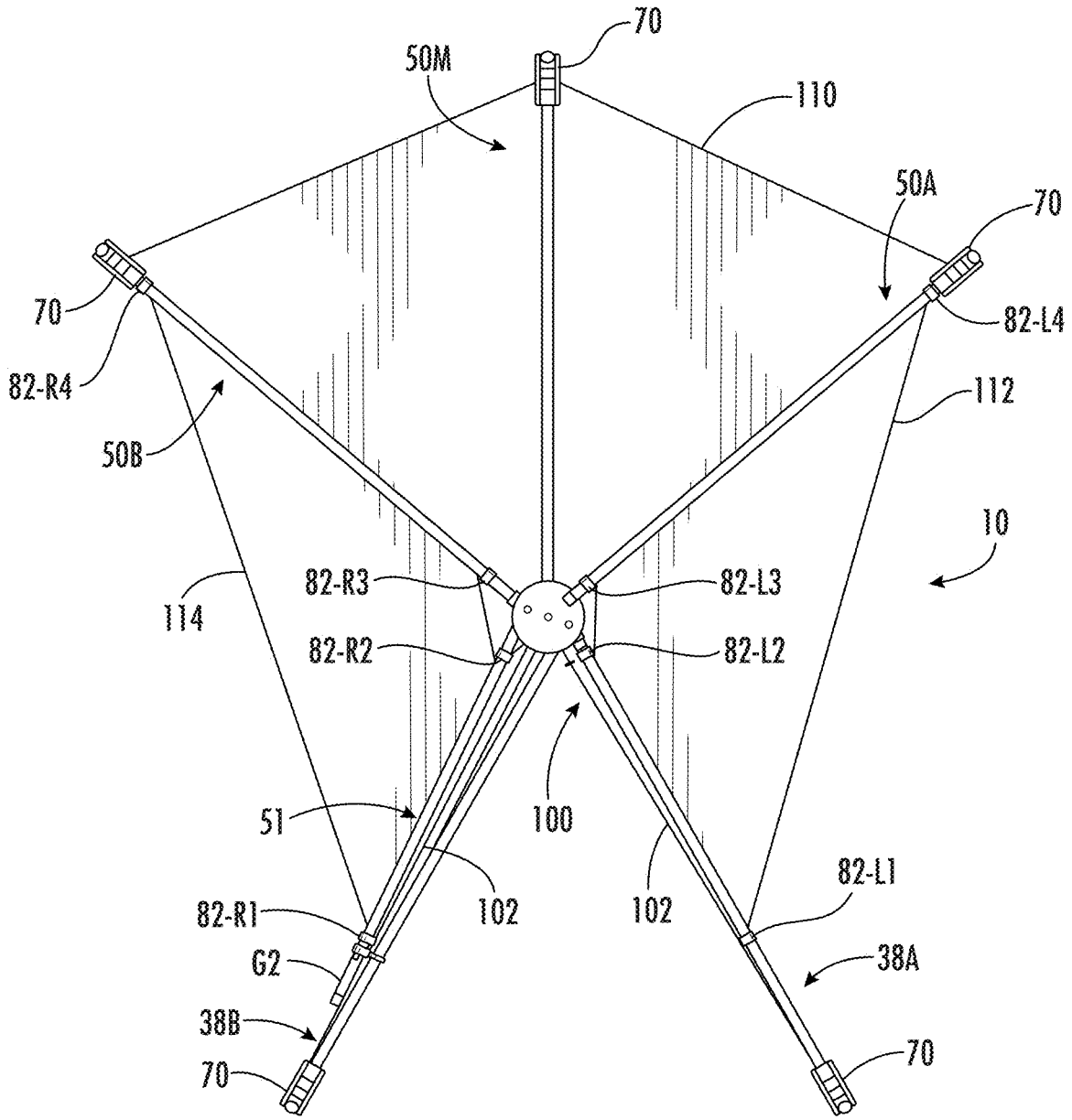
Figure 47:
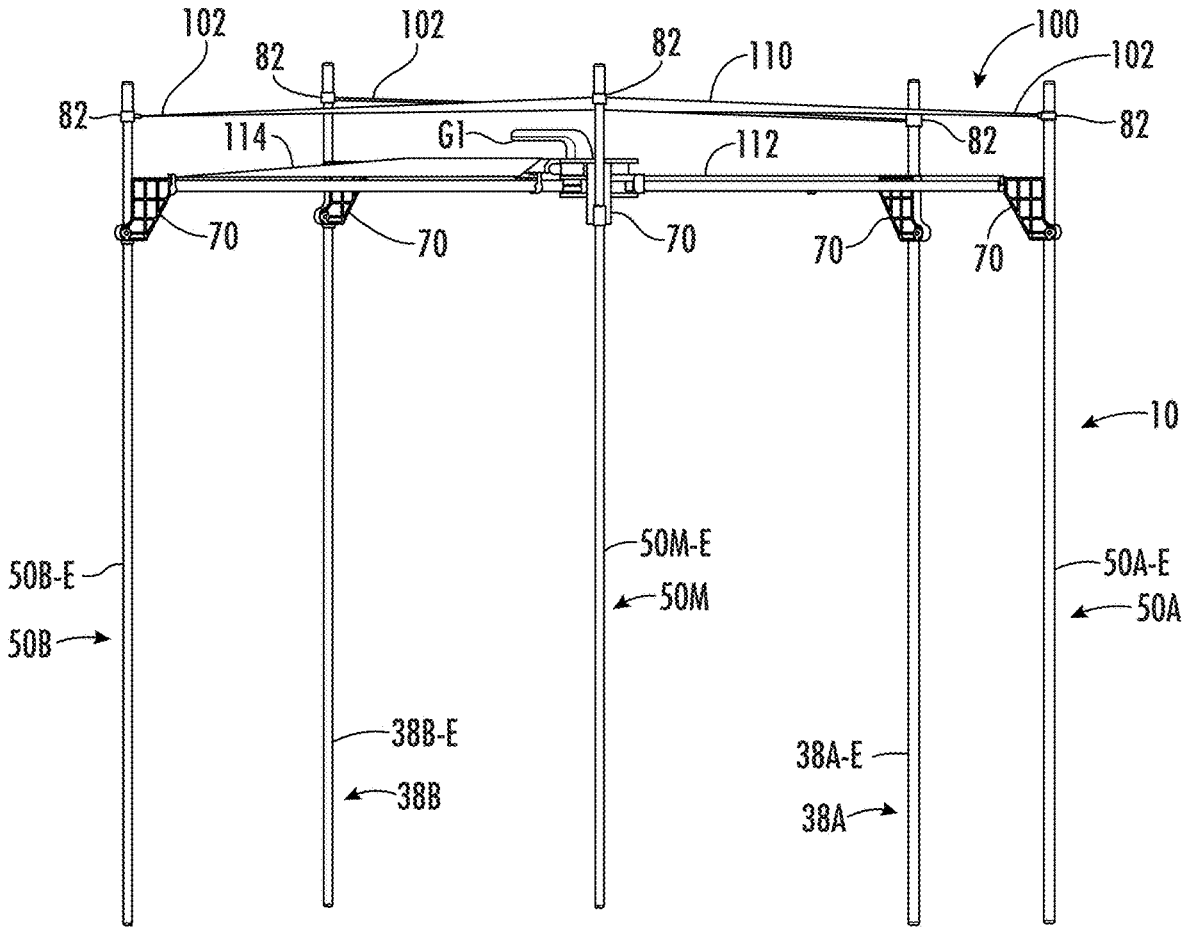
Figure 48:
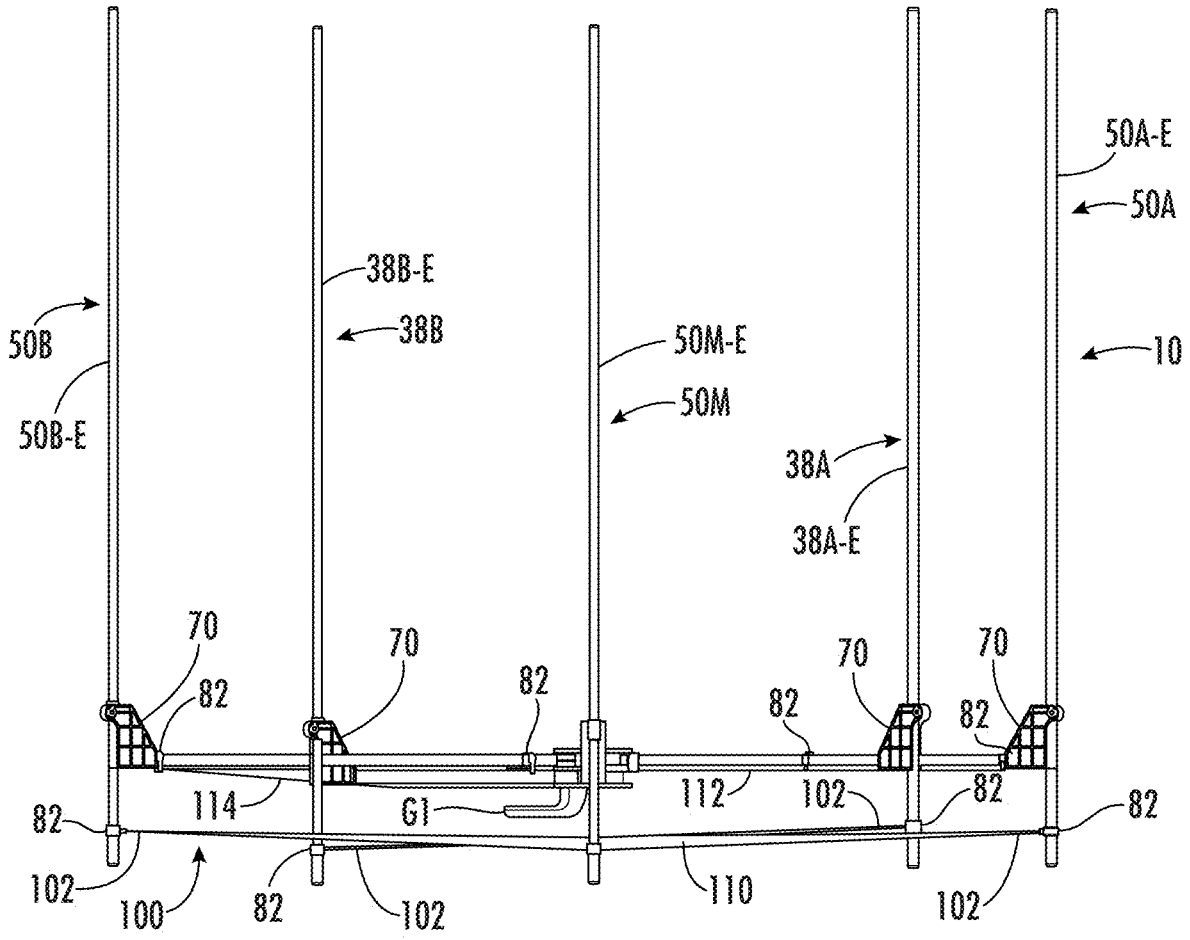

As shown in FIG. 46, the back screen panel 112 includes one strap segment that extends from the panel holder 82-L1 to the panel holder 82-L2 and another strap segment that extends from the panel holder 82-L3 to the panel holder 82-L4. Similarly, as shown in FIG. 46, the back screen panel 114 includes one strap segment that extends from the panel holder 82-R1 to the panel holder 82-R2 and another strap segment that extends from the panel holder 82-R3 to the panel holder 82-R4.

During movement of the portable barrier 10 from its protection mode (see FIGS. 1-8) to its storage mode (see FIG. 73, 73A, 73B), both the leg strut 38A-S and the arm strut 50A-S move in a generally arcuate path. It should be appreciated that the back screen panel 112 is attached to the leg strut 38A-S and the arm strut 50A-S so that the extent of movement or distance between the leg strut 38A-S and the arm strut 50A-S is limited by the back screen panel 112. More specifically, the leg strut 38A-S is allowed to move in relation to the arm strut 50A-E so that the back screen panel 112 moves from a collapsed configuration shown in FIG. 73A, 73B to an expanded configuration shown in FIGS. 1-8 in which the leg strut 38A-S and the arm strut 50A-S are separated by a maximum distance shown in FIGS. 1-8 (and FIGS. 41-48).

During movement of the portable barrier 10 from its protection mode (see FIGS. 1-8) to its storage mode (see FIGS. 73, 73A, 73B), both the actuator component 51 and the arm strut 50B-S pivot about an axis defined by its respective screw 18 as shown in FIGS. 11-12. It should be appreciated that the back screen panel 114 is attached to the actuator component 51 and the arm strut 50B-S so that the extent of movement or distance between the actuator component 51 and the arm strut 50B-S is limited by the back screen panel 114. More specifically, the actuator component 51 is allowed to move in relation to the arm strut 50B-S so that the back screen panel 114 moves from a collapsed configuration shown in FIG. 73A, 73B to an expanded configuration shown in FIGS. 1-8 in which the actuator component 51 and the arm strut 50B-S are separated by a maximum distance shown in FIGS. 1-8 (and FIGS. 41-48).

It should be appreciated that when the portable barrier 10 is positioned in its protection mode, the back screen panel 110 generally lies in a first plane, while the back screen panels 112, 114 generally lie in a second plane that is offset from the first plane as shown in FIGS. 44-45 and 47-48. The benefit of this structural arrangement is that an air vent V is created between the back screen panel 110 and the back screen panel 112, and another air vent V is created between the back screen panel 110 and the back screen panel 114 as shown in FIG. 42. Creation of these air vents V in the rear of the portable barrier 10 enables the portable barrier of the present disclosure to be more stable in wind conditions by allowing the wind to tend to blow through the portable barrier as opposed to blow against the portable barrier.

Operation of Portable Barrier

It should be appreciated that the set-up and take-down procedure of the portable barrier of the present disclosure that is described herein is generally similar to the set-up and take-down procedure of the portable barrier 10 described in U.S. Pat. No. 11,326,365 (hereinafter "the '365 Patent"), the disclosure of which is totally incorporated by reference herein in its entirety. However, one significant difference between the two relates to a requirement in connection with the portable barrier 10 of the '365 Patent, namely, after the collapsed portable barrier is removed from the carry bag, a user must rotate a lower part of the collapsed portable barrier relative to an upper part of the collapsed portable barrier through a path of about 270 degrees prior to undertaking the remaining deploying step in which the cover is positioned over the floor and the backscreen horizontally oriented. As mentioned above, the requirement for a user to move the lower part of the collapsed portable barrier relative to the upper part of collapsed portable barrier through a path of about 270 degrees (as opposed to merely 90 degrees) may be somewhat confusing to a user thereby reducing the ease of setting up portable barriers possessing this type of general structural configuration. In contrast, the portable barrier 10 of the present disclosure eliminates such requirement, and requires only, after the collapsed portable barrier is removed from the carry bag, for a user to move an upper part of the collapsed portable barrier relative to a lower part of the collapsed portable barrier through a path of about 90 degrees prior to undertaking the remaining deploying step in which the cover is positioned over the floor and the backscreen horizontally oriented. Indeed, the portable barrier 10 of the present disclosure has a reduced amount of repositioning by 180 degrees of the various pole structures in comparison to that described at column 8, lines 31-41 (and shown in FIGS. 13 and 17-18) of the '365 Patent. (See, e.g., the required 270 degrees of movement of the portable barrier 10 during its set-up process from its position shown in FIG. 13 to its position shown in FIGS. 17-18 of the '365 Patent). The set-up process of the portable barrier 10 of the present disclosure is believed to be substantially more intuitive to a user of the portable barrier.

Operation of the portable barrier 10 of the present disclosure will now be discussed in detail in connection with FIGS. 73-79 (and reference to FIGS. 1-8 and 73A, 73B as well). In FIGS. 73-79, the flooring 40, the covering 52, the back screen panels 110, 112, 114, and the tensioner 100 are removed for clarity of understanding to show a framework of the portable barrier 10 that includes the legs 38A, 38B, the arms 50A, 50M, 50B, the actuator component 51, and the junction assembly 16. Of course, during set-up and take-down of the portable barrier 10 of the present disclosure, the flooring 40, the covering 52, the back screen panels 110, 112, 114, and the tensioner 100 would be present in the portable barrier 10 similar to how the '365 Patent shows the flooring, the covering, and the back screen are present when the portable barrier 10 of the '365 Patent is set-up and taken down.

In operation, a user (e.g. the eventual occupant 26) will carry the portable barrier 10 while it is positioned in its storage mode and located in the carrier bag 30 as shown in FIG. 10. Upon arriving at a use destination such as a sandy beach or near the sideline of a soccer field, the user removes the portable barrier 10 from the carrier bag 30 and places the portable barrier on a ground surface which is a substantially horizontal surface. FIGS. 73, 73A, 73B show the portable barrier 10 completely removed the carrier bag, and FIG. 9 shows the carrier bag without the portable barrier therein. Thereafter, the portable barrier 10 is manipulated so that the handle H1 of the junction assembly 16 is facing upwardly. Then, the strut portions 38A-S, 38B-S, 50A-S, 50B-S (and the actuator component 51) are pivoted as a group about 90 degrees in relation to the extension portions 38A-E, 38B-E, 50A-E, 50M-E, 50B-E from their position in FIGS. 73, 73A, 73B (after initial manipulation to have the handle H1 facing upwardly) to their position in FIG. 74 about their respective hinge joints.

It should be appreciated that the portable barrier 10 of the present disclosure has a reduced amount of repositioning by 180 degrees of the various pole structures at this point in the set-up process in comparison to that described at column 8, lines 31-41 (and shown in FIGS. 13 and 17-18) of the '365 Patent. (See, e.g., the required 270 degrees of movement of the portable barrier 10 during its set-up process from its position shown in FIG. 13 to its position shown in FIGS. 17-18 of the '365 Patent). This feature of the portable barrier 10 of the present disclosure is believed to make the set-up process of the portable barrier substantially more intuitive to a user of the portable barrier.

Figure 74:
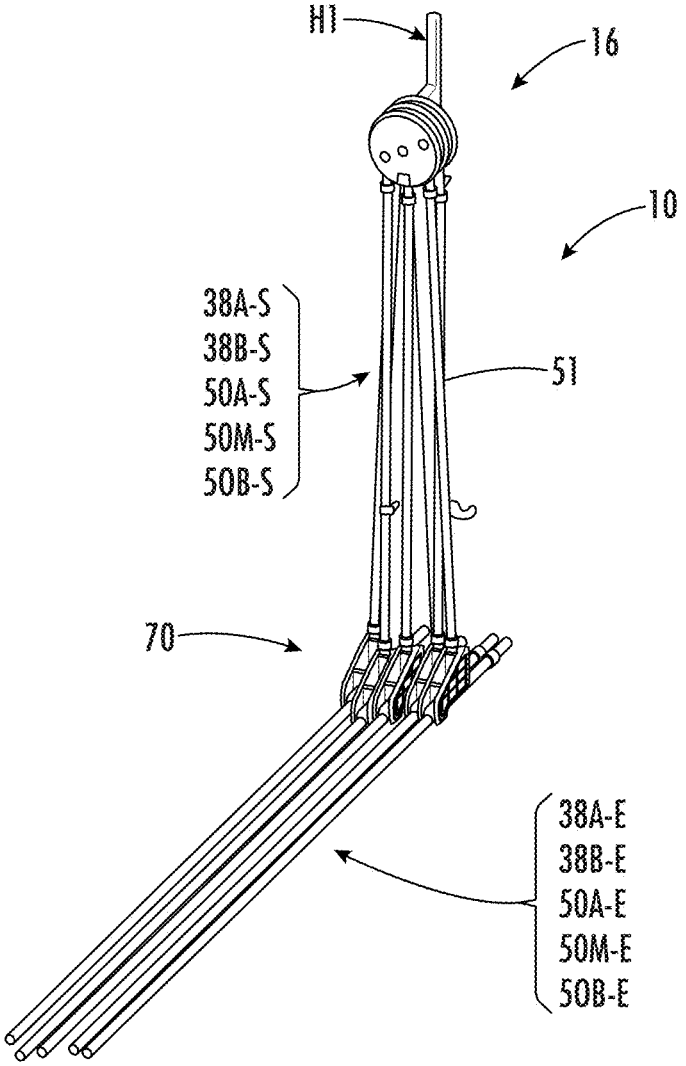
FIGS. 74-79 (along with FIGS. 73, 73A) show various views of the portable barrier of FIGS. 1-8 in the process of being moved from its storage mode of operation to its protection mode of operation.
Figure 75:
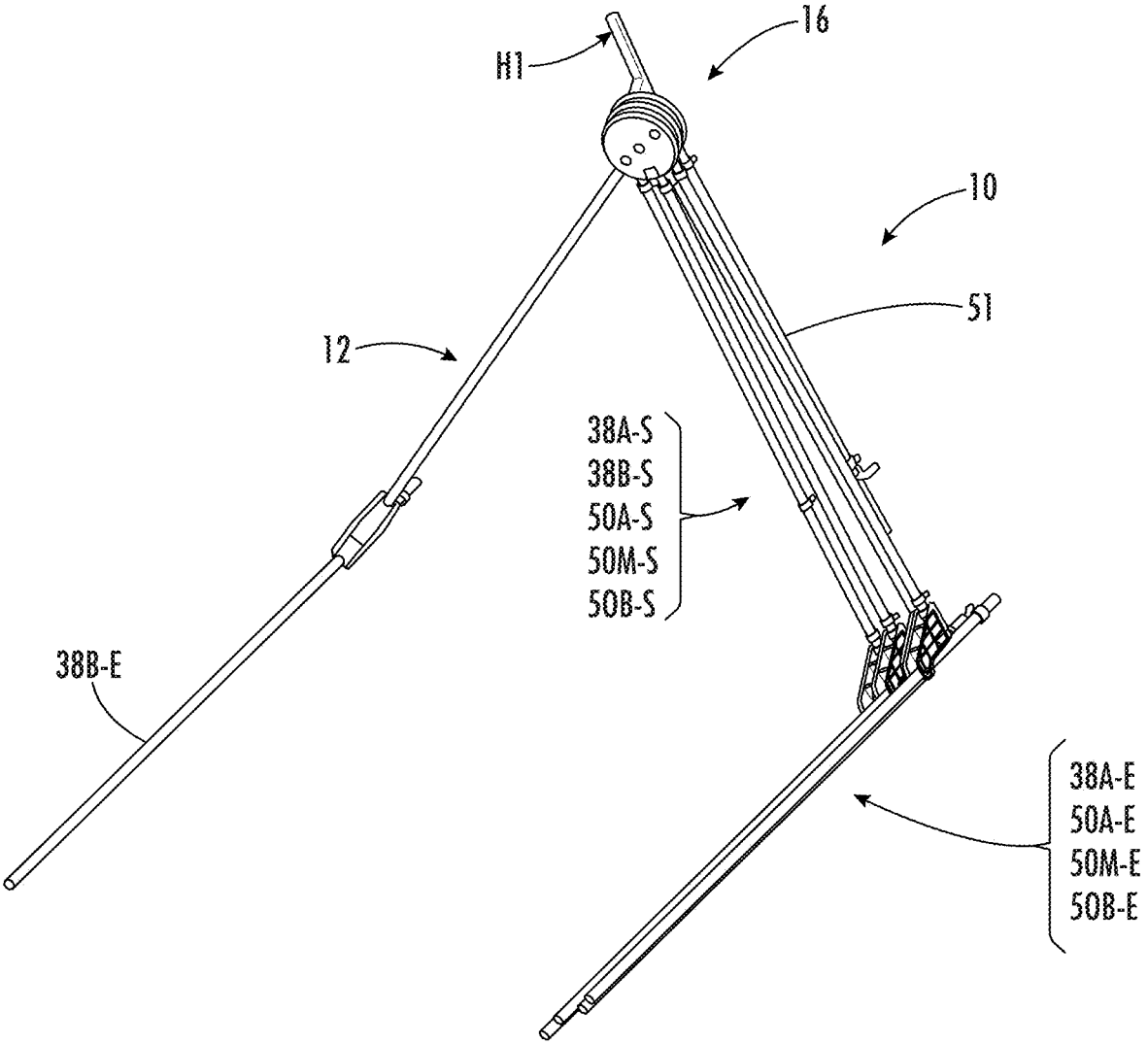

Continuing now with the set-up process of the portable barrier 10 of the present disclosure, the user would thereafter move the legs 38A and 38B away from each other from their relative position shown in FIG. 74 to their relative position shown in FIG. 75. In this position the pedestal assembly 12 is supported on the ground or horizontal surface as shown in FIG. 75. Moving of the legs 38A, 38B in such a manner causes the flooring 40 to be deployed. When deployed, the flooring 40 is positioned on the ground or horizontal surface so as to be supported thereby.

Figure 76:
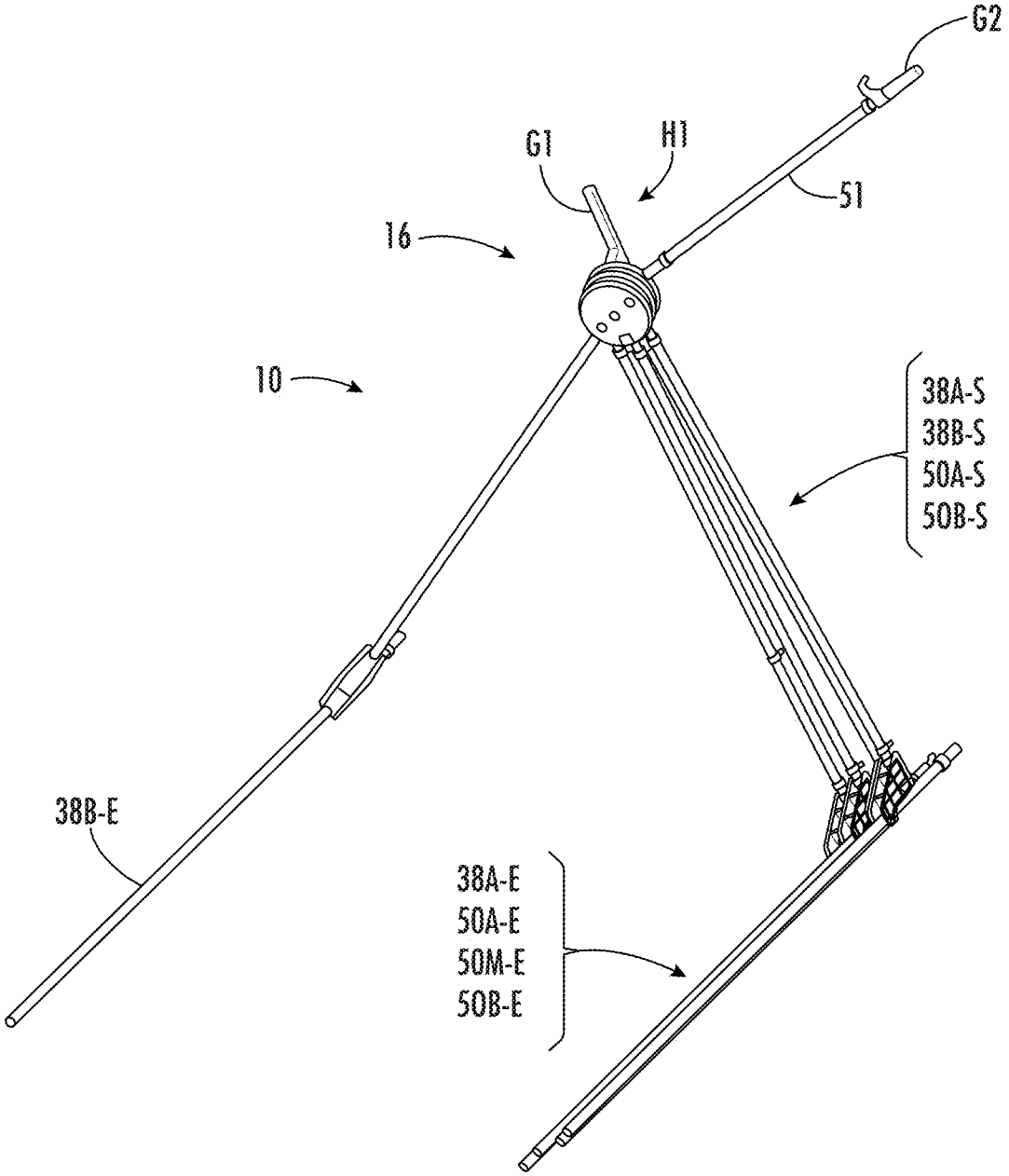

Then, the actuator component 51 is moved from its position shown in FIG. 75 to its position shown in FIG. 76. Moving of the actuator component 51 in the manner described above causes the back screen panels 110, 112, 114 to begin to be partially deployed. It should be appreciated that the back screen panel 114 serves a limiter. Specifically, the back screen panel 114 is attached to the actuator component 51 and the arm 50B so that the extent of movement or distance between the actuator component 51 and the arm 50B is limited by the back screen panel 114.

Figure 77:
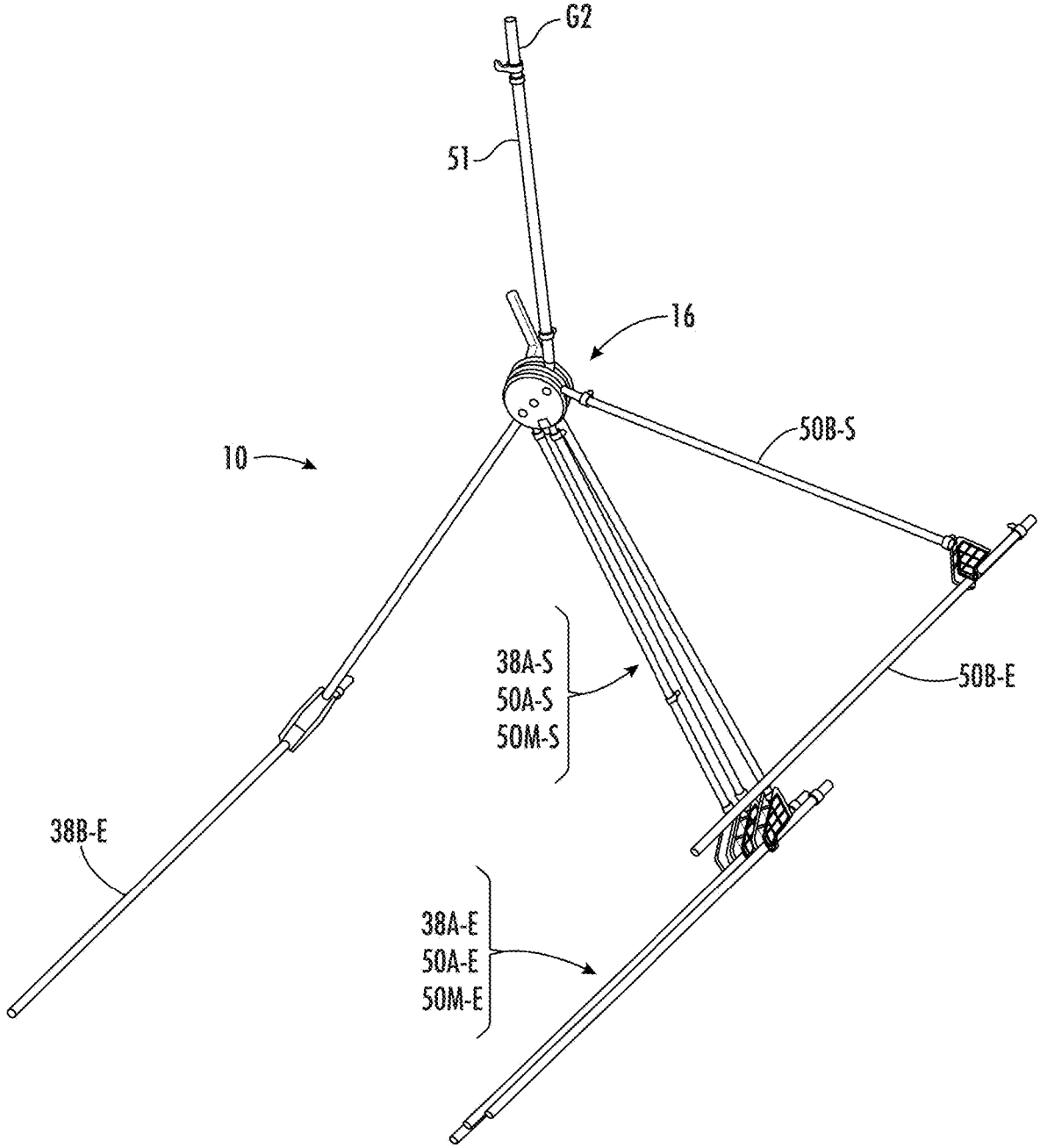

The actuator component 51 and the arm 50B are then moved from their position in FIG. 76 to their position in FIG. 77. Moving of the actuator component 51 and arm 50B in such a manner causes the back screen panels 110, 112, 114 and the covering 52 to be further partially deployed.

Figure 78:
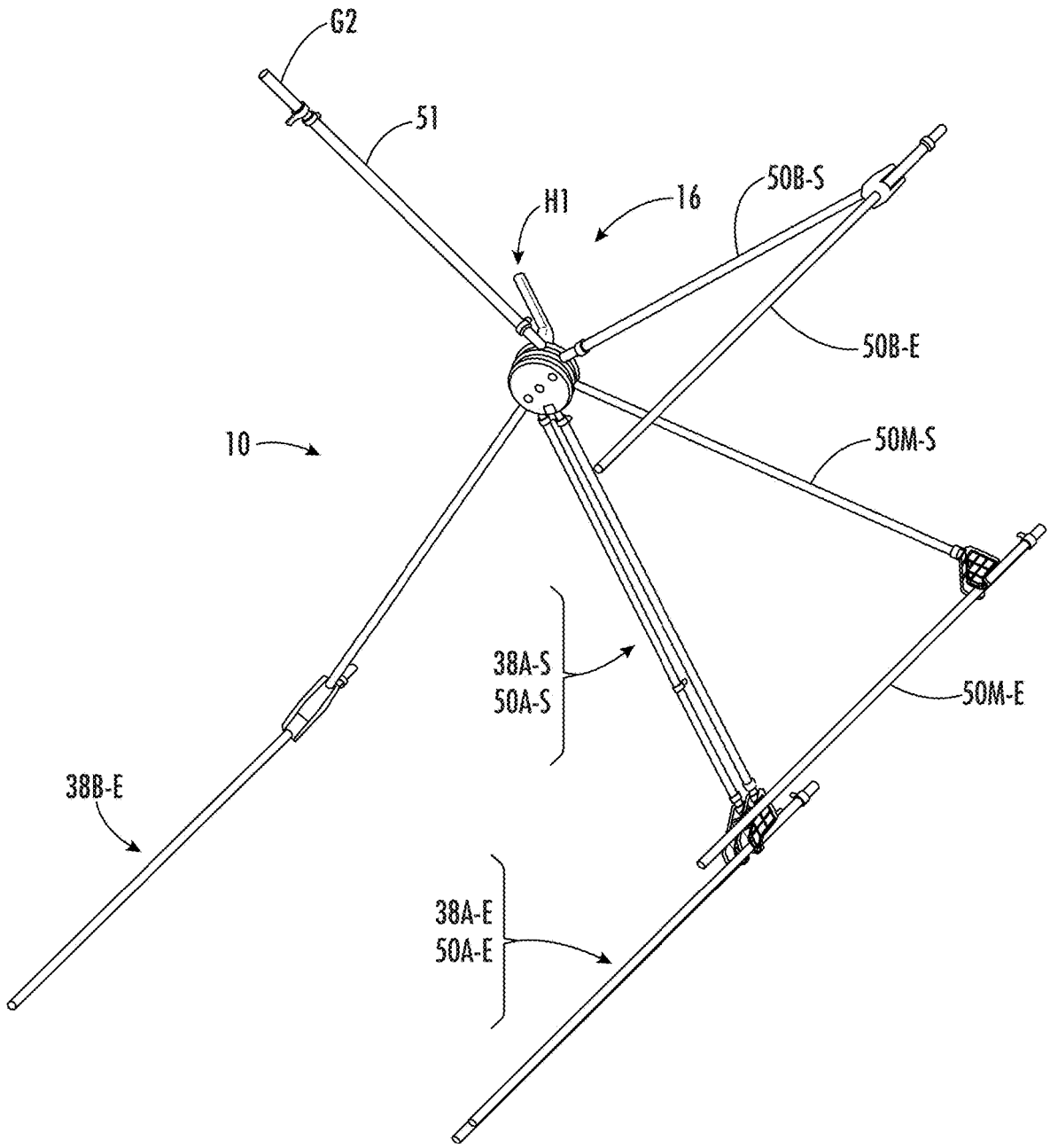

Thereafter, the actuator component 51 and the arms 50B, 50M are moved from their position in FIG. 77 to their position in FIG. 78. Moving of the actuator component 51 and the arms 50B, 50M in the manner described above causes the back screen panels 110, 112, 114 and the covering 52 to be additionally partially deployed.

Figure 79:
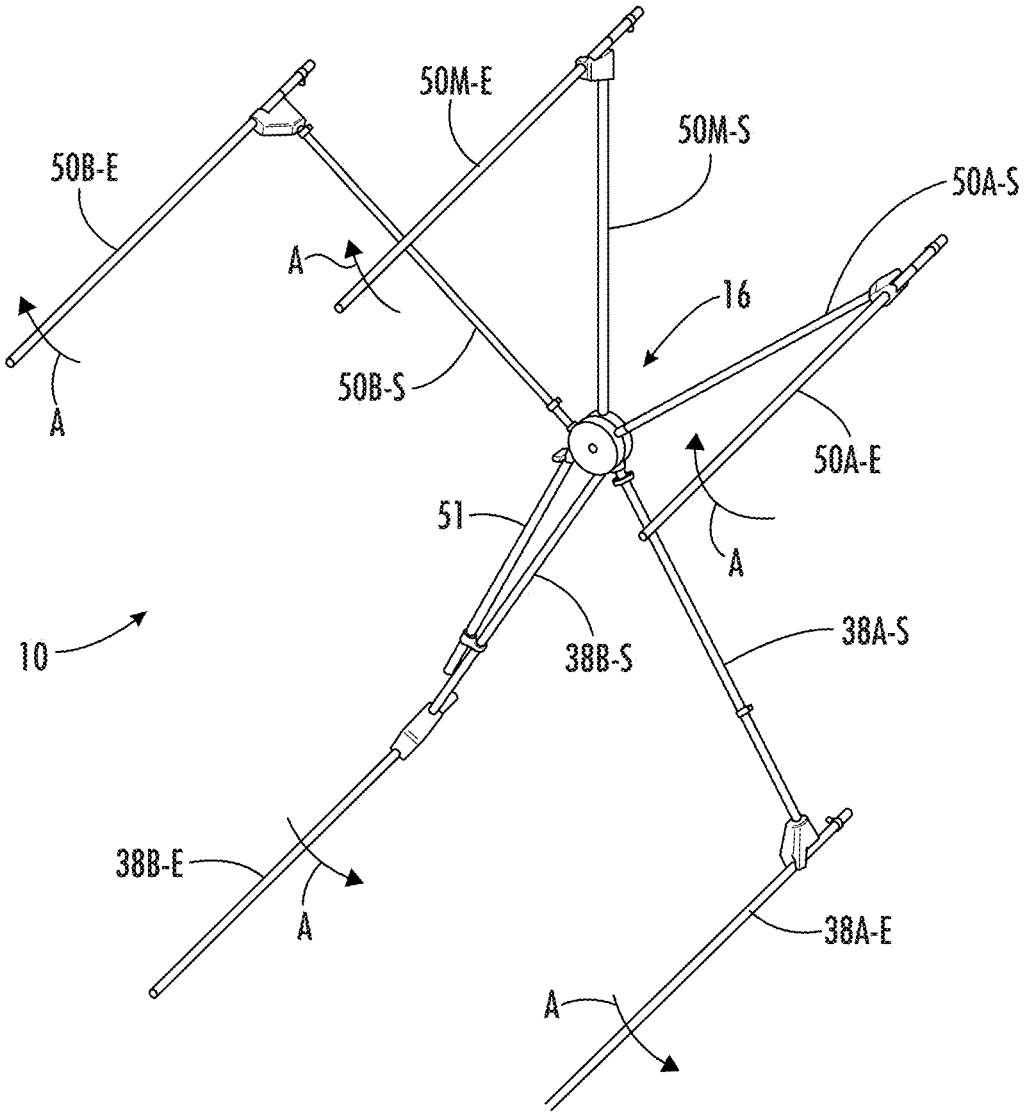

Then, the actuator component 51 and the arms 50B, 50M, 50A are moved from their position in FIG. 78 to their position in FIG. 79. Moving of the actuator component 51 and the arms 50B, 50M, 50A in the manner described above causes the back screen panels 110, 112, 114 and the covering 52 to be fully deployed. When fully deployed, the covering 52 is supported above the flooring 40 as shown in FIGS. 1-8. It should be appreciated that the back screen panel 112 also serves a limiter. Specifically, the back screen panel 112 is attached to the arm 50A (i.e. the strut portion 50A-S) and the leg 38A (i.e. the strut portion 38A-S) so that the extent of movement or distance between the arm 50A and the leg 38A is limited by the back screen panel 112.

As discussed above, the actuator component 51 carries the rod hook 51H at one end of the grip G2 as shown in FIGS. 64-65. In operation, the rod hook 51H is used to secure the portable barrier 10 in its protection mode. As shown in FIGS. 64-65, at the final stage of setting up the portable barrier 10, the actuator component 51 is moved from its position shown in FIG. 65 to its position shown in FIG. 64 so that the hook portion HP partially extends around the contour of the leg strut 38B-S so that the portable barrier 10 is securely locked in its protection state.

In response to the portable barrier 10 being deployed in such a manner, the occupant space 28 is created as shown in FIGS. 5-6. The chair 27 is then advanced into the occupant space 28 and situated so as to be supported on the flooring 40 as shown in FIGS. 5-6. The occupant 26 then enters the occupant space 28 and sits in the chair 27 as shown in FIG. 5-6 so as to be protected from exposure to sun, wind, and/or rain by the portable barrier 10. Alternatively, after the occupant space 28 is created by deployment of the portable barrier 10 in the manner described above, a chair is not positioned in the occupant space, but rather an occupant enters the occupant space 28 and sits down, or alternatively, lays down directly on the flooring 40 whereby the occupant is protected from exposure to sun, wind, and/or rain by the portable barrier 10.

It should be appreciated, when the user's period of use of the portable barrier 10 is done, the user takes down the portable barrier 10 simply by reversing the set-up steps described above thereby ending with the portable barrier being placed in the carry bag 30 in its storage mode of operation.

It should be appreciated that the portable barrier includes a physical configuration and design features to prevent entangling of the tension lines 102 with other structural components of the portable barrier during the process of taking down the portable barrier 10. In particular, as shown in FIG. 71, the portable barrier 10 includes an elastic cord 120 (e.g. a bungee cord) which is connected between the handle H1 of the junction assembly 16 and the tensioner 100 at the connection location 104. More specifically, a first end portion (not shown) of the elastic cord 120 is located the cavity C defined by the handle H1 (see FIG. 23). A knot (not shown) is tied in this end portion of the elastic cord 120 and placed in the cavity C so as to be located at location L shown in FIG. 23. After the covering member 33 is snap fit connected to the handle H1 over the cavity C, the knot becomes trapped in cavity C due to the internal cavity features defined by the handle H1. Alternatively, a clip (not shown) can be placed on the end portion of the elastic cord 120 so as to create a blocking protrusion to prevent the end portion of the elastic cord 120 from sliding out of the handle H1 through the passageway P3 of the passage structure PS of the covering member 33. An intermediate portion of the elastic cord 120 is allowed to extend out of the handle H1 through the passageway P3 as shown in FIGS. 71 and 80. (Note that FIG. 72 shows the elastic cord 120 removed from the drawing for clarity of understanding.) The other end of the elastic cord 120 is then secured to the tensioner 100 near the connection location 104. Specifically, as mentioned above, the tensioner 100 includes the tensioner tab 122 extending from the tension lines 102 near the connection location 104. The tensioner tab 122 carries the grommet that defines a hole though the tensioner tab 122. The other end of the elastic cord 120 is extended through the grommet hole and a knot 124 (schematically shown in FIG. 80) is tied so that this end portion of the elastic cord is prevented from becoming detached from tensioner tab 122. Note that an intermediate portion of the elastic cord 120 is allowed to extend through the covering member 33 via the passageway P3 defined in the passageway structure PS of the covering member. It should be appreciated that FIG. 73B shows the tensioner tab 122 of the tensioner 100 attached to the handle H1 of the back disc 17C of the junction assembly 16 via the elastic cord 120 in a schematic manner.

In operation, during take-down of the portable barrier 10, the connection location 104 of the tensioner 100 may be allowed to migrate away from a location near the junction assembly 16 if the elastic cord 120 was not utilized. Indeed, without the implementation of the elastic cord 120 in the manner described above, the various tension lines 102 of the tensioner may become entangled with the various pole structures of the portable barrier during the set-up process. However, with this implementation of the elastic cord 120, all of the various tension lines 102 are maintained in a generally extended configuration rather than being bunched up together when the portable barrier is moved from its protection mode to its storage mode. Indeed, with the implementation of the elastic cord 120 as described above, the various tension lines 102 are maintained in a generally extended configuration by a light pulling force being applied to the various tension lines 102 by the elastic cord 120 while the portable barrier 10 is positioned in storage mode of operation. Of course, when the portable barrier 10 is in its protection mode of operation, the various tension lines 102 are also maintained in a generally extended configuration (as shown in FIGS. 1-8) but with a relatively heavy tension being applied to all of the tension lines 102 by the configuration of the portable barrier 10. Specifically, the portable barrier 10 is configured such that when the portable barrier 10 is positioned in its protection mode of operation, the three upper tension lines 102 are pulling downwardly on the end portions of the arm extensions 50A-E. 50B-E, 50M-E so as to cause them to maintain a generally horizontal orientation (with the portable barrier in its protection mode), while the two lower tension lines are pulling upwardly on the end portions of the leg extensions 38A-E, 38B-E so as to cause them to also maintain a generally horizontal orientation (with the portable barrier in its protection mode), with all the tension lines 102 being tied together at a central location (i.e. the connection location 104).

Operation of the Tensioner 100

The operation of the tensioner 100 as integral with the deployment of the leg extensions 38A-E, 38B-E and the arm extensions 50A-E, 50M-E, 50B-E will now be discussed. Turning now to FIGS. 35-37, FIG. 61, and FIGS. 73-79 (and 73A, 73B), as the portable barrier 10 is moved through its various motions depicted in FIGS. 73-79 (and 73A, 73B) in order to set-up the portable barrier 10, the tensioner 100 is moved from its collapsed configuration (see FIG. 82) to its expanded configuration (see FIG. 81) so that the tensioner 100 applies forces on the tension lines 102 which, in turn, transmit those forces to the leg extensions 38A-E, 38B-E and the arm extensions 50A-E, 50M-E, 50B-E in the following manner. Specifically, movement of the portable barrier from its storage mode as depicted in FIG. 73, 73A, 73B to its protection mode as depicted in FIG. 79 (and FIGS. 1-8) causes movement of the leg extensions 38A-E and 38B-E and the arm extensions 50A-E, 50M-E, 50B-E in the direction of the arrow A as shown in FIG. 61 (see also FIGS. 35-37) so that they assume a generally horizontal orientation as shown in FIG. 61 (and also FIGS. 35-37). And thereafter, the leg extensions 38A-E, 38B-E and the arm extensions 50B-E, 50M-E are maintained in their generally horizontal orientation while the tensioner 100 remains in its expanded configuration.

On the other hand, as the portable barrier 10 is moved in an opposite manner through its various motions depicted in FIGS. 73-79 in order to take-down the portable barrier 10 (i.e. when the portable barrier is moved from its protection mode as depicted in FIG. 79 to its storage mode as depicted in FIG. 73, 73A), the tensioner 100 is caused to move from its expanded configuration (see FIG. 81) to its collapsed configuration (see FIG. 82). This action causes the forces on the tension lines 102 to be released so that the tensioner transmits no appreciable forces to the leg extensions 38A-E, 38B-E and the arm extensions 50A-E, 50M-E, 50B-E. In response to the tensioner transmitting no appreciable forces to the leg extensions and arm extensions, the leg extensions and the arm extensions are allowed to move in the direction opposite to the arrows A as shown in FIG. 61 (and FIGS. 35-37) so that the leg extensions and the arm extensions assume a generally parallel orientation in relation to the leg struts 38A-S, 38B-S, the arm struts 50A-S, 50B-S and the actuator component as shown in FIG. 61 (and FIGS. 73, 73A, 73B).

TERMINOLOGY

The terms "collapsed configuration" and "expanded configuration" are used in the present disclosure. In order to provide further understanding of the meaning of these terms, it should be appreciated that FIGS. 73, 73A, 73B show various components of the portable barrier in their collapsed configuration while the portable barrier 10 is in its storage mode of operation (i.e. while the portable barrier 10 is in its collapsed configuration). For example, FIGS. 73, 73A, 73B show the following components in their collapsed configuration: the leg 38A, the leg 38B, the arm 50A, and the arm 50B, the arm 50M. It should further be appreciated that the following components are also shown in their collapsed configuration in FIG. 73A, albeit schematically: the flooring 40, the covering 52, the back panels 110, 112, 114, and the tensioner 100. Note that FIGS. 73B, 82 further show the tensioner 110 in its collapsed configuration.

Figure 36:
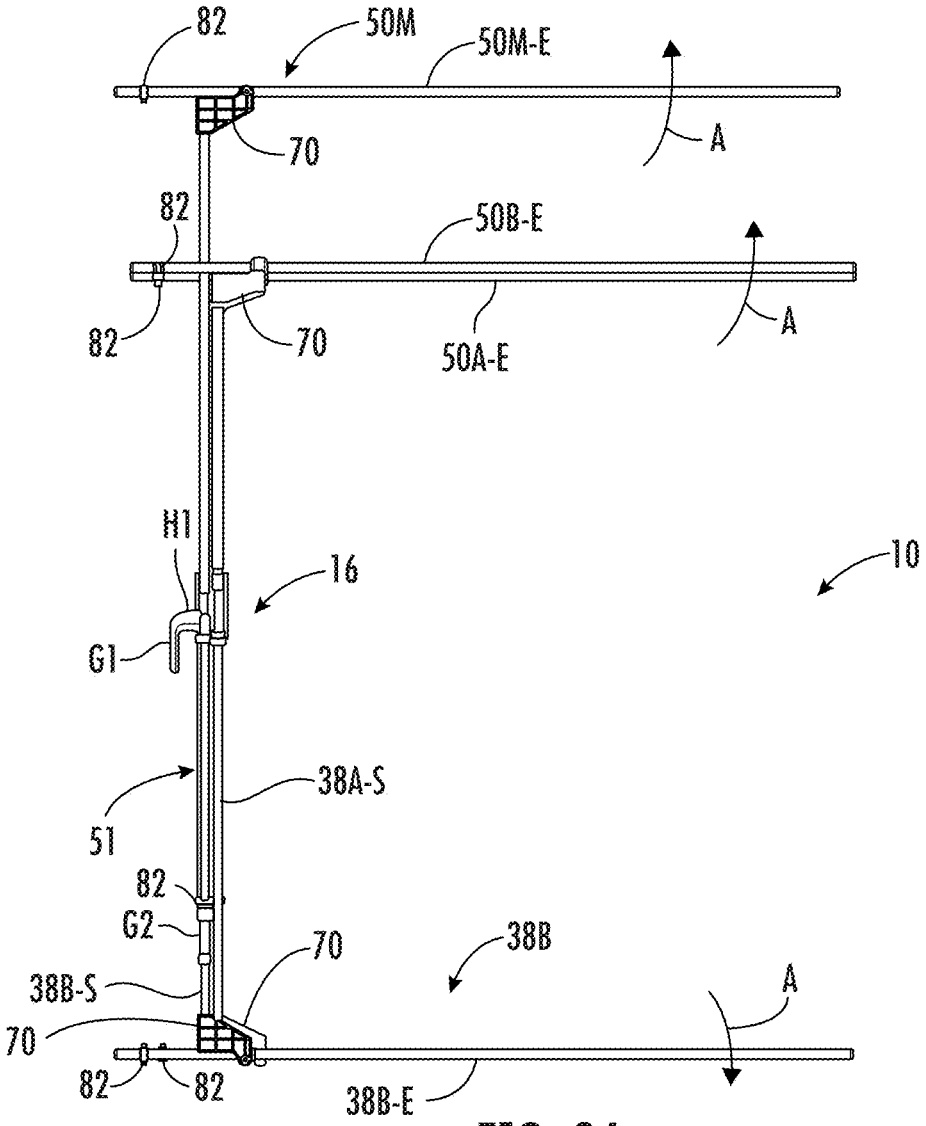
Figure 37:
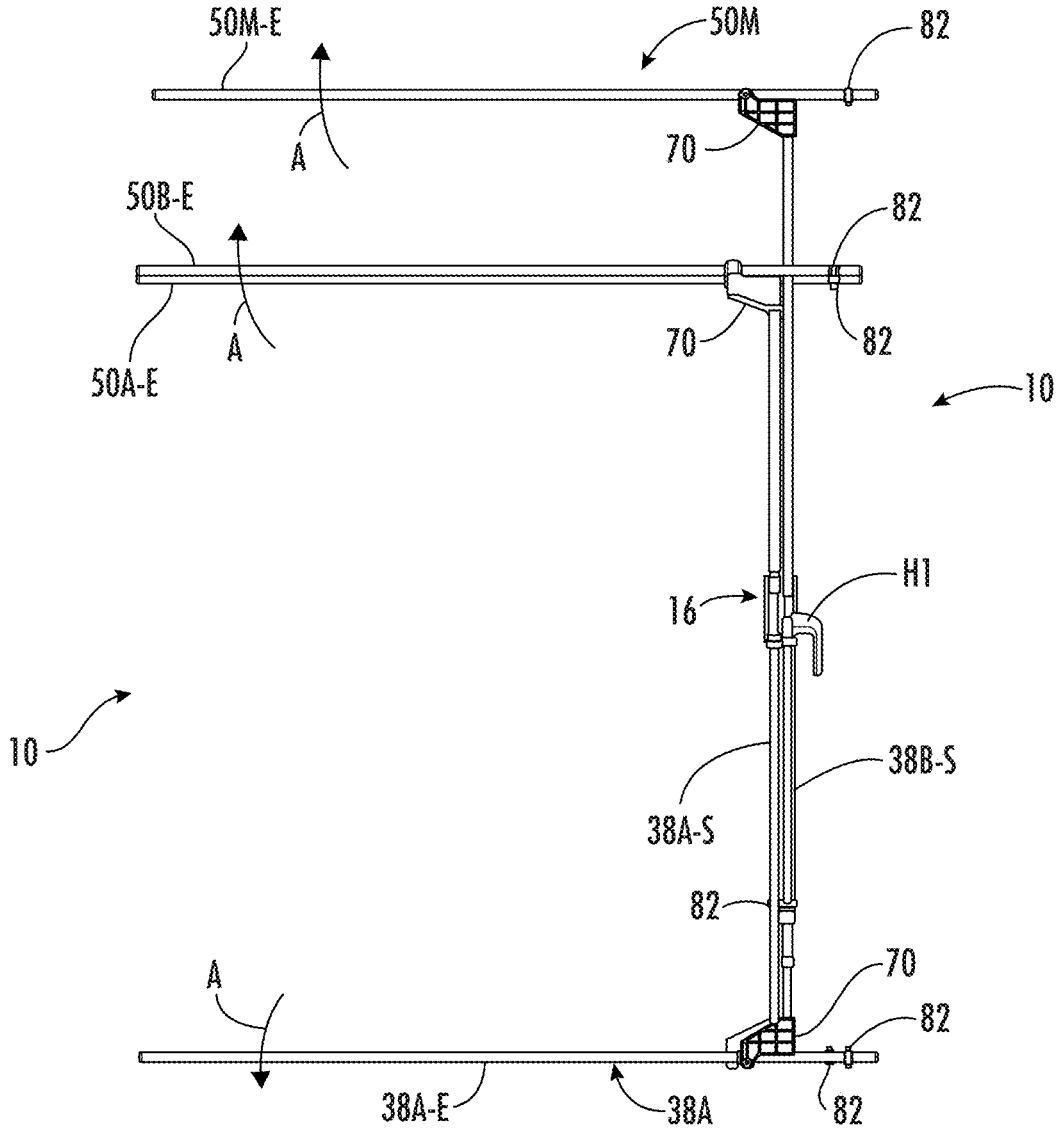
Figure 38:
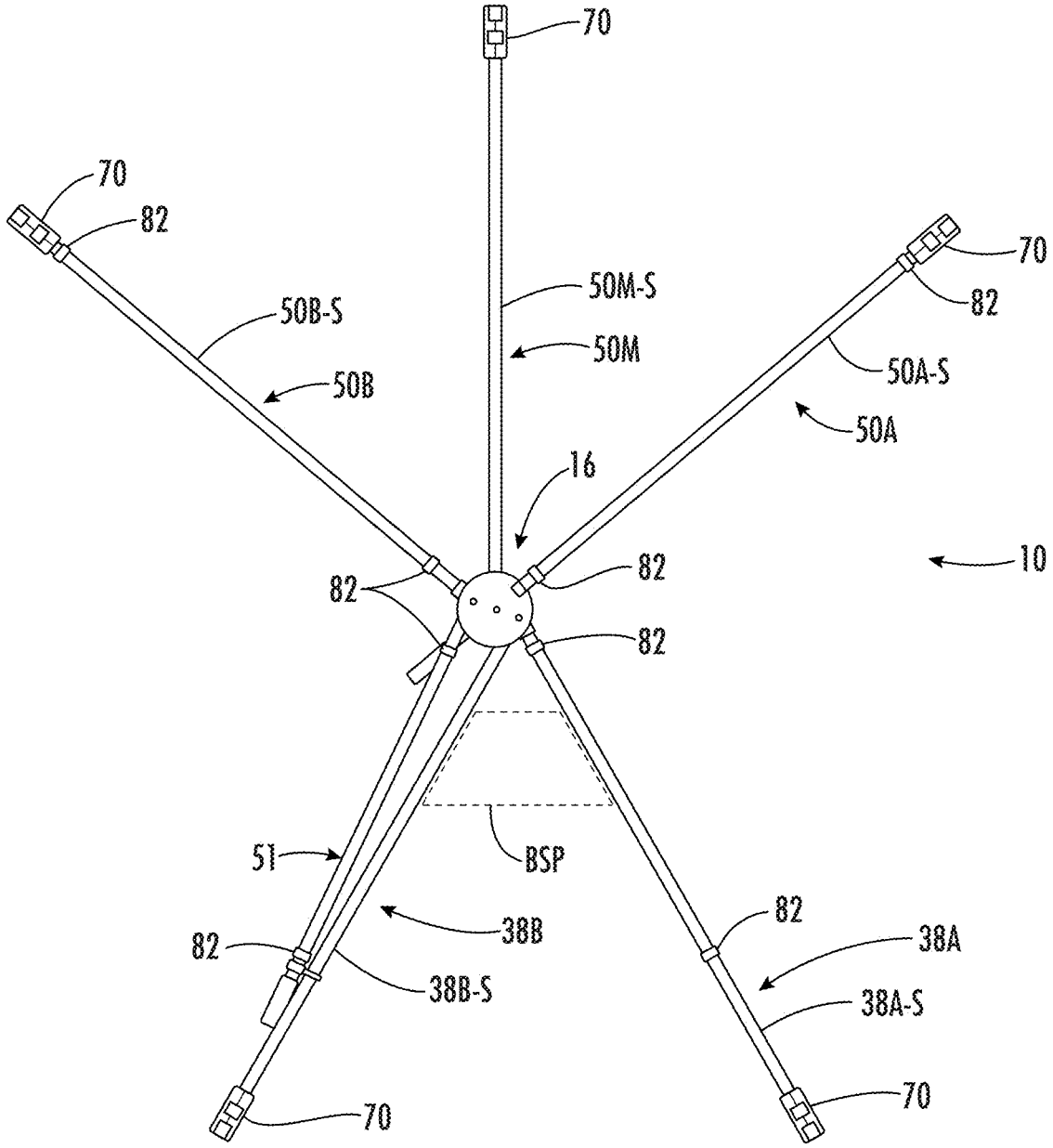
Figure 39:
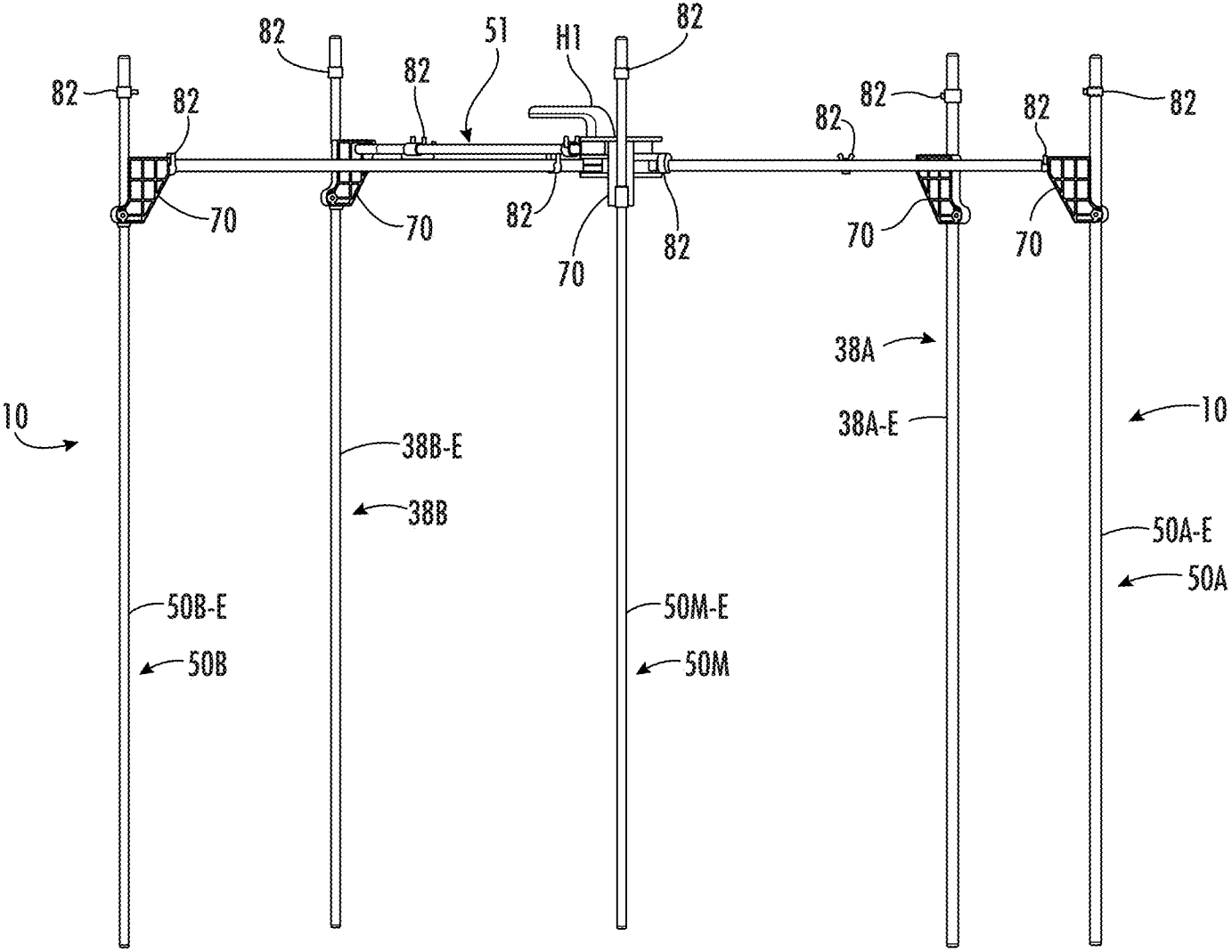
Figure 40:
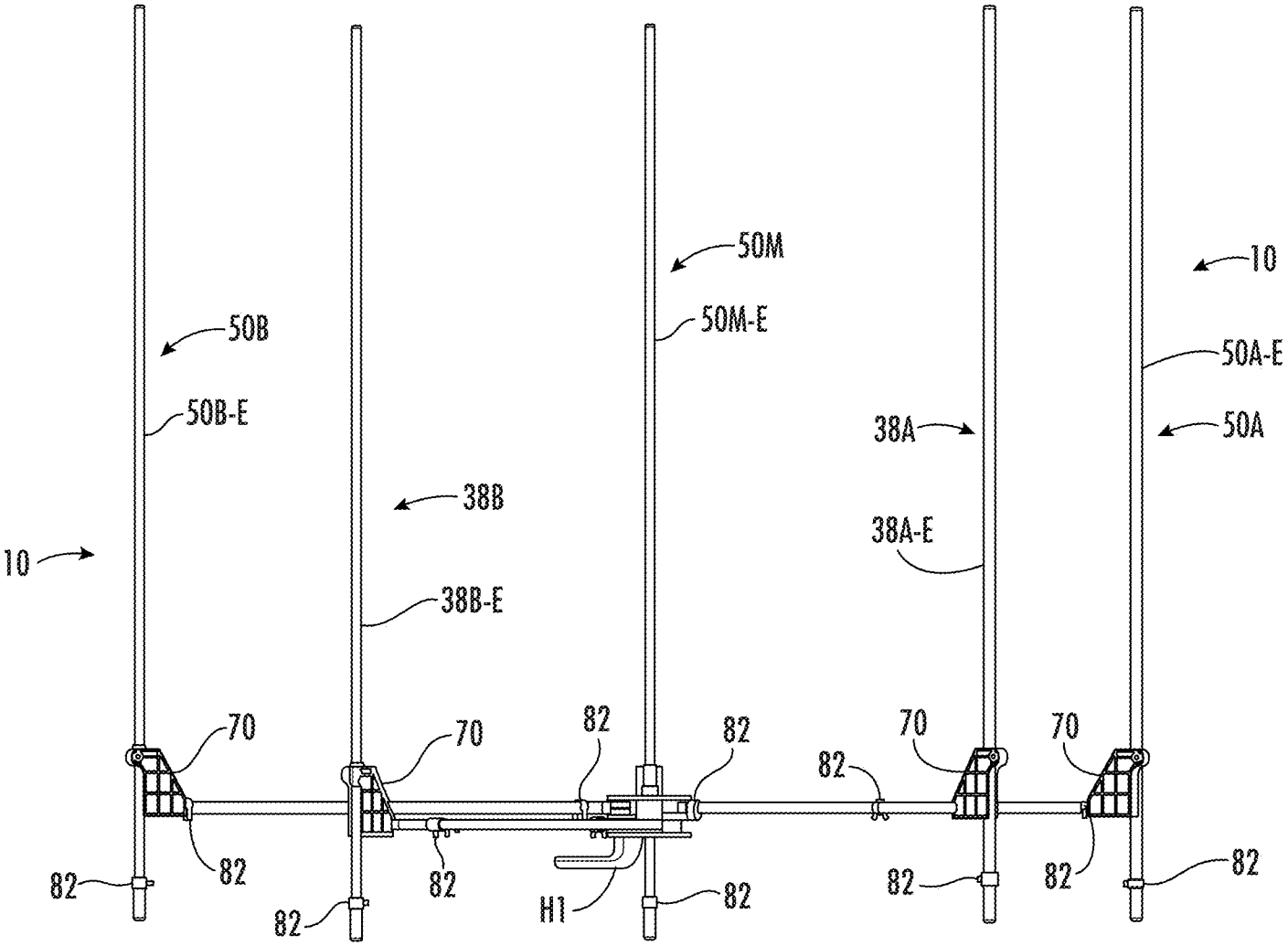
Figure 41:
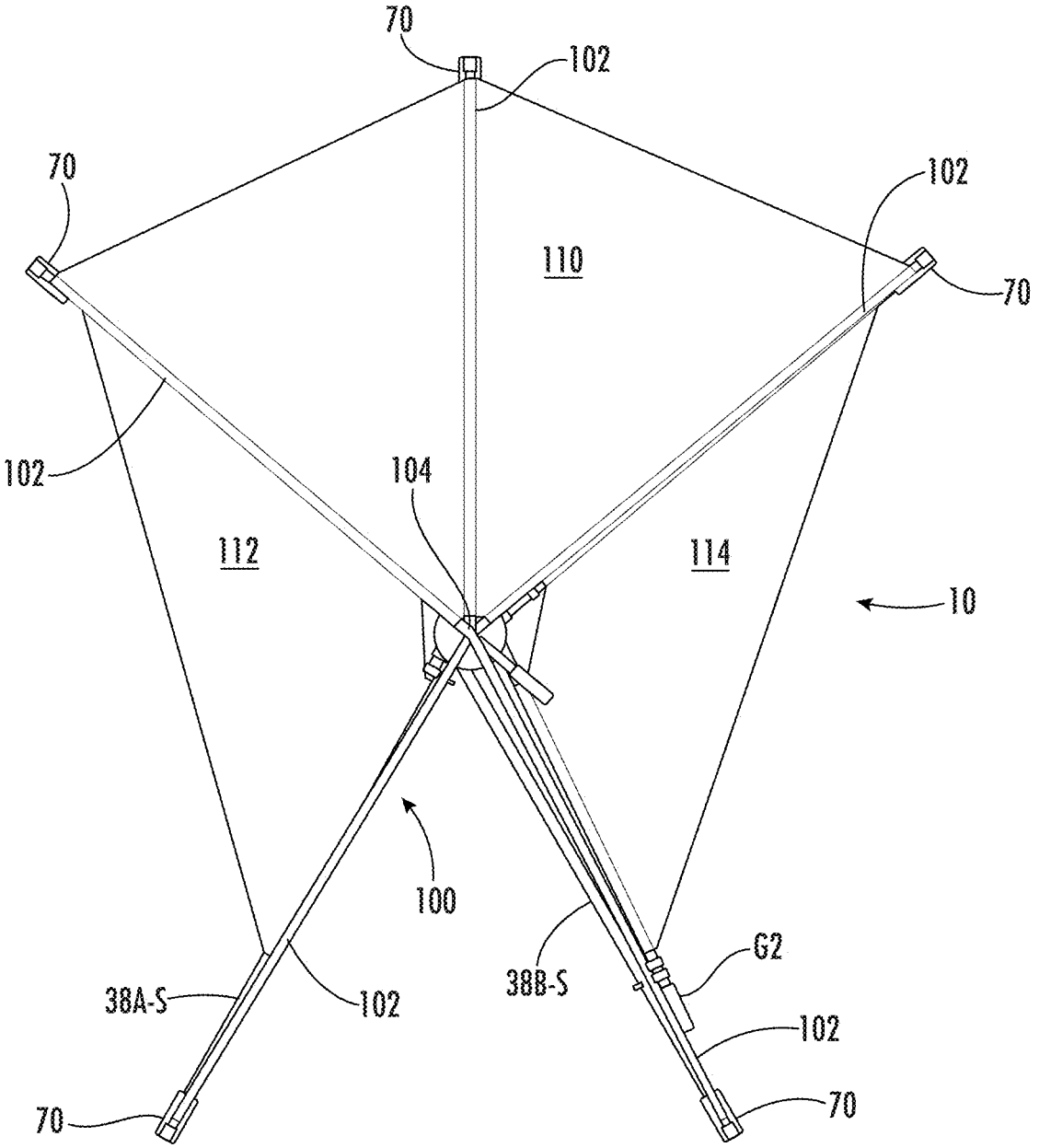
FIGS. 41-48 show various views of the portable barrier of FIGS. 1-8, with the covering and flooring removed for clarity of description.

On the other hand, it should be appreciated that FIGS. 35-37 (and FIGS. 1-8) show various components of the portable barrier in their expanded configuration while the portable barrier 10 is in its protection mode of operation (i.e. while the portable barrier 10 is in its expanded configuration). For example, FIGS. 35-37 (and FIGS. 1-8) show the following components in expanded configuration: the leg 38A, the leg 38B, the arm 50A, the arm 50B, the arm 50M, the flooring 40, the covering 52, the back screen panels 110, 112, 114, and the tensioner 100. Note that FIG. 81 further shows the tensioner 110 in its expanded configuration.

The phrase "moving away from each other" is used in the present disclosure. In order to provide further understanding of the meaning of this phrase, it should be appreciated that a first component and a second component are moving away from each in each of the following instances: (i) when the first component is being advanced away from the second component, while the second component remains stationary, (ii) when the second component is being advanced away from the first component, while the first component remains stationary, and (iii) when both the first component and the second component are being simultaneously advanced in generally opposite directions. Therefore, as one example, moving the leg 38B (while leg 38A remains stationary) from its position in FIG. 74 to its position in FIG. 75 should be understood to mean moving the legs 38A, 38B away from each other. As another example, moving the actuator component 51 (while the arm strut 50B-S remains stationary) from its position in FIG. 75 to its position in FIG. 76 should be understood to mean moving the actuator component 51 and the arm strut 50B-S away from each other. As still another example, moving the arm strut 50A-S (while the leg strut 38A-S remains stationary) from its position in FIG. 78 to its position in FIG. 79 should be understood to mean moving the arm strut 50A-S and the leg strut 38A-S away from each other.

Alternative Embodiments of Portable Barrier

One alternative embodiment of a portable barrier according to the present disclosure is shown in FIGS. 83-86 as the portable barrier 10'. Since the portable barrier 10' has a very similar construction in comparison to the portable barrier 10, the reference numbers used to identify components in FIGS. 1-82 are also applicable to the portable barrier 10' with the exception that a prime symbol (') is used to denote components of the portable barrier 10' in FIGS. 83-86. Also, since the portable barrier 10' has a very similar construction in comparison to the portable barrier only the differences between the back screen components and the tensioner of the portable barriers 10, 10' will be discussed. Again, it should be appreciated that while the tensioner and the back screen components of the portable barrier 10' have differences in comparison to the tensioner and the back screen components of the portable barrier 10, the rest of the components of the portable barrier 10' are essentially the same as the rest of the components of the portable barrier 10.

The portable barrier 10' includes a tensioner 100'. The tensioner 100' includes five tension lines 102' that each extends outwardly in different directions from a central connection location 104'. All five tension lines 102' are commonly connected to each other at the central connection location 104' by sewing. The tension 10' is constructed and configured in the exact same manner as the tensioner 100 of the portable barrier 10 described above. The tension lines 102' of the tensioner are also connected to the pole structures of the portable barrier 10' in the exact same manner as the tension lines 102 are connected to the pole structures of the portable barrier 10 described above. (Recall the pole structures are the legs including their leg struts and leg extensions, the arms including their arm struts and arm extensions, and the actuator component.)

The difference between the portable barrier 10 and the portable barrier 10' is that the tensioner 10' does not carry a back screen panel thereon. Rather, the portable barrier 10' includes a single back screen BS that is configured and secured to the pole structures of the portable barrier 10' in a manner similar to that shown in the '365 Patent. While the portable barrier 10' does not show use of an elastic cord (in FIGS. 83-86) similar to the elastic cord 120 of the portable barrier 10 of the present invention, the portable barrier 10' does include a similar elastic cord which is constructed and utilized in the exact same manner as the elastic cord 120 of the portable barrier 10 described above.

Another alternative embodiment of a portable barrier according to the present disclosure is not shown but may be constructed in the following manner. This alternative portable barrier utilizes a single back screen that is configured in a manner similar to that shown in the '365 Patent (and similar to the single back screen of the portable barrier 10' described herein). This single back screen would be carried completely by a tensioner similar to tensioner 100, 100' (e.g. by being sewn to the tensioner), with the exception that the lower right side of the single back screen would be attached to its actuator component (e.g. like actuator component 51, 51') in a manner similar to the securing of the lower right side of the single back screen BS of the portable barrier 10' at the location CP in FIG. 83 (e.g. by use of a panel holder as described with regard to the portable barrier 10, or alternatively by use of a screw or rivet).

There is a plurality of advantages arising from the various features of each of the embodiments of the portable barrier described herein (such as portable barriers 10, 10'). It will be noted that alternative embodiments of the portable barrier may not include all of the features described yet still benefit from at least some of the advantages of such features. Those of ordinary skill in the art may readily devise their own implementations of the portable barrier that incorporate one or more of the features of the portable barrier described herein (such as the portable barriers 10, 10') and fall within the spirit and scope of the present invention as defined by the appended claims and/or concepts.

Other Disclosed Concepts

1A. A method of setting up a portable barrier that has a cover assembly including (i) a first arm having a first arm strut and a first arm extension that are pivotably coupled together so that the first arm is positionable between a collapsed first arm configuration and an expanded first arm configuration, (ii) a second arm having a second arm strut and a second arm extension that are pivotably coupled together so that the second arm is positionable between a collapsed second arm configuration and an expanded second arm configuration, and (iii) a cover attached to the first arm extension and the second arm extension, the method comprising:

(a) moving a tensioner from a collapsed tensioner configuration to an expanded tensioner configuration;

(b) moving the first arm from the collapsed first arm configuration to the expanded first arm configuration; and (c) moving the second arm from the collapsed second arm configuration to the expanded second arm configuration, wherein steps (b) and (c) are performed in response to step (a).

2A. The method of concept 1A, further comprising:

maintaining the first arm in the expanded first arm configuration with the tensioner after step (b), and maintaining the second arm in the expanded second arm configuration with the tensioner after step (c), 3A. The method of concept 2A, wherein the portable barrier further has a pedestal assembly which includes (i) a first leg having a first leg strut and a first leg extension that are pivotably coupled together so that the first leg is positionable between a collapsed first leg configuration and an expanded first leg configuration, and (ii) a second leg having a second leg strut and a second extension that are pivotably coupled together so that the second leg is positionable between a collapsed second leg configuration and an expanded second leg configuration, the method further comprising:

moving the first leg from the collapsed first leg configuration to the expanded first leg configuration;

moving the second leg from the collapsed second leg configuration to the expanded second leg configuration;

maintaining the first leg in the expanded first leg configuration with the tensioner after the first leg moving step; and maintaining the second leg in the expanded second leg configuration with the tensioner after the second leg moving step.

4A. The method of concept 3A, further comprising moving the first arm and the second arm away from each other, and deploying the cover at least partially in response thereto.

5A. The method of concept 4A, wherein the pedestal assembly further includes a floor attached to the first leg extension and the second leg extension, the method further comprising:

moving the first leg and the second leg away from each other, and deploying the floor in response thereto.

6A. The method of concept 5A, wherein the cover is positioned over the floor to define an occupant space between the cover and floor after both the floor and the cover are deployed.

7A. The method of concept 6A, further comprising positioning a chair in the occupant space on the floor after both the floor and the cover are deployed.

8A. The method of concept 5A, wherein:

the step of deploying the floor includes moving the floor from a collapsed floor configuration to an expanded floor configuration, and the step of deploying the cover includes moving the cover from a collapsed cover configuration to an expanded cover configuration.

9A. The method of concept 8A, further comprising:

limiting movement of the first leg in relation to the second leg with the floor; and limiting movement of the first arm in relation to the second arm with the cover.

10A. The method of concept 4A, wherein the pedestal assembly further includes a limiter attached to the first leg and the second leg, further comprising:

moving the first leg and the second leg away from each other, limiting movement of the first leg in relation to the second leg with the limiter; and limiting movement of the first arm in relation to the second arm with the cover.

11A. The method of concept 10A, wherein the limiter includes a floor that is attached to the first leg extension and the second leg extension.

12A. The method of concept 10A, wherein the limiter includes a strap segment that is attached to the first leg extension and the second leg extension.

13A. The method of concept 10A, wherein the limiter includes a strap segment that is attached to the first leg strut and the second leg strut.

14A. The method of concept 2A, wherein (i) the cover assembly further includes an intermediate arm interposed between the first arm and the second arm, (ii) the intermediate arm has an intermediate arm strut and an intermediate arm extension that are pivotably coupled together so that the intermediate arm is positionable between a collapsed intermediate arm configuration and an expanded intermediate arm configuration, and (ii) the cover is further attached to the intermediate arm extension, the method further comprising:

moving the intermediate arm from the collapsed intermediate arm configuration to the expanded intermediate arm configuration in response to step (a), and maintaining the intermediate arm in the expanded intermediate arm configuration with the tensioner after the intermediate arm extension moving step.

15A. The method of concept 2A, wherein the portable barrier further includes a back screen that is attached to the tensioner, further comprising:

moving the back screen from a collapsed back screen configuration to an expanded back screen configuration in response to step (a).

16A. The method of concept 2A, wherein the portable barrier further includes (i) an actuator component movable in relation to the second arm, (ii) a first back screen panel attached to the tensioner, (iii) a second back screen panel attached to the first arm strut and the first leg strut, and (iv) a third back screen panel attached to the second arm strut and the actuator component, further comprising:

moving the first back screen panel from a collapsed first back screen panel configuration to an expanded first back screen panel configuration in response to step (a);

moving the first arm and the first leg away from each other;

moving the second back screen panel from a collapsed second back screen panel configuration to an expanded second back screen panel configuration in response to moving the first arm and the first leg away from each other;

moving the actuator component and the second arm away from each other; and moving the third back screen panel from a collapsed third back screen panel configuration to an expanded third back screen panel configuration in response to moving the actuator component and the second arm away from each other.

17A. The method of concept 2A, wherein:

the first arm maintaining step includes applying force to the first arm extension with the tensioner to cause the first arm to be retained in the expanded first arm configuration, and the second arm maintaining step includes applying force to the second arm extension with the tensioner to cause the second arm to be retained in the expanded second arm configuration.

18A. The method of concept 3A, wherein:

the first arm maintaining step includes applying force to the first arm extension with the tensioner to cause the first arm to be retained in the expanded first arm configuration, the second arm maintaining step includes applying force to the second arm extension with the tensioner to cause the second arm to be retained in the expanded second arm configuration;

the first leg maintaining step includes applying force to the first leg extension with the tensioner to cause the first leg to be retained in the expanded first leg configuration, and the second leg maintaining step includes applying force to the second leg extension with the tensioner to cause the second leg to be retained in the expanded second leg configuration.

19A. The method of concept 14A, wherein:

the first arm maintaining step includes applying force to the first arm extension with the tensioner to cause the first arm to be retained in the expanded first arm configuration, the second arm maintaining step includes applying force to the second arm extension with the tensioner to cause the second arm to be retained in the expanded second arm configuration;

the intermediate arm maintaining step includes applying force to the intermediate arm extension with the tensioner to cause the intermediate arm to be retained in the expanded intermediate arm configuration;

the first leg maintaining step includes applying force to the first leg extension with the tensioner to cause the first leg to be retained in the expanded first leg configuration, and the second leg maintaining step includes applying force to the second leg extension with the tensioner to cause the second leg to be retained in the expanded second leg configuration.

1B. A method of setting up a portable barrier that includes a pedestal assembly, a cover assembly, and a tensioner, wherein:

the pedestal assembly includes (i) a first leg having a first leg strut and a first leg extension that are pivotably coupled together so that the first leg is positionable between a collapsed first leg configuration and an expanded first leg configuration, (ii) a second leg having a second leg strut and a second extension that are pivotably coupled together so that the second leg is positionable between a collapsed second leg configuration and an expanded second leg configuration, and (iii) a floor attached to the first leg and the second leg, and the cover assembly includes (i) a first arm having a first arm strut and a first arm extension that are pivotably coupled together so that the first arm is positionable between a collapsed first arm configuration and an expanded first arm configuration, (ii) a second arm having a second arm strut and a second arm extension that are pivotably coupled together so that the second arm is positionable between a collapsed second arm configuration and an expanded second arm configuration, and (iii) a cover attached to the first arm extension and the second arm extension, the method comprising:

(a) moving the first leg from the collapsed first leg configuration to the expanded first leg configuration;

(b) moving the second leg from the collapsed second leg configuration to the expanded second leg configuration;

(c) moving the first arm from the collapsed first arm configuration to the expanded first arm configuration; and (d) moving the second arm from the collapsed second arm configuration to the expanded second arm configuration, (e) moving the tensioner from a collapsed tensioner configuration to an expanded tensioner configuration;

(f) while the tensioner is positioned in the expanded tensioner configuration (1) maintaining the first leg in the expanded first leg configuration with the tensioner, (2) maintaining the second leg in the expanded second leg configuration with the tensioner, (3) maintaining the first arm in the expanded first arm configuration with the tensioner, and (4) maintaining the second arm in the expanded second arm configuration with the tensioner.

2B. The method of concept 1B, wherein steps (c) and (d) are performed in response to step (e).

3B. The method of concept 1B, further comprising:

moving the first leg and the second leg away from each, and deploying the floor in response thereto; and moving the first arm and the second arm away from each, and deploying the cover at least partially in response thereto, wherein the cover is positioned over the floor to define an occupant space between the cover and floor after both the floor and the cover are deployed.

4B. The method of concept 3B, further comprising positioning a chair in the occupant space on the floor after both the floor and the cover are deployed.

5B. The method of concept 3B, wherein:

the step of deploying the floor includes moving the floor from a collapsed floor configuration to an expanded floor configuration, and the step of deploying the cover includes moving the cover from a collapsed cover configuration to an expanded cover configuration.

6B. The method of concept 3B, further comprising:

limiting movement of the first leg in relation to the second leg with the floor; and limiting movement of the first arm in relation to the second arm with the cover.

7B. The method of concept 1B, wherein (i) the cover assembly further includes an intermediate arm interposed between the first arm and the second arm, (ii) the intermediate arm has an intermediate arm strut and an intermediate arm extension that are pivotably coupled together so that the intermediate arm is positionable between a collapsed intermediate arm configuration and an expanded intermediate arm configuration, and (ii) the cover is further attached to the intermediate arm extension, the method further comprising:

moving the intermediate arm from a collapsed intermediate arm configuration to an expanded intermediate arm configuration, and maintaining the intermediate arm in the expanded intermediate arm configuration with the tensioner while the tensioner is positioned in the expanded tensioner configuration.

8B. The method of concept 1B, wherein the portable barrier further includes a back screen that is attached to the tensioner, further comprising:

moving the back screen from a collapsed back screen configuration to an expanded back screen configuration in response to step (e).

9B. The method of concept 1B, wherein the portable barrier further includes (i) an actuator component movable in relation to the second arm, (ii) a first back screen panel attached to the tensioner, (iii) a second back screen panel attached to the first arm strut and the first leg strut, and (iv) a third back screen panel attached to the second arm strut and the actuator component, further comprising:

moving the first back screen panel from a collapsed first back screen panel configuration to an expanded first back screen panel configuration in response to step (e);

moving the first arm and the first leg away from each other;

moving the second back screen panel from a collapsed second back screen panel configuration to an expanded second back screen panel configuration in response to moving the first arm and the first leg away from each other;

moving the actuator component and the second arm away from each other; and moving the third back screen panel from a collapsed third back screen panel configuration to an expanded third back screen panel configuration in response to moving the actuator component and the second arm away from each other.

10B. The method of concept 1B, wherein:

the step (f)(1) includes applying force to the first leg extension with the tensioner to cause the first leg to be retained in the expanded first leg configuration, the step (f)(2) includes applying force to the second leg extension with the tensioner to cause the second leg to be retained in the expanded second leg configuration;

the step (f)(3) includes applying force to the first arm extension with the tensioner to cause the first arm to be retained in the expanded first arm configuration, and the step (f)(4) includes applying force to the second arm extension with the tensioner to cause the second arm to be retained in the expanded second arm configuration.

11B. The method of concept 7B, wherein:

the step (f)(1) includes applying force to the first leg extension with the tensioner to cause the first leg to be retained in the expanded first leg configuration, the step (f)(2) includes applying force to the second leg extension with the tensioner to cause the second leg to be retained in the expanded second leg configuration;

the step (f)(3) includes applying force to the first arm extension with the tensioner to cause the first arm to be retained in the expanded first arm configuration, and the step (f)(4) includes applying force to the second arm extension with the tensioner to cause the second arm to be retained in the expanded second arm configuration; and the intermediate arm maintaining step includes applying force to the intermediate arm extension with the tensioner to cause the intermediate arm to be retained in the expanded intermediate arm configuration while the tensioner is positioned in the expanded tensioner configuration.

1D. A portable barrier, comprising:

a pedestal assembly including a plurality of legs that are movable with respect to each other, each of the plurality of legs includes a leg strut and a leg extension that are pivotably coupled together so that the leg is positionable between a collapsed leg configuration and an expanded leg configuration;

a cover assembly including a plurality of arms that are movable with respect to each other, each of the plurality of arms includes an arm strut and an arm extension that are pivotably coupled together so that the arm is positionable between a collapsed arm configuration and an expanded arm configuration; and a tensioner movable between a collapsed tensioner configuration and an expanded tensioner configuration, wherein movement of the tensioner from the collapsed tensioner configuration to the expanded tensioner configuration causes the arm to be moved from the collapsed arm configuration to the expanded arm configuration.

2D. The portable barrier of concept 1D, wherein the arm is maintained in the expanded arm configuration while the tensioner is positioned in the expanded tensioner configuration.

3D. The portable barrier of concept 2D, wherein the leg is maintained in the expanded leg configuration while the tensioner is positioned in the expanded tensioner configuration.

4D. The portable barrier of concept 1D, wherein:

the tensioner includes a plurality of leg straps and a plurality of arm straps, each of the plurality of leg straps is respectively connected to the leg extension, each of the plurality of arm straps is respectively connected to the arm extension.

5D. The portable barrier of concept 4D, wherein the plurality of leg straps is connected to the plurality of arm straps.

6D. The portable barrier of concept 1D, wherein:

the tensioner includes a plurality of leg tension lines and a plurality of arm tension lines, each of the plurality of leg tension lines is respectively connected to the leg extension, each of the plurality of arm tension lines is respectively connected to the arm extension.

7D. The portable barrier of concept 4D, wherein the plurality of leg tension lines is connected to the plurality of arm tension lines.

8D. The portable barrier of concept 6D, wherein:

each the plurality of leg tension lines includes a rope or cord segment, and each the plurality of arm tension lines includes a rope or cord segment.

9D. The portable barrier of concept 6D, wherein:

each the plurality of leg tension lines includes a strap or webbing segment, and each the plurality of arm tension lines includes a strap or webbing segment.

10D. The portable barrier of concept 1D, wherein:

the cover assembly further includes a cover attached to the plurality of arms, and the cover is movable between a collapsed cover configuration and an expanded cover configuration.

11D. The portable barrier of concept 10D, wherein:

the pedestal assembly further includes a floor attached to the plurality of legs, and the floor is movable between a collapsed floor configuration and an expanded floor configuration.

12D. The portable barrier of concept 10D, wherein:

the pedestal assembly further includes a strap attached to the plurality of legs, and the strap is movable between a collapsed strap configuration and an expanded strap configuration.

13D. The portable barrier of concept 1D, further comprising a junction assembly, wherein:

the arm strut extends from the junction assembly, and the arm extension is pivotably coupled to the arm strut.

14D. The portable barrier of concept 11D, further comprising a junction assembly, wherein:

the leg strut extends from the junction assembly, the leg extension is pivotably coupled to the leg strut, the arm strut also extends from the junction assembly, and the arm extension is pivotably coupled to the arm strut.

15D. The portable barrier of concept 11D, wherein:

the portable barrier is configured to move between a protection mode and a storage mode, and an occupant space is defined between the floor and the cover when the portable barrier is positioned in the protection mode.

1E. A portable barrier, comprising:

a junction assembly;

a pedestal assembly including (i) a plurality of legs that are movable with respect to each other, the plurality of legs includes a first leg and a second leg, and (ii) a limiter connected to the first leg and the second leg;

a cover assembly including (i) a plurality of arms that are movable with respect to each other, the plurality of arms includes a first arm and a second arm, and (ii) a cover connected to the first arm and the second arm; and a tensioner movable between a collapsed tensioner configuration and an expanded tensioner configuration, wherein the first leg includes (i) a first leg strut extending from the junction assembly, and (ii) a first leg extension pivotably coupled to the first leg strut, wherein the second leg includes (i) a second leg strut extending from the junction assembly, and (ii) a second leg extension pivotably coupled to the second leg strut, wherein the first arm includes (i) a first arm strut extending from the junction assembly, and (ii) a first arm extension pivotably coupled to the first arm strut, wherein the second arm includes (i) a second arm strut extending from the junction assembly, and (ii) a second arm extension pivotably coupled to the second arm strut, and wherein the tensioner is attached to each of the first leg extension, the second leg extension, the first arm extension, and the second arm extension.

2E. The portable barrier of concept 1E, wherein:

the limiter includes a floor, and the floor is attached to the first leg extension and the second leg extension.

3E. The portable barrier of concept 1E, wherein:

the limiter includes a strap, and the strap is attached to the first leg strut and the second leg strut.

4E. The portable barrier of concept 2E, wherein:

the portable barrier is configured to move between a protection mode and a-storage mode, and wherein an occupant space is defined between the cover and the floor when the portable barrier is positioned in the protection mode.

5E. The portable barrier of concept 1E, further comprising a back screen attached to the tensioner.

6E. The portable barrier of concept 5E wherein:

the tensioner includes a plurality of arm straps and a plurality of leg straps, and the back screen is attached to at least one of the plurality of arm straps and/or one of the plurality of leg straps.

7E. The portable barrier of concept 5E, wherein:

the tensioner includes a plurality of arm tension lines and a plurality of leg tension lines, and the back screen is attached to at least one of the plurality of arm tension lines and/or at least one of the plurality of leg tension lines.

8E. The portable barrier of concept 7E, wherein:

each of the plurality of arm tension lines includes a first rope or cord segment, each of the plurality of leg tension lines includes a second rope or cord segment.

9E. The portable barrier of concept 7E, further comprising an actuator component that is movable in relation to the second arm, wherein:

the back screen is also attached to the actuator component.

10E. The portable barrier of concept 1E, wherein:

the plurality of arms further includes an intermediate arm interposed between the first arm and the second arm, the intermediate arm includes (i) an intermediate arm strut extending from the junction assembly, and (ii) an intermediate arm extension pivotably coupled to the intermediate arm strut, and the cover is further attached to the intermediate arm extension.

11E. The portable barrier of concept 1E, wherein:

the first leg further includes a first leg hinge joint, and the first leg extension is configured to pivot with respect to the first leg strut via the first hinge joint, the second leg further includes a second leg hinge joint, and the second leg extension is configured to pivot with respect to the second leg strut via the second hinge joint, the first arm further includes a first arm hinge joint, and the first arm extension is configured to pivot with respect to the first arm strut via the third hinge joint, and the second arm further includes a second arm hinge joint, and the second arm extension is configured to pivot with respect to the second arm strut via the fourth hinge joint.

12E. The portable barrier of concept 1E, further comprising a back screen attached to the tensioner, wherein:

the limiter includes a floor that is attached to the first leg extension and the second leg extension, the portable barrier is configured to move between (i) storage mode, and (ii) a protection mode in which an occupant space is defined between the cover and the floor, the floor is movable between a collapsed floor configuration and an expanded floor configuration, the cover is movable between a collapsed cover configuration and an expanded cover configuration, the back screen is movable between a collapsed back screen configuration and an expanded back screen configuration, when the portable barrier is positioned in the storage mode, (i) the floor is positioned in the collapsed floor configuration, (ii) the cover is positioned in the collapsed cover configuration, (iii) the back screen is positioned in the collapsed back screen configuration, and (iv) the tensioner is positioned in the collapsed tensioner configuration, and when the portable barrier is positioned in the protection mode, (i) the floor is positioned in the expanded floor configuration, (ii) the cover is positioned in the expanded cover configuration, (iii) the back screen is positioned in the expanded back screen configuration, and (iv) the tensioner is positioned in the expanded tensioner configuration.

13E. The portable barrier of concept 1E, further comprising:

an actuator component movable in relation to the second arm;

a back screen assembly including a first back screen member, a second back screen member, and a third back screen member, wherein the first back screen member is attached to the tensioner, wherein the second back screen member is attached to the first leg strut and the first arm strut, and the third back screen member is attached to the second arm strut and the actuator component.

14E. The portable barrier of concept 13E, wherein:

the portable barrier includes a plurality of arm tension lines and a plurality of leg tension lines, and the first back screen member is attached to the plurality of arm tension lines.

15E. The portable barrier of concept 14E, wherein the plurality of arm tension lines and the plurality of leg tension lines each include a rope or cord segment.

16E. The portable barrier of concept 14E, wherein the plurality of arm tension lines and the plurality of leg tension lines each include a strap or webbing segment.

1F. A portable barrier, comprising:

a junction assembly;

a cover assembly including (i) a plurality of arms that are movable with respect to each other, the plurality of arms includes a first arm and a second arm, and (ii) a cover connected to the first arm and the second arm; and a tensioner movable between a collapsed tensioner configuration and an expanded tensioner configuration, wherein the first arm includes (i) a first arm strut extending from the junction assembly, and (ii) a first arm extension pivotably coupled to the first arm strut, wherein the second arm includes (i) a second arm strut extending from the junction assembly, and (ii) a second arm extension pivotably coupled to the second arm strut, and wherein the tensioner is attached to each of the first arm extension and the second arm extension.

2F. The portable barrier of concept 1F, wherein:

the portable barrier is configured to move between a protection mode and a-storage mode.

3F. The portable barrier of concept 1F, further comprising a back screen attached to the tensioner.

4F. The portable barrier of concept 1F, wherein the tensioner includes a plurality of arm 5F. The portable barrier of concept 4F, wherein the plurality of arm tension lines includes a plurality of rope or cord segments.

6F. The portable barrier of concept 4F, wherein the plurality of arm tension lines includes a plurality of strap or webbing segments.

7F. The portable barrier of concept 1F, further comprising an actuator component that is movable in relation to the second arm, wherein:

the back screen is attached to the actuator component.

8F. The portable barrier of concept 1F, wherein:

the plurality of arms further includes an intermediate arm interposed between the first arm and the second arm, the intermediate arm includes (i) an intermediate arm strut extending from the junction assembly, and (ii) an intermediate arm extension pivotably coupled to the intermediate arm strut, and the cover is further attached to the intermediate arm extension.

9F. The portable barrier of concept 1F, wherein:

the first arm further includes a first arm hinge joint, and the first arm extension is configured to pivot with respect to the first arm strut via the first hinge joint, and the second arm further includes a second arm hinge joint, and the second arm extension is configured to pivot with respect to the second arm strut via the second hinge joint.

10F. The portable barrier of concept 1F, further comprising a back screen attached to the tensioner, wherein:

the portable barrier is configured to move between a storage mode and a protection mode, the cover is movable between a collapsed cover configuration and an expanded cover configuration, the back screen is movable between a collapsed back screen configuration and an expanded back screen configuration, when the portable barrier is positioned in the storage mode, (i) the cover is positioned in the collapsed cover configuration, (ii) the back screen is positioned in the collapsed back screen configuration, and (iii) the tensioner is positioned in the collapsed tensioner configuration, and when the portable barrier is positioned in the protection mode, (i) the cover is positioned in the expanded cover configuration, (ii) the back screen is positioned in the expanded back screen configuration, and (iii) the tensioner is positioned in the expanded tensioner configuration.

What is claimed is:

1. A method of setting up a portable barrier that includes a pedestal assembly, a cover assembly, and a tensioner, wherein:

the pedestal assembly includes (i) a first leg having a first leg strut and a first leg extension that are pivotably coupled together so that the first leg is positionable between a collapsed first leg configuration and an expanded first leg configuration, (ii) a second leg having a second leg strut and a second leg extension that are pivotably coupled together so that the second leg is positionable between a collapsed second leg configuration and an expanded second leg configuration, and (iii) a limiter attached to the first leg and the second leg, and the cover assembly includes (i) a first arm having a first arm strut and a first arm extension that are pivotably coupled together so that the first arm is positionable between a collapsed first arm configuration and an expanded first arm configuration, (ii) a second arm having a second arm strut and a second arm extension that are pivotably coupled together so that the second arm is positionable between a collapsed second arm configuration and an expanded second arm configuration, and (iii) a cover attached to the first arm extension and the second arm extension, the method comprising:

(a) moving the first leg from the collapsed first leg configuration to the expanded first leg configuration;

(b) moving the second leg from the collapsed second leg configuration to the expanded second leg configuration;

(c) moving the first arm from the collapsed first arm configuration to the expanded first arm configuration; and (d) moving the second arm from the collapsed second arm configuration to the expanded second arm configuration, (e) moving the tensioner from a collapsed tensioner configuration to an expanded tensioner configuration; and (f) while the tensioner is positioned in the expanded tensioner configuration (1) maintaining the first leg in the expanded first leg configuration with the tensioner, (2) maintaining the second leg in the expanded second leg configuration with the tensioner, (3) maintaining the first arm in the expanded first arm configuration with the tensioner, and (4) maintaining the second arm in the expanded second arm configuration with the tensioner, wherein the portable barrier further includes a back screen that is attached to the tensioner, the method further comprising:

moving the back screen from a collapsed back screen configuration to an expanded back screen configuration in response to step (e).

2. The method of claim 1, wherein steps (c) and (d) are performed at least partially in response to step (e).

3. The method of claim 1, wherein the limiter includes a floor, the method further comprising:

moving the first leg and the second leg away from each, and deploying the floor in response thereto; and moving the first arm and the second arm away from each, and deploying the cover at least partially in response thereto, wherein the cover is positioned over the floor to define an occupant space between the cover and floor after both the floor and the cover are deployed.

4. The method of claim 3, further comprising positioning a chair in the occupant space on the floor after both the floor and the cover are deployed.

5. The method of claim 3, wherein:

the step of deploying the floor includes moving the floor from a collapsed floor configuration to an expanded floor configuration, and the step of deploying the cover includes moving the cover from a collapsed cover configuration to an expanded cover configuration.

6. The method of claim 3, further comprising:

limiting movement of the first leg in relation to the second leg with the floor; and limiting movement of the first arm in relation to the second arm with the cover.

7. The method of claim 1, wherein (i) the cover assembly further includes an intermediate arm interposed between the first arm and the second arm, (ii) the intermediate arm has an intermediate arm strut and an intermediate arm extension that are pivotably coupled together so that the intermediate arm is positionable between a collapsed intermediate arm configuration and an expanded intermediate arm configuration, and (ii) the cover is further attached to the intermediate arm extension, the method further comprising:

moving the intermediate arm from a collapsed intermediate arm configuration to an expanded intermediate arm configuration, and maintaining the intermediate arm in the expanded intermediate arm configuration with the tensioner while the tensioner is positioned in the expanded tensioner configuration.

8. The method of claim 7, wherein:

the step (f)(1) includes applying force to the first leg extension with the tensioner to cause the first leg to be retained in the expanded first leg configuration, the step (f)(2) includes applying force to the second leg extension with the tensioner to cause the second leg to be retained in the expanded second leg configuration;

the step (f)(3) includes applying force to the first arm extension with the tensioner to cause the first arm to be retained in the expanded first arm configuration, and the step (f)(4) includes applying force to the second arm extension with the tensioner to cause the second arm to be retained in the expanded second arm configuration; and the intermediate arm maintaining step includes applying force to the intermediate arm extension with the tensioner to cause the intermediate arm to be retained in the expanded intermediate arm configuration while the tensioner is positioned in the expanded tensioner configuration.

9. The method of claim 1, wherein:

the step (f)(1) includes applying force to the first leg extension with the tensioner to cause the first leg to be retained in the expanded first leg configuration, the step (f)(2) includes applying force to the second leg extension with the tensioner to cause the second leg to be retained in the expanded second leg configuration;

the step (f)(3) includes applying force to the first arm extension with the tensioner to cause the first arm to be retained in the expanded first arm configuration, and the step (f)(4) includes applying force to the second arm extension with the tensioner to cause the second arm to be retained in the expanded second arm configuration.

10. The method of claim 1, wherein the limiter is a floor attached to the first leg extension and the second leg extension.

11. The method of claim 1, wherein the limiter is a strap or webbing segment attached to the first leg strut and the second leg strut.

12. The method of claim 1, wherein the limiter is a strap or webbing segment attached to the first leg extension and the second leg extension.

13. A method of setting up a portable barrier that includes a pedestal assembly, a cover assembly, and a tensioner, wherein:

the pedestal assembly includes (i) a first leg having a first leg strut and a first leg extension that are pivotably coupled together so that the first leg is positionable between a collapsed first leg configuration and an expanded first leg configuration, (ii) a second leg having a second leg strut and a second leg extension that are pivotably coupled together so that the second leg is positionable between a collapsed second leg configuration and an expanded second leg configuration, and (iii) a limiter attached to the first leg and the second leg, and the cover assembly includes (i) a first arm having a first arm strut and a first arm extension that are pivotably coupled together so that the first arm is positionable between a collapsed first arm configuration and an expanded first arm configuration, (ii) a second arm having a second arm strut and a second arm extension that are pivotably coupled together so that the second arm is positionable between a collapsed second arm configuration and an expanded second arm configuration, and (iii) a cover attached to the first arm extension and the second arm extension, the method comprising:

(a) moving the first leg from the collapsed first leg configuration to the expanded first leg configuration;

(b) moving the second leg from the collapsed second leg configuration to the expanded second leg configuration;

(c) moving the first arm from the collapsed first arm configuration to the expanded first arm configuration; and (d) moving the second arm from the collapsed second arm configuration to the expanded second arm configuration, (e) moving the tensioner from a collapsed tensioner configuration to an expanded tensioner configuration; and (f) while the tensioner is positioned in the expanded tensioner configuration (1) maintaining the first leg in the expanded first leg configuration with the tensioner, (2) maintaining the second leg in the expanded second leg configuration with the tensioner, (3) maintaining the first arm in the expanded first arm configuration with the tensioner, and (4) maintaining the second arm in the expanded second arm configuration with the tensioner, wherein the portable barrier further includes (i) an actuator component movable in relation to the second arm, (ii) a first back screen panel attached to the tensioner, (iii) a second back screen panel attached to the first arm strut and the first leg strut, and (iv) a third back screen panel attached to the second arm strut and the actuator component, the method further comprising:

moving the first back screen panel from a collapsed first back screen panel configuration to an expanded first back screen panel configuration in response to step (e);

moving the first arm and the first leg away from each other;

moving the second back screen panel from a collapsed second back screen panel configuration to an expanded second back screen panel configuration in response to moving the first arm and the first leg away from each other;

moving the actuator component and the second arm away from each other; and moving the third back screen panel from a collapsed third back screen panel configuration to an expanded third back screen panel configuration in response to moving the actuator component and the second arm away from each other.

14. A portable barrier, comprising:

a junction assembly;

a cover assembly including (i) a plurality of arms that are movable with respect to each other, the plurality of arms includes a first arm and a second arm, and (ii) a cover connected to the first arm and the second arm;

a tensioner movable between a collapsed tensioner configuration and an expanded tensioner configuration; and a back screen attached to the tensioner, wherein the first arm includes (i) a first arm strut extending from the junction assembly, and (ii) a first arm extension pivotably coupled to the first arm strut, wherein the second arm includes (i) a second arm strut extending from the junction assembly, and (ii) a second arm extension pivotably coupled to the second arm strut, and wherein the tensioner is attached to each of the first arm extension and the second arm extension.

15. The portable barrier of claim 14, wherein:

the portable barrier is configured to move between a protection mode and a storage mode.

16. The portable barrier of claim 14, wherein the tensioner includes a plurality of arm tension lines.

17. The portable barrier of claim 16, wherein the plurality of arm tension lines includes a plurality of strap or webbing segments.

18. The portable barrier of claim 14, wherein:

the portable barrier is configured to move between a storage mode and a protection mode, the cover is movable between a collapsed cover configuration and an expanded cover configuration, the back screen is movable between a collapsed back screen configuration and an expanded back screen configuration, when the portable barrier is positioned in the storage mode, (i) the cover is positioned in the collapsed cover configuration, (ii) the back screen is positioned in the collapsed back screen configuration, and (iii) the tensioner is positioned in the collapsed tensioner configuration, and when the portable barrier is positioned in the protection mode, (i) the cover is positioned in the expanded cover configuration, (ii) the back screen is positioned in the expanded back screen configuration, and (iii) the tensioner is positioned in the expanded tensioner configuration.

* * * * *